US011569616B2

(12) United States Patent
Musser et al.

(10) Patent No.: US 11,569,616 B2
(45) Date of Patent: Jan. 31, 2023

(54) CONNECTOR WITH TOP- AND BOTTOM-STITCHED CONTACTS

(71) Applicant: Samtec, Inc., New Albany, IN (US)

(72) Inventors: Randall E. Musser, New Albany, IN (US); Jonathan E. Buck, New Albany, IN (US)

(73) Assignee: SAMTEC, INC., New Albany, IN (US)

( * ) Notice: Subject to any disclaimer, the term of this patent is extended or adjusted under 35 U.S.C. 154(b) by 0 days.

(21) Appl. No.: 17/056,486

(22) PCT Filed: Jul. 3, 2019

(86) PCT No.: PCT/US2019/040584

§ 371 (c)(1),
(2) Date: Nov. 18, 2020

(87) PCT Pub. No.: WO2020/010245

PCT Pub. Date: Jan. 9, 2020

(65) Prior Publication Data

US 2021/0126401 A1 Apr. 29, 2021

Related U.S. Application Data

(60) Provisional application No. 62/704,038, filed on Dec. 17, 2018, provisional application No. 62/704,031,
(Continued)

(51) Int. Cl.
*H01R 13/6461* (2011.01)
*H01R 12/71* (2011.01)
(Continued)

(52) U.S. Cl.
CPC ..... *H01R 13/6461* (2013.01); *H01R 12/716* (2013.01); *H01R 13/41* (2013.01); *H01R 13/50* (2013.01); *H01R 12/57* (2013.01)

(58) Field of Classification Search
CPC .. H01R 13/6461; H01R 12/716; H01R 13/41; H01R 13/50; H01R 12/57; H01R 43/205;
(Continued)

(56) References Cited

U.S. PATENT DOCUMENTS 4,647,130 A 3/1987 Blair et al.
4,780,095 A 10/1988 Classon et al.
(Continued)

FOREIGN PATENT DOCUMENTS

CN 2508424 Y 8/2002
CN 1529924 A 9/2004
(Continued)

OTHER PUBLICATIONS

Official Communication issued in corresponding Chinese Patent Application No. 201910602689.8, dated Oct. 10, 2020.
(Continued)

*Primary Examiner* — Abdullah A Riyami
*Assistant Examiner* — Nelson R. Burgos-Guntin
(74) *Attorney, Agent, or Firm* — Keating & Bennett, LLP

(57) ABSTRACT

To help maintain and improve signal integrity, a connector housing can include one or more of the following: asymmetric keying features, asymmetric alignment features, and alternating stitched contacts. First and second contact rows and third and fourth contact rows can each have a first row pitch, and the second and the third contact rows can have a second, greater row pitch. First and second keying structures can be positioned non-symmetrically about both longitudinal and median centerlines of the connector housing. If first, second, third, and fourth contacts all lie on a common centerline of the connector housing, the first and the third contacts can be inserted in a first direction, and the second and the fourth contacts can be inserted in a second, opposite direction. First and second contact securing structures can
(Continued)

engage the connector housing at different heights of the connector housing.

13 Claims, 31 Drawing Sheets

Related U.S. Application Data filed on Nov. 5, 2018, provisional application No. 62/694,832, filed on Jul. 6, 2018.

(51) Int. Cl.
*H01R 13/41* (2006.01)
*H01R 13/50* (2006.01)
*H01R 12/57* (2011.01)

(58) Field of Classification Search
CPC .... H01R 13/6453; H01R 13/02; H01R 12/58; H01R 13/40; H01R 13/502; H01R 13/6275; H01R 13/631; H01R 13/64; H01R 24/005; H01R 13/2407; H01R 43/007; H05K 1/116
See application file for complete search history.

(56) References Cited

U.S. PATENT DOCUMENTS 5,211,585 A 5/1993 Douty et al.
5,525,071 A 6/1996 Obara et al.
5,618,191 A 4/1997 Chikano et al.
5,848,920 A 12/1998 Klein et al.
D407,690 S 4/1999 Lai et al.
5,904,581 A 5/1999 Pope et al.
5,941,715 A 8/1999 Huang
6,135,781 A 10/2000 Pope et al.
D451,885 S 12/2001 Hisatomi et al.
6,328,602 B1 * 12/2001 Yamasaki ..... H01R 13/6471 439/607.11
6,343,951 B1 2/2002 Ono et al.
6,361,373 B1 3/2002 Horchler
D455,127 S 4/2002 Wu
6,454,574 B1 9/2002 Yu
6,634,894 B1 10/2003 Ko
6,638,106 B1 * 10/2003 Wu ..... H01R 12/7064 439/567
6,699,048 B2 3/2004 Johnson et al.
6,702,590 B2 3/2004 Zaderej et al.
D489,039 S 4/2004 Kawase et al.
D489,687 S 5/2004 Kawase et al.
6,746,281 B1 6/2004 Zhang
D500,740 S 1/2005 Fan
D505,920 S 6/2005 Moritake
6,918,776 B2 7/2005 Spink, Jr.
D517,495 S 3/2006 Fan
D561,696 S 2/2008 Chen et al.
7,341,482 B2 3/2008 Ngo
7,384,289 B2 6/2008 Minich
7,422,444 B1 * 9/2008 Johnescu ..... H01R 12/718 439/78
7,422,447 B2 9/2008 Daily et al.
7,442,089 B2 10/2008 Regnier
D582,859 S 12/2008 Sasaki
D582,860 S 12/2008 Sasaki
7,473,138 B2 1/2009 Tuin et al.
7,476,110 B2 * 1/2009 Lemke ..... H01R 43/0249 439/876
7,476,122 B2 1/2009 Zhang
D598,861 S 8/2009 Hoshino et al.
7,581,990 B2 9/2009 Kirk et al.
7,585,188 B2 9/2009 Regnier
D607,836 S 1/2010 Yang
7,708,603 B1 5/2010 Little
7,794,240 B2 9/2010 Cohen et al.
7,896,698 B2 * 3/2011 Trout ..... H01R 12/52 439/607.1
7,955,138 B1 6/2011 Zhu
7,967,647 B2 * 6/2011 Johnescu ..... H01R 12/585 439/733.1
D659,646 S 5/2012 Kajiura et al.
8,251,716 B2 8/2012 Chen
8,251,737 B2 8/2012 Van Stiphout et al.
8,333,617 B2 12/2012 Fjelstad
D708,580 S 7/2014 McCartin et al.
8,764,464 B2 7/2014 Buck et al.
8,784,116 B2 7/2014 Buck et al.
8,821,191 B2 9/2014 Soo
D718,245 S 11/2014 Sato
9,028,281 B2 5/2015 Kirk et al.
9,077,115 B2 7/2015 Yang
9,300,103 B2 3/2016 Buck et al.
D767,501 S 9/2016 Yuan et al.
9,728,873 B2 8/2017 Komoto et al.
9,748,698 B1 8/2017 Morgan et al.
10,404,014 B2 9/2019 Huang et al.
2003/0013325 A1 1/2003 Zaderej et al.
2004/0198077 A1 10/2004 Zaderej et al.
2004/0203281 A1 10/2004 Crane, Jr. et al.
2004/0253863 A1 12/2004 Iwasaki
2006/0084311 A1 4/2006 Suzuki et al.
2006/0178022 A1 8/2006 Liu
2009/0130912 A1 5/2009 Shuey et al.
2010/0167593 A1 7/2010 Yu
2010/0291774 A1 11/2010 Cheng et al.
2011/0201234 A1 8/2011 Long
2011/0256763 A1 10/2011 De Geest et al.
2012/0083155 A1 4/2012 Minich et al.
2012/0094544 A1 4/2012 Sato et al.
2012/0238145 A1 9/2012 Zhang et al.
2012/0252232 A1 10/2012 Buck et al.
2012/0322305 A1 12/2012 Uchiyama
2013/0189866 A1 7/2013 Wagata et al.
2013/0316586 A1 11/2013 Nagamine
2014/0310957 A1 10/2014 Buck et al.
2015/0064940 A1 * 3/2015 Mukunoki ..... H01R 13/436 29/882
2016/0036145 A1 * 2/2016 Hasegawa ..... H01R 12/716 439/78
2016/0064837 A1 3/2016 Yu et al.
2016/0134057 A1 5/2016 Buck et al.
2017/0125930 A1 5/2017 Komoto et al.
2017/0125946 A1 5/2017 Horchler et al.
2018/0145467 A1 * 5/2018 Doi ..... H01R 12/73
2020/0127417 A1 * 4/2020 Shimba ..... H01R 12/91
2021/0126401 A1 * 4/2021 Musser ..... H01R 13/41
2021/0305752 A1 * 9/2021 Faith ..... H01R 12/721
2021/0320461 A1 * 10/2021 Buck ..... H01R 13/03

FOREIGN PATENT DOCUMENTS

CN 2772061 Y 4/2006
CN 101764305 A 6/2010
CN 201639018 U 11/2010
CN 102832492 A 12/2012
CN 102904086 A 1/2013
CN 103427204 A 12/2013
CN 105449427 A 3/2016
CN 106921056 A 7/2017
CN 107565279 A 1/2018
CN 304487963 S 2/2018
CN 305498393 S 12/2019
CN 215299559 U 12/2021
EP 1 544 949 A1 6/2005
GB 1 418 031 A 12/1975
JP 2001-307804 A 11/2001
JP 2002-083637 A 3/2002
JP 2009-059671 A 3/2009
JP D1413137 S 5/2011
JP 2011-108419 A 6/2011
JP 2014-165029 A 9/2014
TW 391840 5/2000
TW D137889 S1 11/2010

(56) References Cited

FOREIGN PATENT DOCUMENTS

| | | | |
|---|---|---|---|
| TW | D140669 | S1 | 5/2011 |
| TW | D149636 | S1 | 10/2012 |
| TW | D151642 | S1 | 2/2013 |
| TW | D157156 | S | 11/2013 |
| TW | D163688 | S | 10/2014 |
| TW | D167749 | S | 5/2015 |
| TW | D168325 | S | 6/2015 |
| TW | I558026 | B | 11/2016 |
| TW | D190127 | S | 5/2018 |
| TW | D190546 | S | 5/2018 |
| TW | 192655 | D | 9/2018 |
| TW | D197460 | S | 5/2019 |
| TW | D197461 | S | 5/2019 |
| TW | D198415 | S | 7/2019 |
| TW | D198416 | S | 7/2019 |
| TW | D199668 | S | 9/2019 |
| TW | M589915 | U | 1/2020 |
| WO | 2008/017717 | A1 | 2/2008 |
| WO | 2012/138519 | A2 | 10/2012 |
| WO | 2018/039351 | A1 | 3/2018 |

OTHER PUBLICATIONS

Official Communication issued in corresponding Taiwanese Patent Application No. 109305929, dated Feb. 2, 2021.
Official Communication issued in corresponding Taiwanese Patent Application No. 109305930, dated Feb. 2, 2021.
Official Communication issued in corresponding Taiwanese Patent Application No. 109305931, dated Feb. 3, 2021.
Official Communication issued in corresponding Taiwanese Patent Application No. 109300858, dated Feb. 5, 2021.
Official Communication issued in corresponding Taiwanese Patent Application No. 109305927, dated Feb. 2, 2021.
Official Communication issued in corresponding Taiwanese Patent Application No. 109305928, dated Feb. 2, 2021.
Official Communication issued in International Patent Application No. PCT/US2019/040584, dated Nov. 6, 2019.
Hirose Electric Co., Ltd, Drawing No. EDC3-311352-00, Part No. DF40C-*DS-0. 4V(51), Code No. CL684, Nov. 19, 2018, 2 pages.
Hirose Electric Co., Ltd, "DF40 Series•0.4mm Pitch, 1.5 to 4.0mm Height, Board-to-Board and Board-to-FPC Connectors", Mar. 2016, pp. 1-20.
Samtec, ".8MM Q-Rate Terminal Assembly", Drawing No. QRM8-XXX-XX.X-X-D-XX-A-XX, Aug. 27, 2008, pp. 1-4.
Official Communication issued in corresponding Taiwanese Patent Application No. 108123806, dated May 5, 2020.
Official Communication issued in corresponding Taiwanese Patent Application No. 107307068, dated Sep. 26, 2019.
TE Connectivity, "Male Connector Z-Pack Slim UHD", Drawing No. C-2042088, Jan. 3, 2008, 1 page.
Samtec, ".050 Pitch Socket Array Assembly", Dwg. No. SEAF-XX-XX.X-XX-XX-X-A-XX-K-TR-MKT, May 27, 2004, Sheet 1-5.
Samtec, ".050 Pitch Terminal Array Assembly", Dwg. No. SEAM-XX-XX.X-XXX-XX-X-A-XX-K-TR-MKT, Aug. 9, 2010, Sheet 1-7.
PICMG, "COM-HPC Overview", URL: https://www.picmg.org/com-hpc-overview/, retrieved Jul. 30, 2020, pp. pp. 1-3.
Hayes, "The COM-HPC Embedded Standard Will Facilitate High-Performance Computing", URL:https://www.connectorsupplier.com/the-com-hpc-embedded-standard-will-facilitate-high-performance-computing/, Jan. 28, 2020, pp. 1-6.
Samtec, "Accelerate HD Micro Interfaces", ADF6* Series, Nov. 21, 2018, 1 page.
Samtec, "Accelerate HD Micro Interfaces"; ADM6* Series, Nov. 21, 2018, 1 page.
Official Communication issued in corresponding Taiwanese Patent Application No. 108123806, dated Nov. 20, 2020.
Musser et al., "Contact", U.S. Appl. No. 29/655,784, filed Jul. 6, 2018.
Musser et al., "Contact", U.S. Appl. No. 29/655,786, filed Jul. 6, 2018.
Musser et al., "Connector and Contact", U.S. Appl. No. 29/652,012, filed Nov. 5, 2018.
Musser et al., "Connector", U.S. Appl. No. 29/652,014, filed Dec. 17, 2018.
Musser et al., "Connector", U.S. Appl. No. 29/652,015, filed Dec. 17, 2018.
Musser et al., "Connector", U.S. Appl. No. 29/709,518, filed Oct. 15, 2019.
Musser et al., "Connector", U.S. Appl. No. 29/716,201, filed Dec. 6, 2019.
Musser et al., "Connector", U.S. Appl. No. 29/716,202, filed Dec. 6, 2019.
Musser et al., "Connector", U.S. Appl. No. 29/773,719, filed Mar. 11, 2021.
Musser et al., "Contact", U.S. Appl. No. 29/773,721, filed Mar. 11, 2021.
Musser et al., "Contact", U.S. Appl. No. 29/773,722, filed Mar. 11, 2021.
Musser et al., "Connector", U.S. Appl. No. 29/773,723, filed Mar. 11, 2021.
Musser et al., "Connector", U.S. Appl. No. 29/773,724, filed Mar. 11, 2021.
Musser et al., "Connector", U.S. Appl. No. 29/773,725, filed Mar. 11, 2021.
Musser et al., "Contact", U.S. Appl. No. 29/759,286, filed Nov. 20, 2020.
Official Communication issued in International Patent Application No. PCT/US2020/062389, dated Mar. 22, 2021.
Official Communication issued in corresponding Chinese Patent Application No. 201910602689 8, dated Aug. 23, 2021.
Official Communication issued in corresponding Taiwanese Patent Application No. 109142234, dated Sep. 16, 2021.
Official Communication issued in corresponding Chinese Patent Application No. 201910602689.8, dated Jan. 25, 2022.
Official Communication issued in corresponding Taiwanese Design Patent Application No. 110300489, dated Dec. 28, 2021.
Official Communication issued in corresponding European Patent Application No. 19830502.1, dated Mar. 3, 2022.
Musser et al., "Connector and Contact", U.S. Appl. No. 29/832,053, filed Mar. 24, 2022.
Musser et al., "Connector", U.S. Appl. No. 29/832,052, filed Mar. 24, 2022.
Official Communication issued in corresponding Taiwanese Patent Application No. 110303910 dated Mar. 31, 2022.
Musser et al., "Connector", U.S. Appl. No. 29/833,175, filed Apr. 1, 2022.
Musser et al., "Connector", U.S. Appl. No. 29/833,208, filed Apr. 1, 2022.
Musser et al., "Contact", U.S. Appl. No. 29/841,151, filed Jun. 3, 2022.
Official Communication issued in corresponding Taiwanese Patent Application No. 110304333, dated Apr. 29, 2022.
First Office Action in Chinese Patent Application No. 202011418253.2, dated Jun. 15, 2022, 10 pages.
Office Action in Taiwanese Patent Application No. 110303910, dated Aug. 31, 2022, 5 pages.
Office Action in Taiwanese Patent Application No. 110304043, dated Aug. 31, 2022, 5 pages.
Office Action in Taiwanese Patent Application No. 110304333, dated Aug. 31, 2022, 5 pages.

* cited by examiner

CONNECTOR WITH TOP- AND BOTTOM-STITCHED CONTACTS

CROSS REFERENCE TO RELATED APPLICATIONS

This application claims the benefit of U.S. Patent Application No. 62/694,832 filed on Jul. 6, 2018; U.S. Patent Application No. 62/704,031 filed on Nov. 5, 2018; and U.S. Patent Application No. 62/704,038 filed on Dec. 17, 2018. The entire contents of each application are hereby incorporated by reference in their entireties.

BACKGROUND

1. Field of the Invention

The present invention relates to electrical connectors.

2. Description of the Related Art

Connectors are used to place electrical devices in communication with one another. A connector includes contacts that transmit signals to an electrical device or another connector and a housing to support the contacts. The contacts of a connector may each include a raised portion to help secure and position the contacts within the housing. Further, solder may be attached to the contacts. The solder is used to form electrical and mechanical connections between the contact and a pad on a printed circuit board (PCB).

FIG. 1 is an end view and FIG. 2 is a side view of a known contact 20. FIG. 1 shows the contact 20 without a fusible member 40, and FIG. 2 shows the contact 20 with the fusible member 40. The contact 20 includes a head 21 and a tail 22 at the opposite end from the head 21. The head 21 includes the contact beam 23. A medial portion of the contact 20 includes wings 24, wedges 25, lead-ins 26, and a bump 27. The wings 24 engage the bottom of a core of a connector housing to maintain a consistent distance between the tail portion 22 of the contact 20 and the housing. The wedges 25 engage a side wall of the core in order to fix the position of the contact 20 and retain the contact 20 in the core of the housing. The wedges 25 fix the contact 20 in the core in the width direction of the housing to prevent stress from being applied in a length direction of the housing to prevent problems with co-planarity that may lead to an unreliable connection. The lead-ins 26 are formed by coined edges that facilitate insertion of the contacts or terminals 20 into the cores of the housing. The bump 27 positions and stabilizes the contact 20 in a desired position and orientation relative to the housing.

As shown in FIG. 3, known connectors can have an array of contacts 20 arranged in rows. The contacts 30 shown in FIG. 3 are different than the contact 20 shown in FIGS. 1 and 2. As shown in FIG. 3, the contact 30 includes a head 31 and a tail 32 at the opposite end from the head 31. The head 31 includes the contact beam 33. A medial portion of the contact 30 includes wedges 35 and lead-ins 36, and the tail 42 includes a fusible member 39. However, the contact 30 shown in FIG. 3 does not include wings 24 or bumps 27 as included in the contact 20 shown in FIGS. 1 and 2. It is also possible that the contact 20 shown in FIGS. 1 and 2 can be used in the connector shown in FIG. 3. Because of the orientation of wedges 25 and lead-ins 26 (and the wings 24 of the contact 20 shown in FIGS. 1 and 2 is used), the contact 20 is designed to be stitched or inserted from the bottom of the housing. The contact 20 is usually part of a contact ribbon that is included on a spool. The contacts 20 are stitched, or loaded, from the bottom, one row at a time. In a single row, the contacts 20 can be loaded sequentially or simultaneously.

In small connectors, contacts with wider beams can provide better electrical performance. However, wider beams limit the pitch of the contacts. When the beams of the contacts are widened, there is less material from the housing that contacts can engage with, making smaller pitches even more difficult.

SUMMARY OF THE INVENTION

To overcome the problems described above, embodiments of the present invention provide connectors and methods of making connectors, which each achieve improved impedance and return loss, smaller pitches, and contacts with wider beams. One approach is to alternatively stitch, in series along a common row, two different types of contacts from the top and bottom of the connector. Contacts that lie along a common linear array are double stitched from two directions into a housing. First and third contacts are stitched into corresponding first cores in a housing in a first direction, and second contacts, positioned between the first and third contacts, are stitched into a corresponding second core in the housing in a second direction that is directly or 180° opposite to the first direction. The first and third contacts can each define a first securing structure, and the second contacts can each define a second securing structure. Wings, wedges, protrusions, lead-ins, or bumps defined by the first securing structure can extend in a direction opposite to wings, wedges, protrusions, lead-ins, or bumps defined by the second securing structure.

According to an embodiment of the present invention, a connector includes a housing including a linear array, column or row of at least three contacts. The at least three contacts include at least one first contact with a first securing structure and at least one second contact with a second securing structure; the first and second securing structures engage the housing at different heights of the housing; and the first and second securing structures are identical.

Instead of the first and second securing structures being identical, the first and second securing structures can be different. The first and second securing structures can each include at least one of a wing, a wedge, a protrusion, a lead-in, or a bump. The connector further includes a fusible member attached to at least one or each of the at least three contacts. The housing can include first and second cores; the at least one first contact is included in the first cores; the at least one second contact is included in the second cores; and shapes of the first and second cores are different.

According to an embodiment of the present invention, a method of making a connector includes providing a housing with a row of cores and stitching at least three contacts into the row of cores. At least one first contact is stitched from a top of the housing, and at least one second contact is stitched from a bottom of the housing.

The at least one first contact and the at least one second contact can be alternatively stitched, or all of the at least one first contact can be stitched first, and then all of the at least one second contact can be subsequently stitched. The at least one first contact and at least one second contact can be identical or can be different.

The at least one first contact can include a first securing structure, and the at least one second contact can include a second securing structure. The first and second securing structures can engage the housing at different heights of the housing. The first and second securing structures can be identical or can be different. The first and second securing structures can each include at least one of a wing, a wedge, a protrusion, a lead-in, or a bump.

The connector made by the method can further include a fusible member attached to each of the at least three contacts. The housing can include first and second cores; the at least one first contact can be included in the first cores; the at least one second contact can be included in the second cores; and shapes of the first and second cores can be different.

According to an embodiment of the present invention, a connector includes a connector housing that includes first, second, third, and fourth standoffs; first, second, third, and fourth contact rows, each including one hundred contacts; and first and second alignment pegs that extend from a bottom of the connector housing. A contact pitch between adjacent contacts in each of the first, second, third, and fourth contact rows is approximately 0.63 mm; the first and fourth contact rows are outer contact rows, and the second and third contact rows are inner contact rows; a first row pitch between the first contact row and the second contact row is approximately 2.2 mm, a second row pitch between the second contact row and the third contact row is approximately 2.4 mm, and a third row pitch between the third contact row and the fourth contact row is approximately 2.2 mm; each of the first, second, third, and fourth contact rows has a length of approximately 62.8 mm, as measured from the tips of the contacts; a distance between a bottom of the first alignment peg and a bottom of the first standoff, a distance between the bottom of the first alignment peg and a bottom of the second standoff, a distance between a bottom of the second alignment peg and a bottom of the third standoff, and a distance between the bottom of the second alignment peg and a bottom of the fourth standoff are each approximately 0.74 mm; a distance between the first and second alignment pegs is approximately 67.1 mm; at least one of a first distance between the first alignment peg and the centerline along the length of the connector and a second distance between the second alignment peg and the centerline along the length of the connector is approximately 1.2 mm to approximately 1.3 mm; the first alignment peg has a circular shape with a diameter of approximately 0.8 mm; and the second alignment peg has an oval shape with diameters of approximately 0.6 mm and approximately 0.8 mm.

The connector can be a receptacle connector; a shortest distance between tips of the contacts in the first and second row and a shortest distance between tips of the contacts in the third and fourth rows can be each approximately 1.8 mm; the connector housing can include a cavity with a width of approximately 7.1 mm and a length of approximately 65.7 mm; and the connector housing can have a height of approximately 3.7 mm, a length of approximately 68.6 mm, and a width of approximately 9.0 mm.

The connector can be a plug connector; the connector housing can include first and second ribs each having a width of approximately 2.3 mm and a length of approximately 65.5 mm; first and second keying structures can each extend approximately 0.7 mm from the connector housing; a beveled surface of the first keying structure and a first beveled surface of the connector housing can face in opposite directions, and a beveled surface of the second keying structure and a second beveled surface of the connector housing can face in opposite directions; and the connector housing can have a height of approximately 8.4 mm, a length of approximately 68.6 mm, and a width of approximately 8.7 mm.

The second distance can be approximately 1.2 mm to approximately 1.3 mm, and the first distance can be approximately 0 mm.

An electrical connector can include a connector housing and first, second, third, and fourth rows of electrical contacts included in the connector housing in parallel with each other. Each row may include one hundred electrical contacts. The first row of the electrical contacts can be spaced from the second row of electrical contacts by approximately 2.1 mm to approximately 2.3 mm. The third row of electrical contacts can be spaced from the second row of electrical contacts by approximately 2.35 mm to approximately 2.5 mm. The fourth row of electrical contacts can be spaced from the third row of electrical contacts by approximately 2.1 mm to approximately 2.3 mm.

The connector housing extends along a longitudinal centerline and may further include two mount interface posts and two keying structures. One of the two keying structures and the two mount interface posts can be positioned on one side of the longitudinal centerline and another of the two keying structures can be positioned on an opposite side of the longitudinal centerline. The connector housing can further define a first beveled surface and a first keying structure. The first keying structure can define a second beveled surface, and the second beveled surface of the first keying structure and a first beveled surface of the connector housing can face in opposite directions.

Electrical contacts in the first row are spaced apart on approximately 0.63±0.05 mm centerlines. The electrical contacts can be alternately stitched into a top of the electrical housing and a bottom of the electrical housing. The first row of electrical contacts can be spaced from the second row of electrical contacts by approximately 2.2 mm, the third row of electrical contacts can be spaced from the second row of electrical contacts by approximately 2.4 mm, and the fourth row of electrical contacts can be spaced from the third row of electrical contacts by approximately 2.2 mm.

An embodiment of the present invention provides a printed circuit board footprint that matches a mounting footprint of the plug or receptacle connector. The PCB footprint can include first, second, third, and fourth rows of fusible element pads included on the printed circuit board in parallel with each other, each of the first, second, third, and fourth rows of fusible element pads includes one hundred fusible element pads. The first row of fusible element pads can be spaced from a second row of fusible element pads by approximately 2.1 mm to approximately 2.3 mm. The third row of fusible element pads can be spaced from the second row of fusible element pads by approximately 2.35 mm to approximately 2.5 mm. The fourth row of fusible element pads can be spaced from the third row of fusible element pads by approximately 2.1 mm to approximately 2.3 mm.

The first row of fusible element pads can be spaced from the second row of fusible element pads by approximately 2.2 mm, the third row of fusible element pads can be spaced from the second row of fusible element pads by approximately 2.4 mm, and the fourth row of fusible element pads can be spaced from the third row of fusible element pads by approximately 2.2 mm.

According to an embodiment of the present invention, an electrical connector includes a connector body including two parallel, spaced apart longitudinal walls; two parallel, spaced apart end walls with a centerline that extends through the two parallel, spaced apart end walls; a mating interface; a first keying structure positioned at the mating interface and positioned on one side of the centerline; a second keying structure positioned at the mating interface, on an opposite side of the centerline as the first keying structure, and abutting the centerline; a mounting interface; a first alignment peg; and a second alignment peg; and first, second, third, and fourth rows of electrical contacts included in the connector body in parallel with each other, each of the first, second, third, and fourth rows of electrical contacts includes one hundred electrical contacts. The centerline passes through the first alignment peg but does not intersect the second alignment peg. The second alignment peg is positioned at least partially under the first keying structure. The first alignment peg is positioned at least partially under the second keying structure. The first row of electrical contacts is spaced from the second row of electrical contacts by approximately 2.1 mm to approximately 2.3 mm. The third row of electrical contacts is spaced from the second row of electrical contacts by approximately 2.35 mm to approximately 2.5 mm. The fourth row of electrical contacts is spaced from the third row of electrical contacts by approximately 2.1 mm to approximately 2.3 mm. The second alignment peg and one of the first, second, third, and fourth rows of electrical contacts both lie along a common centerline that is parallel to and spaced away from the centerline, such that the common centerline passes through one of the first, second, third and fourth rows of electrical contacts and the second alignment peg.

Each of the first and second keying structures can be a recess having a perimeter with fives sides that include a first set of parallel side walls, a second set of parallel side walls, and a canted side wall that connects a first one of the first set of parallel side walls and a first one of the second set of parallel side walls; the second set of parallel side walls can form respective right angles with a second one of the first set of parallel side walls; and the first one of the first set of parallel side walls can form a right angle with a second one of the second set of parallel side walls. The first one of the first set of parallel side walls can abut the centerline. The second one of the first set of parallel side walls can abut the centerline.

Each of the first and second keying structures can be a protrusion having a perimeter with five sides that include a first set of parallel side walls, a second set of parallel side walls, and a canted side wall that connects a first one of the first set of parallel side walls and a first one of the second set of parallel side walls; the second set of parallel side walls can form respective right angles with a second one of the first set of parallel side walls; and the first one of the first set of parallel side walls can form a right angle with a second one of the second set of parallel side walls. The first one of the first set of parallel side walls can abut the centerline. The second one of the first set of parallel side walls can abut the centerline.

According to an embodiment of the present invention, an electrical connector includes a connector body including two parallel, spaced apart longitudinal walls; two parallel, spaced apart end walls with a centerline that extends through the two parallel, spaced apart end walls parallel to the two parallel, spaced apart longitudinal walls; a mating interface; a first keying structure positioned on the centerline such that the first keying structure is non-symmetrical about the centerline; and a second keying structure positioned on an opposite side of the centerline as the first keying structure; and first, second, third, and fourth rows of electrical contacts included in the connector housing in parallel with each other, each of the first, second, third, and fourth rows of electrical contacts includes one hundred electrical contacts. The second keying structure is non-symmetrical about the centerline. The first keying structure and the second keying structure are offset with respect to each other. The first row of electrical contacts is spaced from the second row of electrical contacts by approximately 2.1 mm to approximately 2.3 mm. The third row of electrical contacts is spaced from the second row of electrical contacts by approximately 2.35 mm to approximately 2.5 mm. The fourth row of electrical contacts is spaced from the third row of electrical contacts by approximately 2.1 mm to approximately 2.3 mm. The first keying structure includes a first set of parallel side walls, a second set of parallel side walls, and a canted side wall that connects a first one of the first set of parallel side walls and a first one of the second set of parallel side walls. The second keying structure is defined by a first set of parallel side walls, a second set of parallel side walls, and a canted side wall that connects a first one of the first set of parallel side walls and a first one of the second set of parallel side walls. The first set of parallel walls of the first keying structure are both evenly spaced from the centerline. The first set of parallel walls of the second keying structure are both unevenly spaced from the centerline. The centerline passes through an intersection of a respective one of the second set of parallel side walls and the canted side wall of only the second keying structure.

A mounting interface of the connector body can include a first alignment peg and a second alignment peg; the centerline can pass through a center point of the first alignment peg; and the second alignment peg can be positioned on either side of the centerline such that the centerline does not intersect the second alignment peg. The second alignment peg can be at least partially positioned under a perimeter defined by the first set of parallel side walls, the second set of parallel side walls, and the canted side wall of the first keying structure. No portion of the first alignment peg is positioned under a perimeter defined by the first set of parallel side walls, the second set of parallel side walls, and the canted side wall of the second keying structure.

According to an embodiment of the present invention, an electrical connector includes a connector housing that extends along a longitudinal centerline and has a median centerline that is perpendicular or substantially perpendicular to the longitudinal centerline, the connector housing including a first end wall and a second end wall opposed to the first end wall; a first, a second, a third, and fourth rows of electrical contacts that are spaced apart in parallel rows, each of the first, the second, the third, and the fourth rows of electrical contacts extend parallel or substantially parallel to the longitudinal centerline; the first row of electrical contacts is spaced from the second row of electrical contacts by a first row pitch; the third row of electrical contacts is spaced from the second row of electrical contacts by a second row pitch greater than the first row pitch; the fourth row of electrical contacts is spaced from the third row of electrical contacts by the first row pitch; a first keying structure positioned adjacent to the first end wall of the connector housing and adjacent to a mating side of the connector housing; and a second keying structure positioned adjacent to the second end wall of the connector housing and adjacent to the mating side of the connector housing. The first keying structure and the second keying structure are positioned non-symmetrically about both the longitudinal centerline and the median centerline. A ratio defined by the first row pitch over the second row pitch can be approximately 0.9, or 2.2 mm over 2.4 mm.

The electrical connector can further include a first alignment peg positioned adjacent to the first end wall of the connector housing and adjacent to a mounting side of the connector housing and a second alignment peg positioned adjacent to the second end wall of the connector housing and adjacent to the mounting side of the connector housing, where the first alignment peg and the second alignment pegs are both positioned non-symmetrically about both the longitudinal centerline and the median centerline.

The connector housing can further include an inner rib that extends along the longitudinal centerline and carries the second row and the third row of electrical contacts, the inner rib can define at least one air void that also extends along the longitudinal centerline, and the air void can be positioned between a mating end of an electrical contact in the third row of electrical contacts and a mating end of an electrical contact in the fourth row of electrical contacts.

The connector housing can further include an inner rib that carries the second row and the third row of electrical contacts, the inner rib can define at least one air void, and the air void can be positioned between a mounting end of an electrical contact in the third row of electrical contacts and a mounting end of an electrical contact in the fourth row of electrical contacts.

The connector housing can further include a first plug rib that extends parallel or substantially parallel to the longitudinal centerline and carries the first row and second row of electrical contacts, the first plug rib can define at least one air void that extends parallel or substantially parallel to the longitudinal centerline, and the air void can be positioned between a mating end of an electrical contact in the first row of electrical contacts and a mating end of an electrical contact in the second row of electrical contacts.

The connector housing can further include a second plug rib that extends parallel or substantially parallel to the longitudinal centerline and carries the third row and the fourth row of electrical contacts, the second plug rib can define at least one air void that also extends parallel or substantially parallel to the longitudinal centerline, and the air void can be positioned between a mating end of an electrical contact in the third row of electrical contacts and a mating end of an electrical contact in the fourth row of electrical contacts.

The electrical connector can be devoid of shields and power contacts between the first row of electrical contacts and the second row of electrical contacts. The electrical connector can be devoid of shields and power contacts between the second row of electrical contacts and the third row of electrical contacts.

The first keying structure and the second keying structure can be offset mirror images about the median centerline. The air void can be a plurality of air voids. The first keying structure can be a first recess. The first recess can be defined by at least four sides. The first recess can be defined by at least five sides. The second keying structure can be a second recess. The second recess can be defined by at least four sides. The second recess can be defined by at least five sides. The first keying structure can be a first protrusion. The first protrusion can be defined by at least four sides. The first protrusion can be defined by at least five sides. The second keying structure can be a second protrusion. The second protrusion can be defined by at least four sides. The second protrusion can be defined by at least five sides. The first keying structure can be positioned entirely on a first side of the longitudinal centerline, and a second keying structure can be positioned entirely on a second side of the longitudinal centerline opposite to the first side. The first keying structure can abut the longitudinal centerline. The second keying structure can abut the longitudinal centerline. The longitudinal centerline can pass through a portion of the first keying structure. The longitudinal centerline can pass through a portion of the second keying structure.

Each of the respective first, second, third, and fourth rows of electrical contacts can contain at least one hundred electrical contacts that each terminate with a respective fusible element. The first row pitch can be 2.2±0.1 mm or 2.2±0.05 mm and the second row pitch can be 2.4±0.1 mm or 2.4±0.05 mm.

The electrical connector can have a data rate of at least 32 Gbits/sec with an insertion loss between 0 dB and −1.5 dB. The electrical connector can have an aggregate data rate of at least 4096 Gbits/sec with an insertion loss between 0 dB and −1.5 dB. The electrical connector can have a data rate density of at least 2088 Gbits per square inch or 13467 Gbits per square centimeter, with an insertion loss between 0 dB and −1.5 dB.

Electrical contacts in the first row of electrical contacts can be alternatingly stitched into a top of the electrical housing and a bottom of the electrical housing. Each of the respective first, second, third, and fourth rows of electrical contacts can include at least one hundred electrical contacts that each terminate with a respective press-fit pin.

According to an embodiment of the present invention, an electrical connector includes a housing that defines at least four consecutive, immediately adjacent cores positioned on a common line; a first electrical contact that defines a first retention shape, the first electrical contact positioned in a first one of the four consecutive, immediately adjacent cores; a second electrical contact that defines a second retention shape, the second electrical contact positioned in a second one of the four consecutive, immediately adjacent cores, the second electrical contact positioned immediately adjacent to the first electrical contact; a third electrical contact that defines the first retention shape, the third electrical contact positioned in a third one of the four consecutive, immediately adjacent cores, the third electrical contact positioned immediately adjacent to the second electrical contact; and a fourth electrical contact that defines the second retention shape, the fourth electrical contact positioned in a fourth one of the four consecutive, immediately adjacent cores, the fourth electrical contact positioned immediately adjacent to the third electrical contact. The first electrical contact and the third electrical contact are inserted into the housing in a first direction, the second electrical contact and the fourth electrical contacts are inserted into the housing in a second direction that is opposite to the first direction, and the first, second, third, and fourth electrical contacts all lie on a common centerline.

The second retention shape of the second electrical contact can be inserted completely in the second one of the four consecutive, immediately adjacent cores. The electrical connector can be a mezzanine connector that mates with another mezzanine connector. The electrical connector can further include a fusible member attached to the first electrical contact prior to reflow. The electrical connector can be an open pin field connector. The electrical connector can be devoid of crosstalk shields. The first, second, third, and fourth electrical contacts can each terminate with a press-fit pin.

According to an embodiment of the present invention, an electrical connector includes a housing including a linear array, column, or row of at least three contacts. The at least three contacts include at least one first contact with a first securing structure and at least one second contact with a second securing structure, the first and second the securing structures engage the housing at different heights of the housing, and the first and the second securing structures are identical.

The first and the second securing structures can each include at least one of a wing, a wedge, a protrusion, a lead-in, or a bump. The connector can further include a fusible member attached to each of the at least three contacts. The housing can include first and second cores; the at least one first contact can be included in the first cores; the at least one second contact can be included in the second cores; and shapes of the first and the second cores can be different or can be the same.

According to an embodiment of the present invention, an electrical connector includes a connector housing that extends along a longitudinal centerline and has a median centerline that is perpendicular or substantially perpendicular to the longitudinal centerline, the connector housing includes a first end wall and a second end wall opposed to the first end wall; first, second, third, and fourth rows of electrical contacts that are spaced apart in parallel rows, each of the first, the second, the third, and the fourth rows of electrical contacts extend parallel or substantially parallel to the longitudinal centerline; the first row of electrical contacts is spaced from the second row of electrical contacts by a first row pitch of 2.2±0.1 mm or 2.2±0.05 mm; the third row of electrical contacts is spaced from the second row of electrical contacts by a second row pitch of 2.4±0.1 mm or 2.4±0.05 mm; the fourth row of electrical contacts is spaced from the third row of electrical contacts by the first row pitch of 2.2±0.1 mm or 2.2±0.05 mm; a first keying structure positioned adjacent to the first end wall of the connector housing, adjacent to a mating side of the connector housing; a second keying structure positioned adjacent to the second end wall of the connector housing, adjacent to a mating side of the connector housing; the first keying structure and the second keying structure are positioned non-symmetrically about both the longitudinal centerline and the median centerline; and the first keying structure and the second keying structure are mirror images about the median centerline.

The electrical connector can further include a first alignment peg positioned adjacent to the first end wall of the connector housing and adjacent to a mounting side of the connector housing; and a second alignment peg positioned adjacent to the second end wall of the connector housing and adjacent to a mounting side of the connector housing; where the first alignment peg and the second alignment pegs are both positioned non-symmetrically about both the longitudinal centerline and the median centerline.

The first alignment peg can have a diameter of 0.8±0.05 mm, and the second alignment peg can have dimensions of 0.8±0.05 mm by 0.6±0.05 mm. Each of the respective first, second, third, and fourth rows of electrical contacts can each terminate with a respective press-fit pin. Each of the respective first, second, third, and fourth rows of electrical contacts can each terminate with a respective fusible element.

According to an embodiment of the present invention, a printed circuit board footprint includes a first pad row of at least one hundred pads; a second pad row of at least one hundred pads; a third pad row of at least one hundred pads; a fourth pad row of at least one hundred pads; the first pad row of pads spaced from the second pad row of pads by a first pad row pitch of 2.2±0.1 mm or 2.2±0.05 mm; the third pad row of pads spaced from the second pad row of pads by a second pad row pitch of 2.4±0.1 mm or 2.4±0.05 mm; the fourth pad row of pads spaced from the third pad row of pads by the first pad row pitch of 2.2±0.1 mm±0.05 mm; a first alignment hole; and a second alignment hole. The first alignment hole has a diameter of 0.8±0.05 mm and is positioned along a same line as the third pad row; and the second alignment hole has dimension of 0.8±0.05 mm by 0.6±0.05 mm, is positioned on a centerline positioned equidistant between and parallel or substantially parallel to the second and third pad rows, and is positioned adjacent to a first pad in the second pad row.

According to an embodiment of the present invention, a printed circuit board footprint includes a first pad row of at least one hundred pads; a second pad row of at least one hundred pads; a third pad row of at least one hundred pads; a fourth pad row of at least one hundred pads; the first pad row of pads spaced from the second pad row of pads by a first pad row pitch of 2.2±0.1 mm or 2.2±0.05 mm; the third pad row of pads spaced from the second pad row of pads by a second pad row pitch of 2.4±0.1 mm or 2.4±0.05 mm; the fourth pad row of pads spaced from the third pad row of pads by the first pad row pitch of 2.2±0.1 mm mm 2.2±0.05; a first alignment hole; and a second alignment hole. The first alignment hole has a diameter of 0.8±0.05 mm, is positioned on a centerline positioned equidistant between and parallel or substantially parallel to the second and third pad rows, and is positioned adjacent to a last pad in the second pad row; and the second alignment hole is positioned along a same line as the second pad row of pads and the second alignment hole has dimensions of 0.8±0.05 mm by 0.6±0.05 mm.

The above and other features, elements, characteristics, steps, and advantages of the present invention will become more apparent from the following detailed description of embodiments of the present invention with reference to the attached drawings.

DETAILED DESCRIPTION

Embodiments of the present invention can include, but are not limited to: alternatively stitched electrical contacts, in series, along a common row of cores in a connector housing to increase electrical contact density without degrading signal integrity to commercially useless levels; optimized row to row spacing in an electrical connector and corresponding substrate footprint to reduce crosstalk, to permit more ground vias in a substrate, such as a printed circuit board, to maintain electrical conductor density, to aid in alternatively stitching of electrical contacts, and to make differential signal routing in a printed circuit board easier; and air void placement in ribs that helps to improve single-ended or differential impedance and reduce near-end crosstalk (NEXT) between adjacent rows of electrical contacts by reducing coupling between adjacent rows of electrical contacts at or above approximately 32 Gbits/sec. Row to row spacings described herein also permit electrical contacts in adjacent rows to carry more power or current or voltage at a 30° C. rise time.

Figure 1:
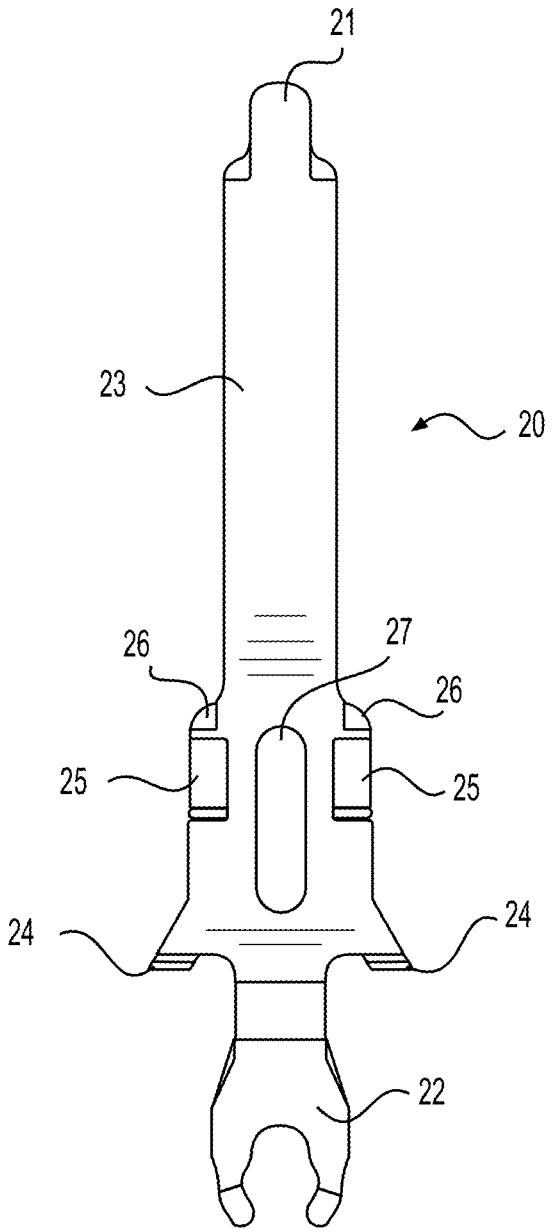
PRIOR ART FIG. 1
FIGS. 1 and 2 show a known electrical contact that can be stitched into a connector housing from one direction.
Figure 2:
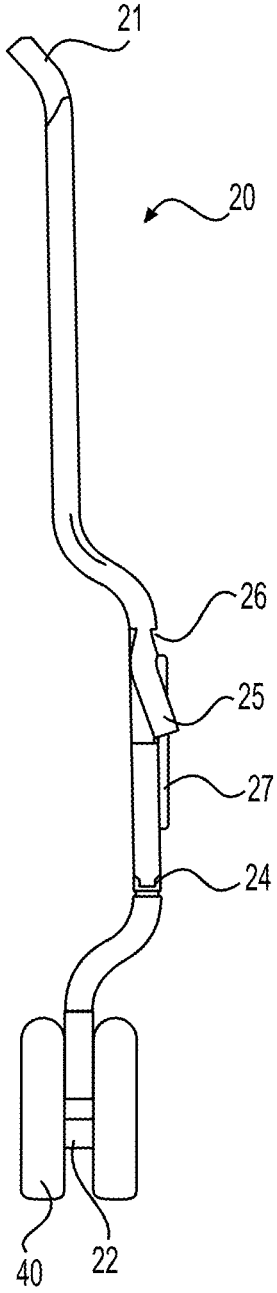
PRIOR ART FIG. 2
Figure 3:
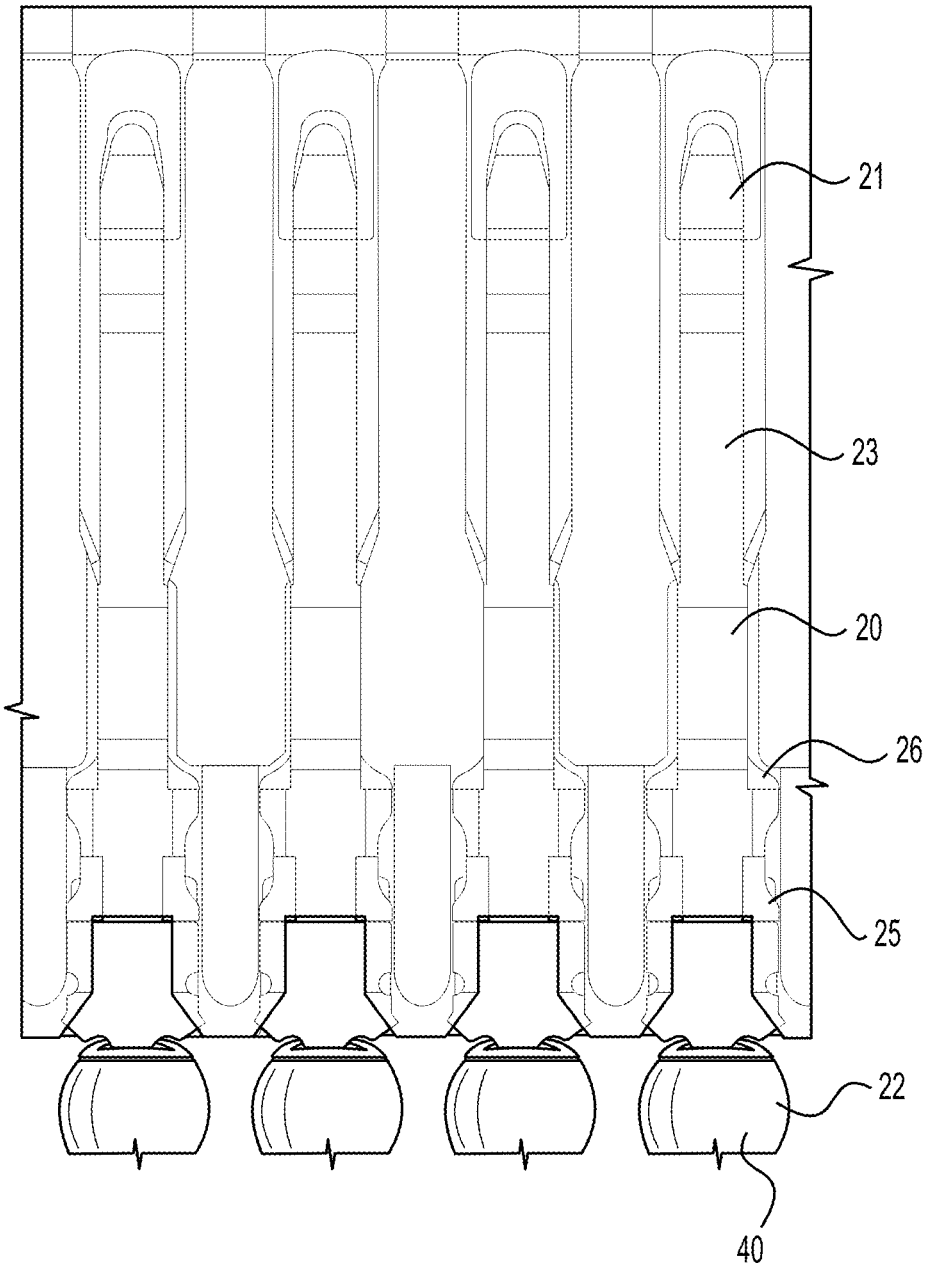
PRIOR ART FIG. 3
FIG. 3 is a close-up sectional view of a known connector housing with electrical contacts stitched from one direction.
Figure 4:
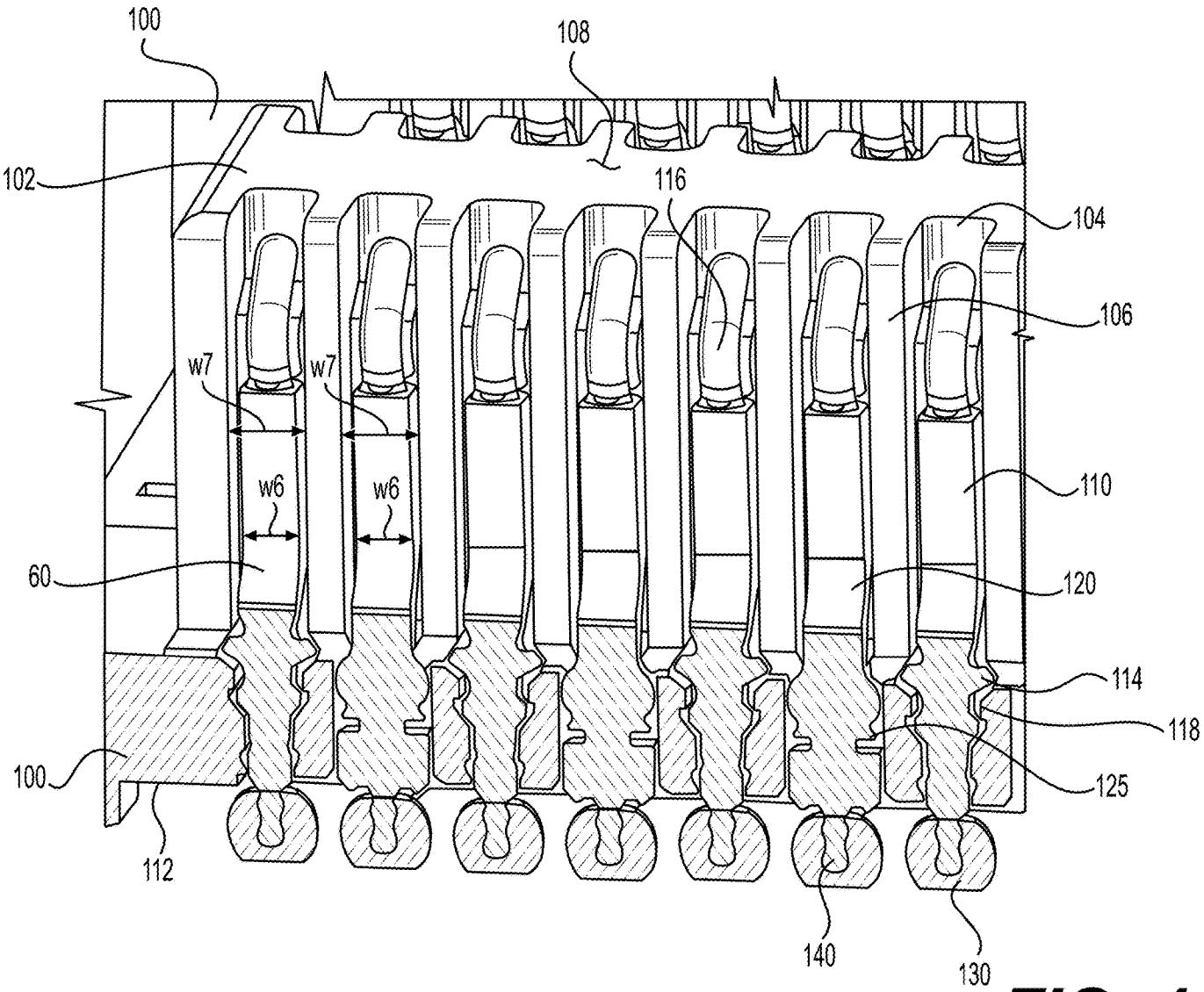
FIG. 4 is a close-up sectional view of a connector housing with electrical contacts stitched from two different directions.

Alternatively stitched electrical contacts 110, 120 are discussed first. FIG. 4 shows a portion of a single contact row in a housing 102 of a receptacle connector 100. As shown, the receptacle connector 100 can include recesses 104 defined by ribs 106. The ribs 106 each extend beyond contact mating ends 116 of electrical contacts 110, 120. The ribs 106 can be positioned between two immediately adjacent electrical contacts 110, 120 along a row. Electrical contacts 110 can each be stitched into the housing 102 from the top or mating side 108 of the housing 102, in a first direction toward a bottom or mounting side 112 of the housing 102. Electrical contacts 120 can be stitched from the bottom or mounting side 112 of the housing 102 in a second direction toward the top or mating side 108 of the housing 102. Each row of electrical contacts 110, 120 can include any number of electrical contacts 110, 120, including three or more electrical contacts. The first and second directions oppose each other.

The electrical contacts 110, 120 can each include securing structures. Securing structures can include structures that engage with cores 118 in the housing 102 to prevent the electrical contacts 110, 120 from being removed from the cores 118 and/or to position the electrical contacts 110, 120 within the cores 118 and include, for example, wings, wedges, protrusions, lead-ins, and bumps. Electrical contacts 110, 120 can be held in the housing 102 by an interference fit.

Electrical contacts 110 can include securing structures that are oriented to allow the electrical contacts 110 to be inserted into the cores 118 of the housing 102 from the mating side 108. As shown in FIG. 4, the electrical contacts 110 can include wings 114 that engage with the housing 102 to secure the electrical contacts 110 in the housing 102. Electrical contacts 120 can include securing structures that are oriented to allow the electrical contacts 110 to be inserted into the cores 118 of the housing 102 from the mounting side 112. As also shown in FIG. 4, the electrical contacts 120 can include wedges 125 that engage with the housing 102 to secure the electrical contacts 120 in the housing 102.

Figure 5:
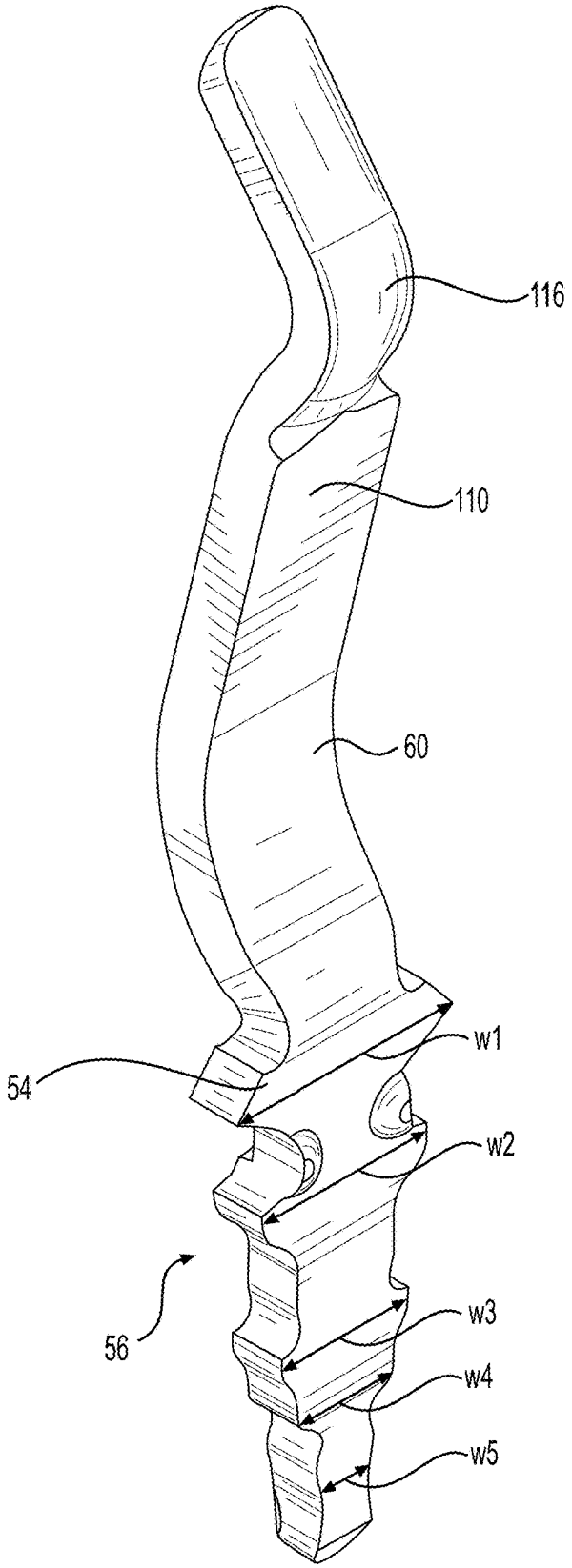
FIGS. 5 and 6 show an electrical contact that can be stitched from the top of a connector housing.
Figure 6:
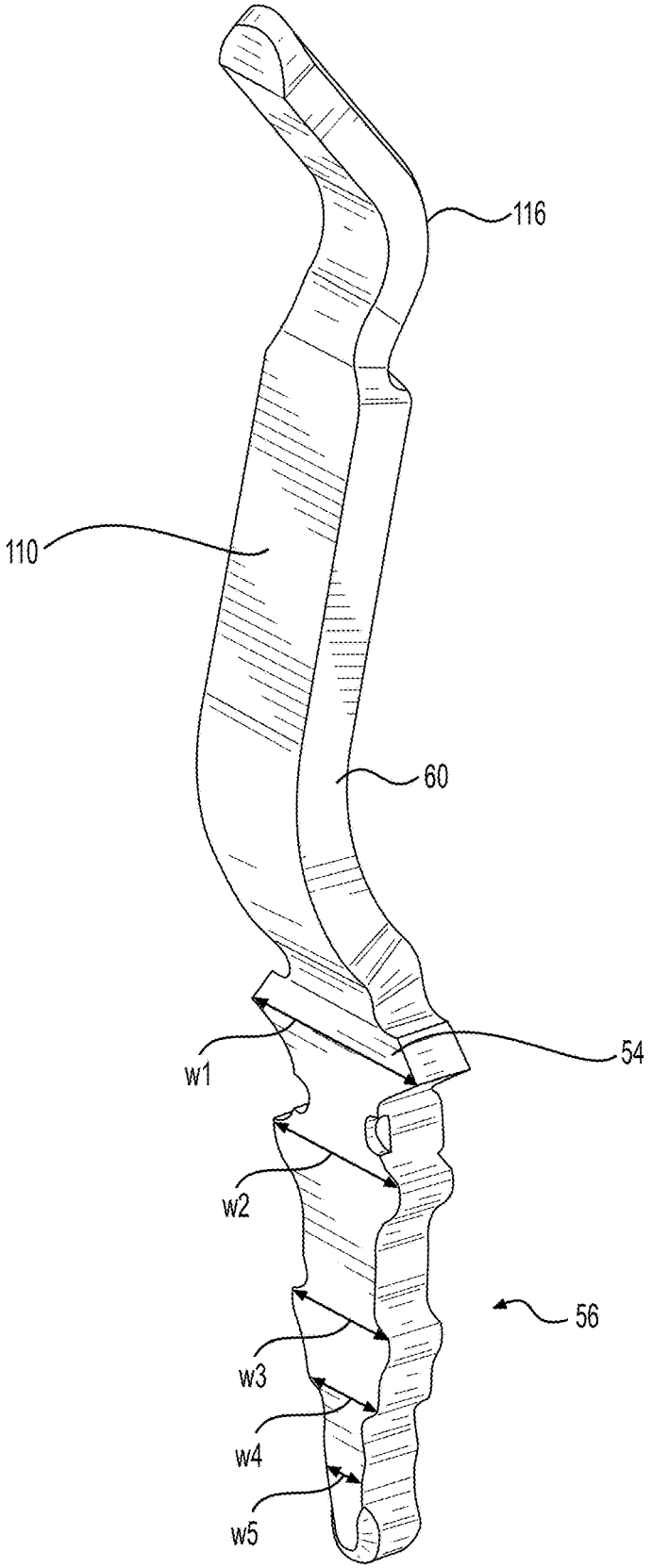

An example electrical contact 110 is shown in FIGS. 5 and 6. FIGS. 5 and 6 show an electrical contact 110 that includes a mating end 116 and wings 54. FIG. 5 shows that a retention portion 56 of the electrical contact 110 can define a first width W1, a second width W2, a third width W3, and a fourth width W4. The first width W1 can be greater in length than any one of the second width W2, the third width W3, or the fourth widths W4. The second width W2 can be greater in length than any one of the third width W3 or the fourth widths. The third width W3 can greater in length than the fourth width W4. A mounting end 58 of the electrical contact 110 can have a fifth width W5 that is shorter in length than any one of the first width W1, the second width W2, the third width W3, or the fourth width W4. Alternatively, the second width W2 and the third width W3 can be the same length or approximately the same lengths.

Figure 7:
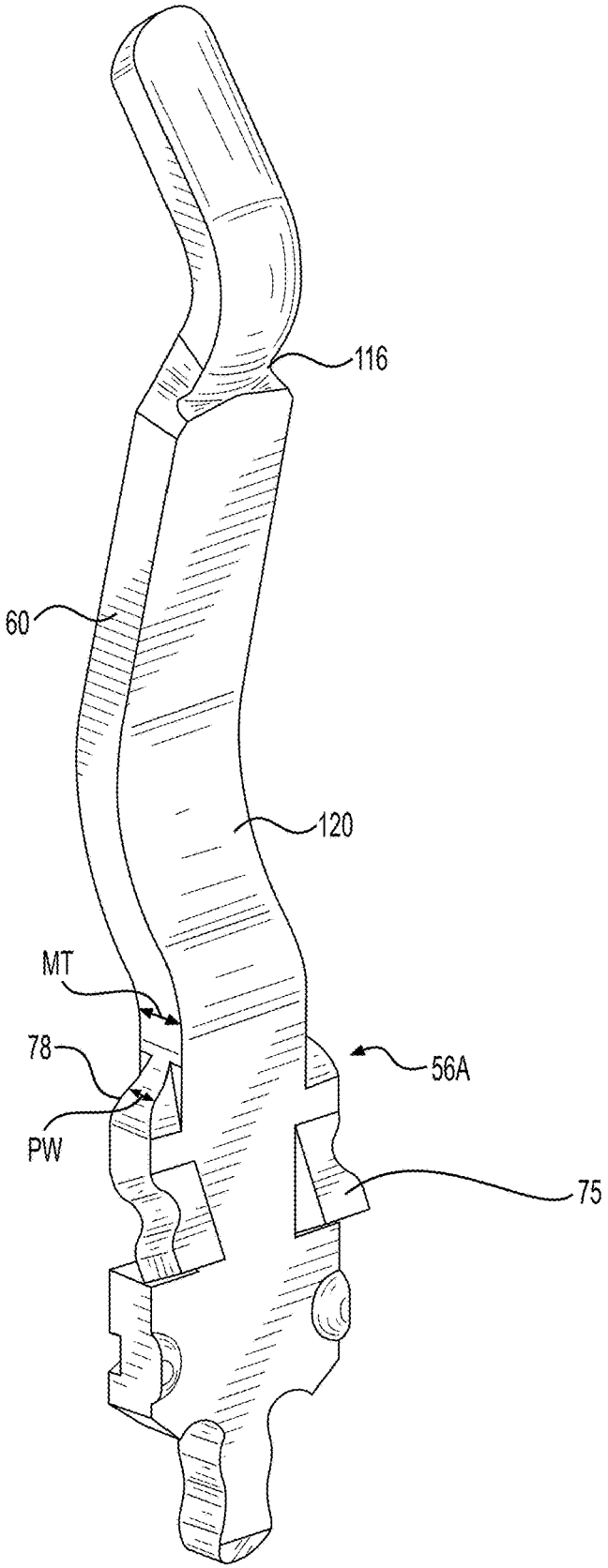
FIGS. 7 and 8 show another electrical contact that can be stitched from the bottom of a connector housing.
Figure 8:
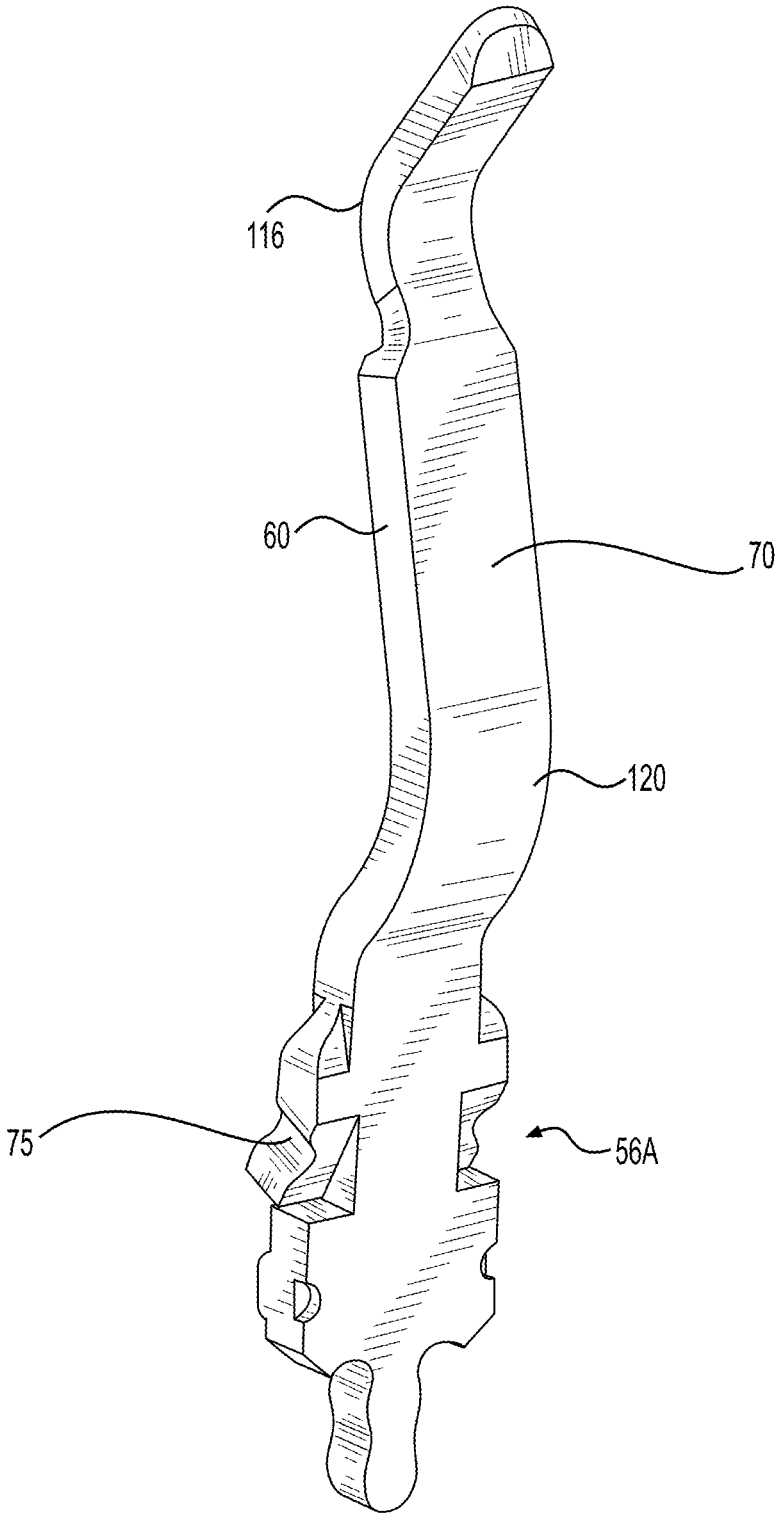

An example electrical contact 120 is shown in FIGS. 7 and 8. FIGS. 7 and 8 show an electrical contact 120 that includes a mating end 116 and one or more wedges 75 that each protrude in the same direction from a material thickness MT of the electrical contact 120. Wedges 75 can each include a portion 78 that has a portion width PW that is shorter in length than the material thickness MT of the electrical contact 120.

The electrical contacts 110, 120 can include other securing structures. For example, although not shown in FIG. 4, the electrical contacts 110, 120 can include bumps that position the contact within the core 118 of the housing 102. In FIG. 4, the electrical contacts 110, 120 include different securing structures, i.e., wings 114 and wedges 125, but it is possible that electrical contacts 110, 120 can include the same securing structures, e.g., both having wings 114 or both having wedges 125. As shown in FIG. 4, the cores 118 in the housing 102 can be shaped to receive the electrical contacts 110, 120. Thus, the cores 118 that receive electrical contacts 110 can be shaped differently than the cores 118 that receive electrical contacts 120. Regardless of the shapes or widths of the dissimilarly shaped retention portions 56, 56A of electrical contacts 110, 120, the intermediate portions 60 of two immediately adjacent electrical contacts 110, 120 can be the same sixth width W6. The same can be true for two or more or for three or more immediately adjacent recesses 104, which can each define approximately equal seventh widths W7. Electrical contacts 110, 120 can define differently shaped retention portions 56, 56A, but the same shaped intermediate portions 60 and same shaped mating ends 116.

Fusible members 130, 140 can be attached to the mounting ends 58 of the electrical contacts 110, 120 in any suitable manner. Fusible members 130, 140 can include solder or any other suitable material that can be used to form electrical and mechanical connections to another device such as a substrate, e.g. PCB, flexible circuit board, or a cable.

By stitching electrical contacts 110, 120 from the mating side 108 and mounting side 112 of the housing 102, the electrical contacts 110, 120 can be located closer together than allowed by the prior art, decreasing the pitch of the electrical contacts 110, 120, even if the electrical contacts 110, 120 have intermediate portions 60 or mating ends 116 that are wider than electrical contacts that are only stitched in one direction. A sixth width W6 to contact pitch ratio can be 50-75% of the contact pitch. As shown in FIG. 4, top and bottom stitching allows the electrical contacts 110, 120 to include securing structures or retention portions 56, 56A that engage at different heights in the cores 118 so that retention portions 56, 56A of adjacent electrical contacts 110, 120 do not interfere with each other. In FIG. 4, the wings 114 engage the top of the cores 118, and the wedges 125 engage the middle of the cores 118, which allows the cores 118 to be placed closer together, decreasing the pitch of the receptacle connector 100 without sacrificing signal integrity at a data transfer rate at or above 32 Gbits/sec.

For a fixed pitch, electrical contacts 110, 120 with wider width W6, intermediate portions, 60 and mating ends 116 provide improved electrical performance, including improved impedance/improved return loss. For example, if differential signals are transported, i.e., transmitted and/or received, through electrical contacts 110, 120, then a time domain impedance can be between about 85Ω and about 100Ω at 17 ps (10%-90%) or between about 86Ω and about 99Ω at 17 ps (10%-90%). Simulated insertion loss is between 0 dB and −1.5 dB at frequencies from 1 GHz up to and including 17 GHz (approximately 34 Gbits/sec or 2 times the frequency) and between 0 dB and −3 dB through 23 GHz (approximately 46 Gbits/sec). Simulated differential return loss is between −10 dB and −60 dB at frequencies from 1 GHz up to and including 23 GHz. Simulated differential vector sum crosstalk is between −40 dB and −100 dB at frequencies from 1 GHz up to and including 19 GHz with excursions, is between −30 dB and −100 dB at frequencies from 1 GHz up to and including 34 GHz, and is between −20 dB and −100 dB at frequencies from 1 GHz up to and including 50 GHz. Data rate per channel is approximately 32 Gbits/sec, an aggregate data rate can be approximately 4096 Gbits/sec, and the data rate density can be approximately 2088 Gbits/sec per square inch at any of the at least 32 Gbit/sec capable impedance, insertion loss, differential return loss, vector sum crosstalk values listed above. Because electrical connectors can be devoid of metal, metal crosstalk shields, power contacts, and lossy crosstalk shields, electrical connectors can have an open pin field. Electrical contacts 110, 120 can be electrically arranged in patterns of signal-ground-signal (S-G-S), S-S-G S S, S S G-G-S-S or can electrically carry or be assigned as power, reference, or ground electrical contacts 110, 120.

In a single row, different stitching processes can be used. For example, the electrical contacts 110 or 120 can all be stitched, and then the remaining electrical contacts 120 or 110 can all be stitched. Alternatively, the electrically contacts 110, 120 can be alternatively stitched in series: a single electrical contact 110 or 120 can be stitched, then a single electrical contact 120 or 110 can be stitched, etc., until the entire row is stitched.

The fusible members 130, 140 can be attached to the electrical contacts 110, 120 after the electrical contacts 110, 120 have been stitched into the receptacle connector 100.

The receptacle connector 100 can be any suitable connector, including, for example, a mezzanine connector that can be used to connect two substrates, e.g., printed circuit boards, together in parallel or substantially parallel within manufacturing tolerances. The receptacle connector 100 can be a hermaphroditic connector that connects with a connector that has contacts that are only stitched from one direction.

Figure 9:
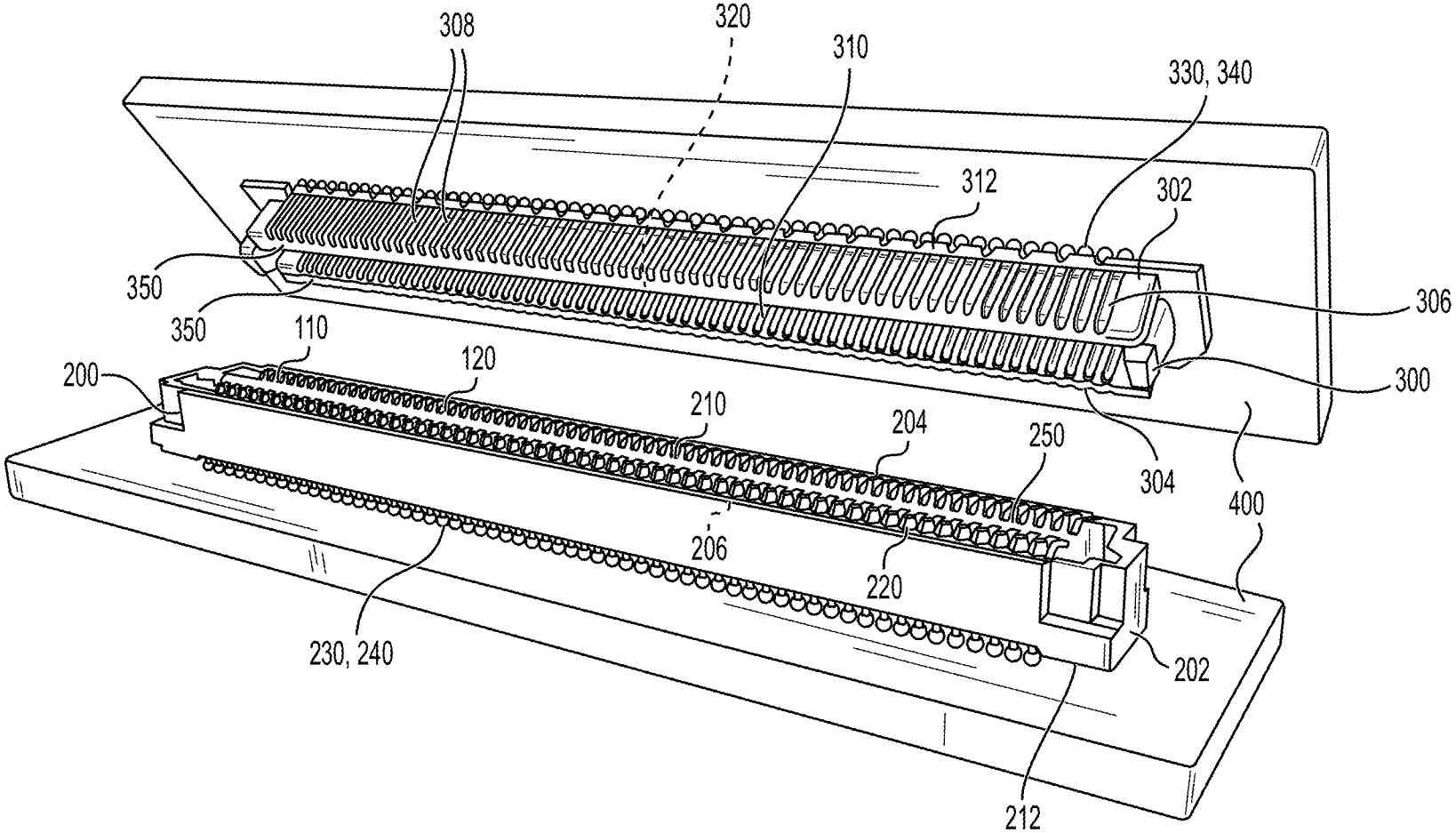
FIG. 9 is a perspective view of a mating pair of mezzanine connectors according to an embodiment of the present invention.

FIG. 9 shows examples of such mezzanine connectors, in which receptacle connector 200 has electrical contacts that are stitched from two directions and the plug connector 300 has electrical contacts that are only stitched from one side. Optionally, the connector can be a right angle connector. The plug connector 300 can have stitched electrical contacts and the receptacle connector 200 can have electrical contacts that are only stitched from one side, such as the mounting side 212 of the receptacle housing 202.

FIG. 9 shows receptacle connector 200 and plug connector 300 mounted on respective substrates 400. As shown, the receptacle connector 200 in the bottom portion of FIG. 9 can include four parallel, spaced apart receptacle rows 204, 210, 220, 206 of electrical contacts 110, 120. A first receptacle row 204 of electrical contacts 110, 120 and a fourth receptacle row 206 of electrical contacts 110, 120 extend along the inside of the outer sides of the receptacle housing 202. A second receptacle row 210 of electrical contacts 110, 120 and a third receptacle row of electrical contacts 110, 120 are back-to-back and extend along an inner rib 250 that extends from end to end down a middle of the receptacle connector 200 along longitudinal centerline CL. Although the receptacle connector 200 in FIG. 9 is shown with four parallel, spaced apart, shieldless rows, any number of rows of electrical contacts 110, 120 can be used. The electrical contacts 110, 120 of the receptacle connector 200 can be stitched from two directions as described with respect to FIGS. 4-8. The receptacle connector 200 can be devoid any of crosstalk shields and magnetic absorbing lossy material or can include any number of crosstalk shields or electrically conductive or non-conductive magnetic absorbing lossy material. Fusible members 230, 240, such as solder balls, can be attached to respective ones of the electrical contacts 110, 120.

The plug connector 300 in the top portion of FIG. 9 can include a plug housing 302 four parallel, spaced apart plug rows 304, 310, 320, 306 of electrical plug contacts 308. A first plug row 304 of electrical plug contacts 308 and a second plug row 310 of electrical plug contacts 308 each extend along a respective plug rib 350 that extends from end to end of the plug connector 300. A third plug row 320 of electrical plug contacts 308 and a fourth plug row 306 of electrical plug contacts 308 each extend along a respective plug rib 350 that extends from end to end of the plug connector 300.

Although the plug connector 300 in FIG. 9 is shown with four parallel, spaced apart, shieldless rows of electrical plug contacts 308, any number of rows can be used. The electrical plug contacts 308 of the plug connector 300 can be stitched from two directions as described with respect to FIGS. 4-8. The plug connector 300 can be devoid any of crosstalk shields and magnetic absorbing lossy material or can include any number of crosstalk shields or electrically conductive or non-conductive magnetic absorbing lossy material. Fusible elements 330, 340, such as solder balls, can be attached to each respective one of the electrical plug contacts 308.

Typically, the numbers of rows and electrical plug contacts 308 in the plug connector 300 and receptacle connector 200 are the same.

As shown in FIG. 9, fusible members 230, 240, 330, 340 are used to attach the electrical plug contacts 308 to the substrates 400. The electrical plug contacts 308 carried by the plug connector 300 can be stitched from one side or only from the mounting side 312 of the plug housing 302.

Figure 10:
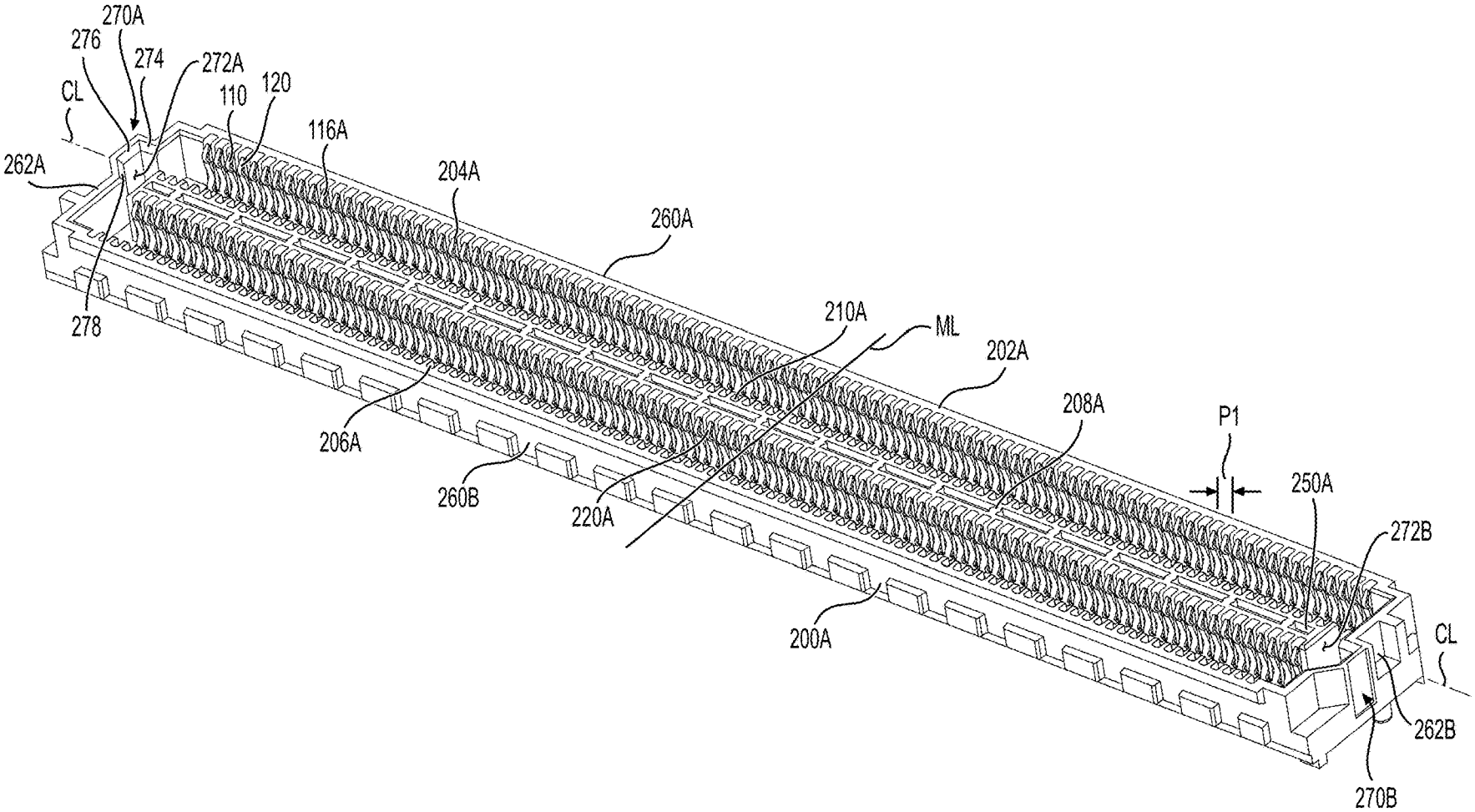
FIGS. 10 and 11 are perspective views of a receptacle connector according to an embodiment of the present invention.
Figure 11:
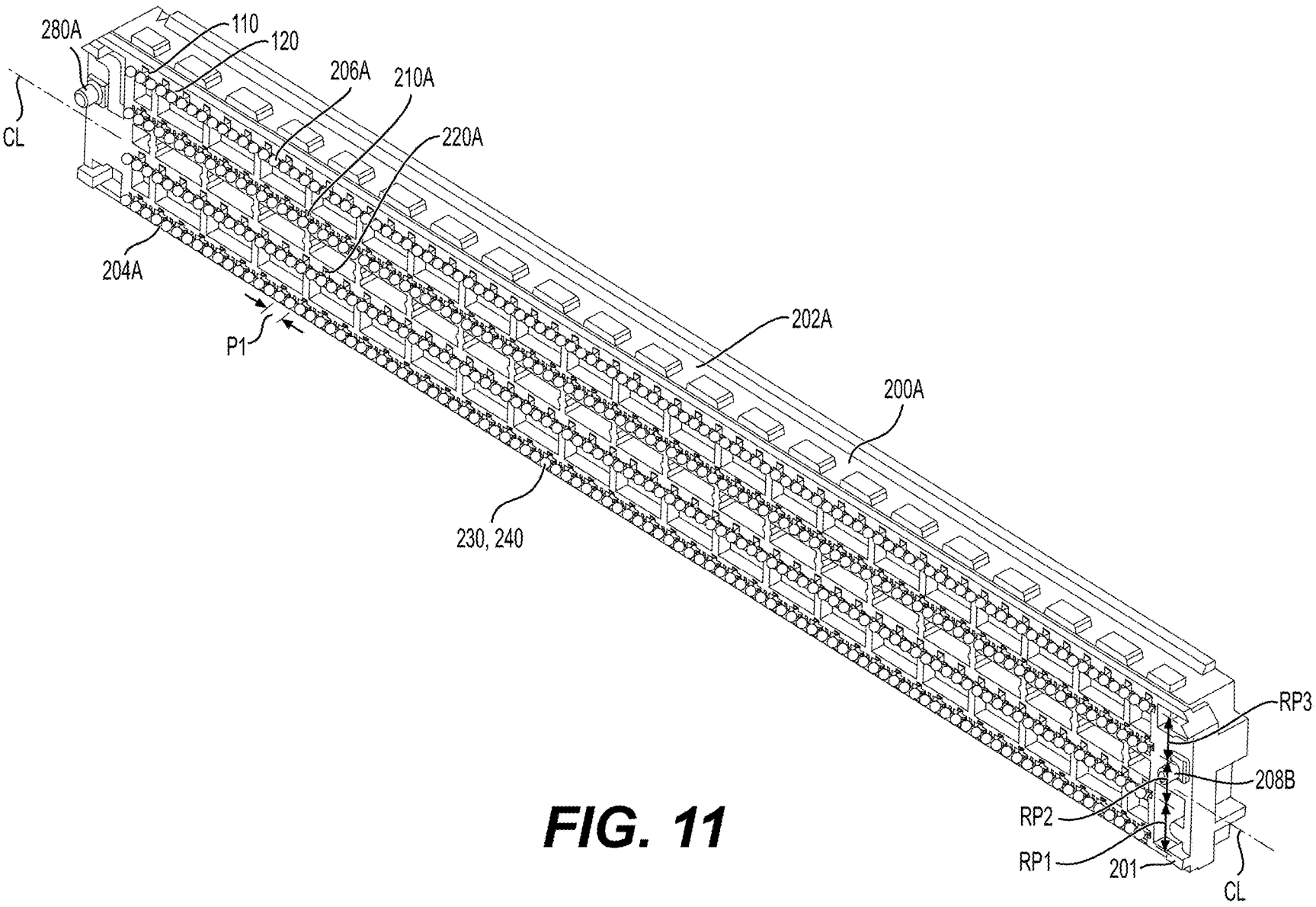

FIGS. 10 and 11 show a receptacle connector 200A of an embodiment of the present invention that includes a first receptacle row 204A, a second receptacle row 210A, a third receptacle row 220A, and a fourth receptacle row 206A of stitched electrical contacts, such as electrical contacts 110, 120. As shown in FIG. 11, the first receptacle row 204A and the second receptacle row 210A can be spaced apart by a first row pitch RP1. The second receptacle row 210A and the third receptacle row 220A can be spaced apart by a second row pitch RP2 that is numerically greater than the first row pitch RP1. The third receptacle row 220A can be spaced apart from the fourth receptacle row 206A by a third row pitch RP3 that is equal to or approximately equal to the first row pitch RP1. The first row pitch can be 2.2±0.05 mm, 2.2±0.1 mm, or some other value approximately equal to 2.2 mm, such as 2.2±0.05 mm or 2.2±0.005 mm. The second row pitch can be 2.4±0.005 mm, 2.4±0.05 mm, 2.4±0.1 mm, or some other value approximately equal to 2.4 mm. The third row pitch can be the same as the first row pitch, such as 2.2±0.005 mm, 2.2±0.05 mm, 2.2±0.1 mm, or some other value approximately equal to 2.2 mm. Making the row pitches unequal to each other in an electrical connector and corresponding substrate footprint helps to reduce crosstalk in the electrical connector and the footprint, permit more ground vias in a substrate, such as a printed circuit board, maintain electrical conductor density, and ease differential signal routing in a printed circuit board so that data rates of at least 32 Gbits/sec can be maintained with acceptable levels of impedance, insertion loss, differential return loss, or crosstalk.

The top perspective view of FIG. 10 shows that the receptacle connector 200A includes a first receptacle row 204A and a fourth receptacle row 206A that each extend along the inside of the outer sides of the receptacle housing 202A. A second receptacle row of electrical contacts 110, 120 and a third receptacle row of electrical contacts 110, 120 are positioned back-to-back extending along an inner rib 250A that extends from end to end down the middle of the receptacle connector 200A along longitudinal centerline CL.

In FIGS. 10 and 11, the receptacle connector 200A or receptacle housing 202 includes four rows of electrical contacts 110, 120, but any number of rows can be used. In FIGS. 10 and 11, each row of electrical contacts 110, 120 can include at least one hundred, evenly spaced contacts positioned on a 0.63±0.1 mm or 0.065±0.05 contact pitch P1, but any number of electrical contacts can be used per row.

As shown in FIG. 10, mating ends 116A of three immediately adjacent electrical contacts 110, 120 can be on the same pitch, but two of the three electrical contacts, such as electrical contacts 110, can be inserted into the receptacle housing 202A in a first direction from a mating side 108A of the receptacle housing 202A and the third one of the three electrical contacts, such as electrical contact 120 can be inserted into the receptacle housing 202A from a second direction opposite to the first direction.

The receptacle housing 202A can be defined by two parallel, spaced apart longitudinal walls, such as first longitudinal wall 260A and second longitudinal wall 260B, and two parallel, spaced apart end walls, such as first end wall 262A and second end wall 262B. The two parallel, first and second spaced apart end walls 262A, 262B are shorter in length than the two parallel, first and second spaced apart longitudinal walls 260A, 260B. A centerline CL extends through the two parallel, spaced apart end walls 262A, 262B, parallel to the two parallel, spaced apart first and second longitudinal walls 260A, 260B. A receptacle mating side 208A of the receptacle housing 202A may include a first keying structure 270A and a second keying structure 270B. The first keying structure 270A lies on one side of the centerline CL, and may abut the centerline CL or cross the centerline CL such that the centerline CL passes through at least a portion, but does not bisect the total bounded area, of the first keying structure 270A. The second keying structure 270B may be positioned at the receptacle mating side 208A of the receptacle housing 202A on an opposite side of the centerline compared to the first keying structure 270A, and may abut the centerline CL or cross the centerline CL such that the centerline CL passes through at least a portion, but does not bisect the total bounded area, of the second keying structure 270B.

Each of the first and second keying structures 270A, 270B can be a respective first recess 272A and second recess 272B, with at least three sides or surfaces defined by the receptacle housing 202A and respective portions of the two parallel, spaced apart end first and second end walls 262A, 262B. Each of the at least three-sided, first and second recesses 272A, 272B can be defined by or include a first side wall, line, or surface 274, a second side wall, line, or surface 276 that can perpendicularly intersect the first side wall 274, and a canted side wall, line, or surface 278 that intersects with the second side wall 276. Each of the first and second keying structures 270A, 270B, which can be recesses, are configured to receive a corresponding first keying structure or second keying structure, which can be posts, of a mating plug connector. The first keying structure 270A and the second keying structure 270B can be positioned non-symmetrically about both the longitudinal centerline CL and the median centerline ML. One benefit of the offset is to position plastic and air, present in the first and second keying structures 270A, 270B and their mating counterparts, in places that help with signal integrity.

On one side of the receptacle housing 202A, adjacent to first end wall 262A, the canted side wall 278 can abut the centerline CL, be spaced from the centerline CL, or pass through centerline CL. On an opposed side of the receptacle housing 202A, adjacent to the second end wall 262B, the first side wall 274 can abut, be coincident with, be parallel to, or be positioned adjacent to, but spaced away from, the centerline CL. The first keying structure 270A and the second keying structure 270B can be identically shaped, can be mirror images about a centerline that is perpendicular to the centerline CL and spans the receptacle rows 204, 210, 220, 206, or can be offset mirror images.

FIG. 11 is a bottom perspective view of the receptacle connector 200A shown in FIG. 10. Fusible members 230, 240 can be attached to the electrical contacts 110, 120 in any suitable manner. The receptacle connector 200A can include one or more standoffs 201. As shown in FIG. 11, the standoffs 201 can be located at one or more of the four corners of the receptacle housing 202A. Any number and any location of standoffs 201 can be used. The standoffs 201 ensure that the receptacle connector 200A is a fixed distance from a substrate when the fusible members 230, 240 are re-flowed to connect the receptacle connector 200A to the substrate. The receptacle connector 200A can include alignment pegs 280A, 280B that can be inserted into corresponding alignment holes in a substrate to self-align the receptacle housing 202A on a substrate and roughly align the fusible members 230, 240 with respect to solder pads on a substrate. FIG. 11 shows a first alignment peg 280A and a second alignment peg 280B, but any number of alignment pegs can be used. The first and second alignment pegs 280A, 280B can have any suitable shapes, including, for example, a circular shape, an oval shape, a square shape, etc. The shape of the first and second alignments pegs 280A, 280B can be the same or different. Portions of one or more of the first or second alignment pegs 280A, 280A can intersect the centerline CL, or both the first and second alignment pegs 280A, 280B can be spaced from the centerline CL. Four receptacle rows 204A, 210A, 220A, 206A of electrical contacts 110, 120 is are shown, but one or more receptacle rows can be used.

Figure 12:
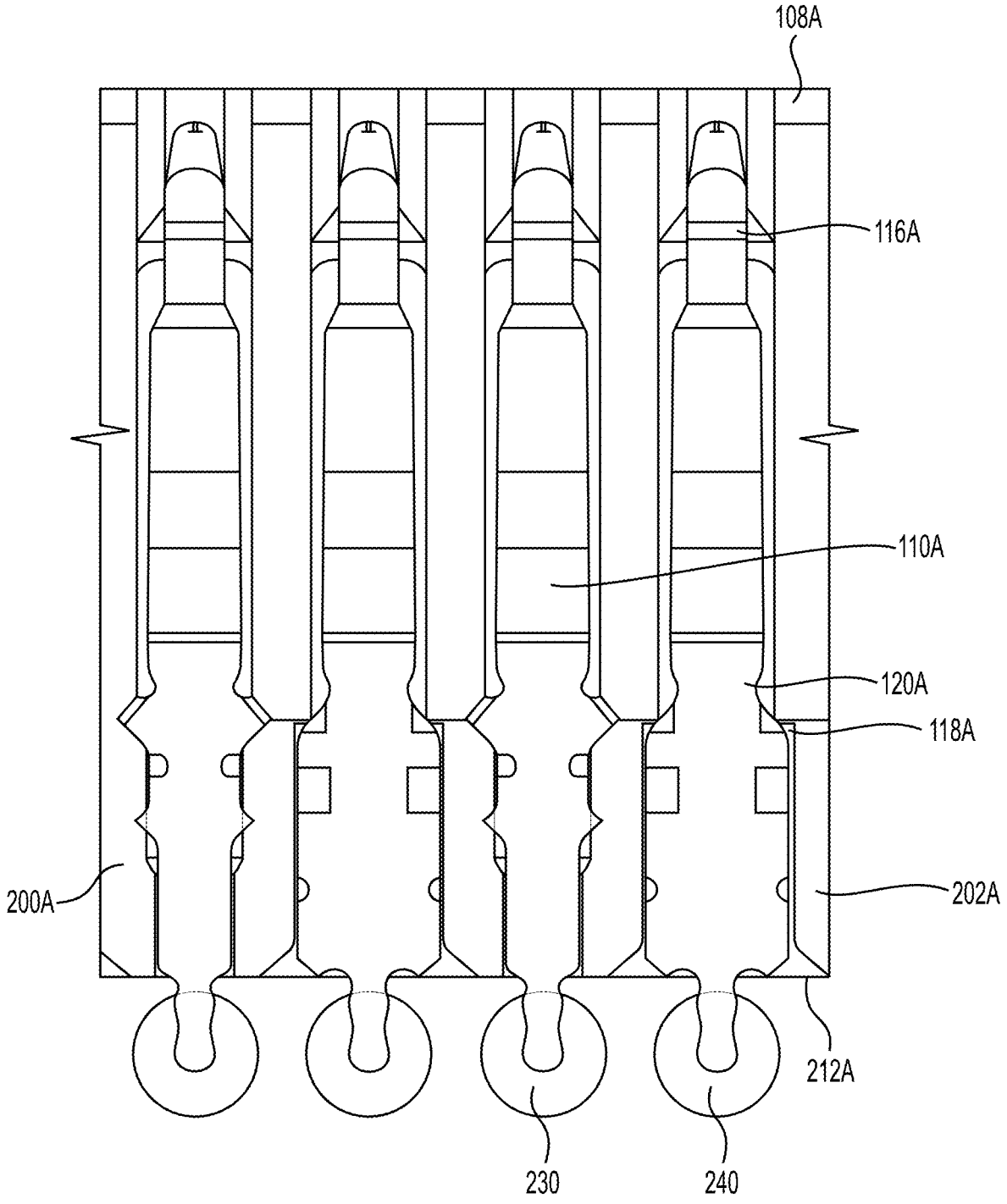
FIG. 12 is a partial sectional view of the receptacle connector shown in FIGS. 10 and 11.

FIG. 12 shows four electrical contacts 110A, 120A carried by the receptacle housing 202A of the receptacle connector 200A. The receptacle housing 202 can include cores 118A into which the electrical contacts 110A, 120A can be stitched. The electrical contacts 110A can include mating ends 116A and may be stitched from the mating side 108A of the receptacle housing 202A, and the electrical contacts 120A can be stitched from the mounting side 212A of the receptacle housing 202, as described above.

Figure 13:
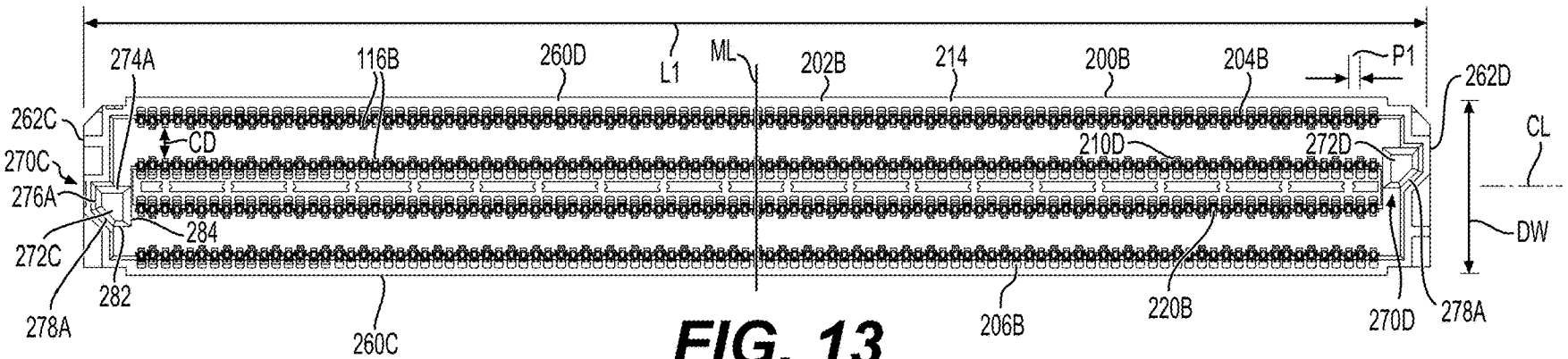
FIG. 13 is a top view of the receptacle connector shown in FIGS. 10-12.
Figure 14:
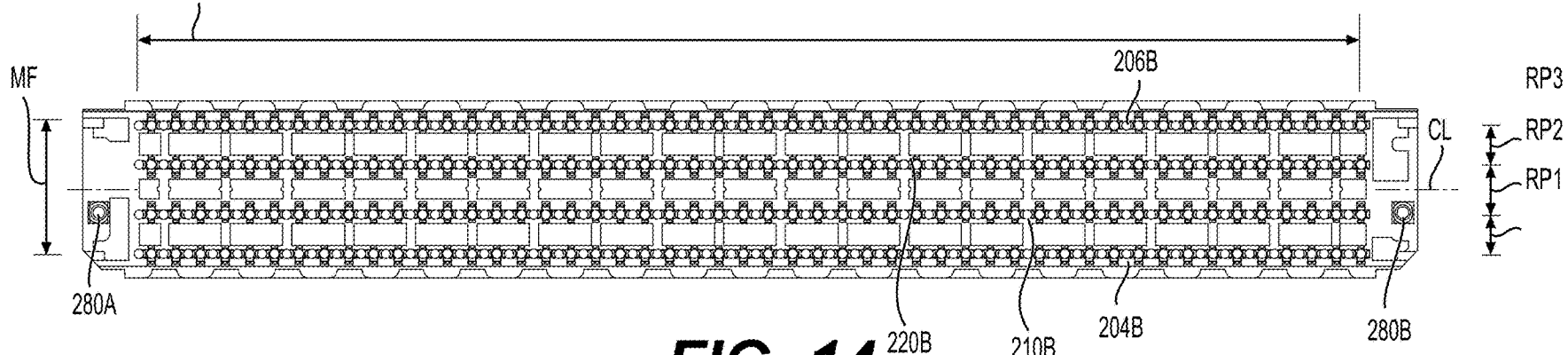
FIG. 14 is a bottom view of the receptacle connector shown in FIGS. 10-13.
Figure 15:
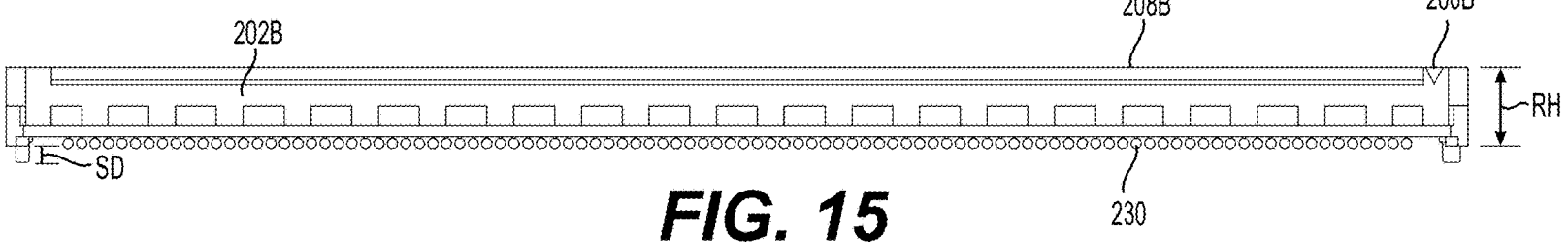
FIG. 15 is a side view of the receptacle connector shown in FIGS. 10-14.

FIGS. 13-15 show a receptacle connector 200B that includes four receptacle rows 204B, 210B, 220B, 206B of electrical contacts 110, 110A, 120, 120A. As shown in FIG. 13, the contact pitch P1 between adjacent electrical contacts 110, 110A, 120, 120A in any receptacle row can be between approximately 0.62±0.1 mm, such as 0.635 mm. A longitudinal length L1 of a receptacle housing 202B carrying four receptacle rows of one hundred electrical contacts 110, 110A, 120, 120A can be between approximately 67.6±2 mm. A receptacle cavity length at a mating interface can be between approximately 64.7±2 mm. A receptacle cavity depth of the mating interface can be between approximately 7.0±2 mm. A contact area distance CD between two facing mating ends 116B is approximately 1.7±0.1 mm. A depth or width DW of the receptacle housing 202B is approximately 8.5±0.5 mm. The receptacle connector 200B can be devoid of shields, devoid of power contacts, can have metallic crosstalk shields, can have electrically conductive on non-conductive magnetic absorbing material, or can be devoid of magnetic absorbing material.

The receptacle connector 200B can include a receptacle housing 202, which can define two parallel, spaced apart longitudinal walls, such as a first longitudinal wall 260C and a second longitudinal wall 260D, and two parallel, spaced apart end walls, such as first end wall 262C and second end wall 262D. The two parallel, spaced apart first and second end walls 262C, 262D can each be shorter in width than the two parallel, spaced apart first and second longitudinal walls 260C, 260D. A centerline CL extends through the two parallel, spaced apart first and second end walls 262C, 262D, parallel to the two parallel, spaced apart first and second longitudinal walls 260C, 260D. A median centerline ML cuts a longitudinal length of the receptacle connector 200B in half, intersects the centerline CL at a ninety degree angle, and extends across first, second, third, and fourth receptacle rows 204, 210, 220, 206. A mating interface of the receptacle connector 200B may include a first keying structure 270C and a second keying structure 270D. The first keying structure 270C can lie on one side of the centerline CL. The first keying structure 270C may abut the centerline CL, or intersect the centerline CL such that the centerline CL passes through at least a portion of the first keying structure 270C, but does not bisect the total bounded area, of the first keying structure 270C. The second keying structure 270D may be positioned at the mating interface or mating side 214 of the receptacle connector 200B on an opposite side of the centerline compared to the first keying structure 270C. The second keying structure 270D may abut the centerline CL or cross the centerline CL, such that the centerline CL passes through at least a portion, but does not bisect the total bounded area, of the second keying structure 270D.

The receptacle housing 202, also called a connector housing, defines a first end wall 262A, an opposed second end wall 262C, extends along a longitudinal centerline CL, and has median centerline ML that is perpendicular to the longitudinal centerline CL. The respective first, second, third, and fourth spaced apart, parallel receptacle rows 204, 210, 220, 206 of electrical contacts may be carried by the receptacle housing 202. Each of the first, the second, the third, and the fourth receptacle rows of 204, 210, 220, 206 of electrical contacts 110, 120 each extend parallel to the longitudinal centerline CL. The first receptacle row 204 or first row of electrical contacts 110, 120 is spaced from the second receptacle row 210 or second row of electrical contacts 110, 120 by a first row pitch RP1. The third receptacle row 220 or third row of electrical contacts 110, 120 is spaced from the second receptacle row 210 of electrical contacts 110, 120 by a second row pitch RP2 that is numerically greater than the first row pitch RP1. The fourth receptacle row 206 or fourth row of electrical contacts 110, 120 is spaced from the third receptacle row 220 of electrical contacts 110, 120 by a third row pitch RP3 that is equal to or with manufacturing tolerance of the first row pitch RP1. The first keying structure 270A is positioned adjacent to the first end wall 262A of the receptacle housing 202, adjacent to a mating side 214 of the receptacle housing 202. The second keying structure 270B is positioned adjacent to the second end wall 262B of the receptacle housing 202, adjacent to the mating side 214 of the receptacle housing 202. The first keying structure 270A and the second keying structure 270B can be positioned non-symmetrically about both the longitudinal centerline CL and the median centerline ML. The first and second keying structures 270A and 270B can be offset with respect to each other along the median centerline ML.

Each of the first and second keying structures 270C, 270D can be a respective first recess 272C and second recess 272D with at least three sides or surfaces defined by the receptacle connector 200B and respective portions of the two parallel, spaced apart first and second end walls 262C, 262D. Each of the at least three-sided first and second recesses 272C, 272D can be defined by or include a first side wall, line, or surface 274A, a second side wall, line, or surface 276A that can perpendicularly intersect the first side wall 274A, and a canted side wall, line, or surface 278A that intersects with the second side wall 276A. A fourth side wall, line, or surface 282 can intersect the canted side wall, line, or surface 278A. A fifth side wall, line, or surface 284 can intersect the first side wall, line, or surface 274A and the fourth side wall, line, or surface 282. Each of the first and second keying structures 270C, 270D, which can be recesses, are configured to receive a corresponding first keying structure or second keying structure, which can be posts, of a mating plug connector.

On one end of the receptacle housing 202B, adjacent to the second end wall 262D, the canted side wall 278A can abut the centerline CL, be spaced from the centerline CL, or pass through centerline CL. On an opposed side of the receptacle housing 202B, adjacent to the first end wall 262C, the first side wall 274A can abut, be coincident with, be parallel to, or be positioned adjacent to, but spaced away from, the centerline CL. The first keying structure 270C and the second keying structure 270D can each be identically shaped, can be positioned as mirror images about a centerline that is perpendicular to the centerline CL and spans the receptacle rows 204B, 210B, 220B, 206B, or can be positioned as offset mirror images.

As shown in FIG. 14, a mounting contact field MF can have a width of approximately 6.8±1 mm and can have a contact field length MFL approximately 62.8±1 mm, for an approximate overall contact area between approximately 427.04 $mm^2$ and approximately 440.22 $mm^2$, including these areas and any area therebetween. Four hundred individual electrical contacts can fit within these areas. First, second and third row pitches RP1, RP2, RP3 of the receptacle connector 200B can be approximately 2.1 to 2.3 mm, approximately 2.3 to 2.5 mm, and approximately 2.1 to 2.3 mm, respectively. For example, first, second, and third row pitches RP1, RP2 and RP3 can be 2.2±0.05 mm, 2.4±0.05 mm, and 2.2±0.05 mm, respectively. The first row pitch RP1 is a distance between centerlines of the first receptacle row 204A and the second receptacle row 210A. The second row pitch RP2 is a distance between centerlines of the second receptacle row 210A and the third receptacle row 220A. A third row pitch RP3 is a distance between the third receptacle row 220A and the fourth receptacle row 206A. A distance between respective centers of the first and second alignment pegs 280A, 280B and the centerline CL along the length of the receptacle connector 200B can be approximately 1.2±0.1 mm. The diameter of the circular alignment peg and the larger diameter of the oval-shaped alignment peg can be approximately 0.6±0.1 mm to 0.8±0.1 mm. The smaller diameter of the oval-shaped second alignment peg 280B can be approximately 0.5±0.1 mm to 0.7±0.1 mm.

As shown in FIG. 15, a receptacle height RH of the receptacle connector 200B, measured from a receptacle mating side 208B of the receptacle housing 202B to bottom surface of a fusible member 230, such as a solder ball, can be between approximately 3.7±0.1 mm. A standoff distance SD between the bottom of the connector standoff and the bottom of the adjacent alignment peg can be approximately 0.74±0.05 mm.

Figure 16:
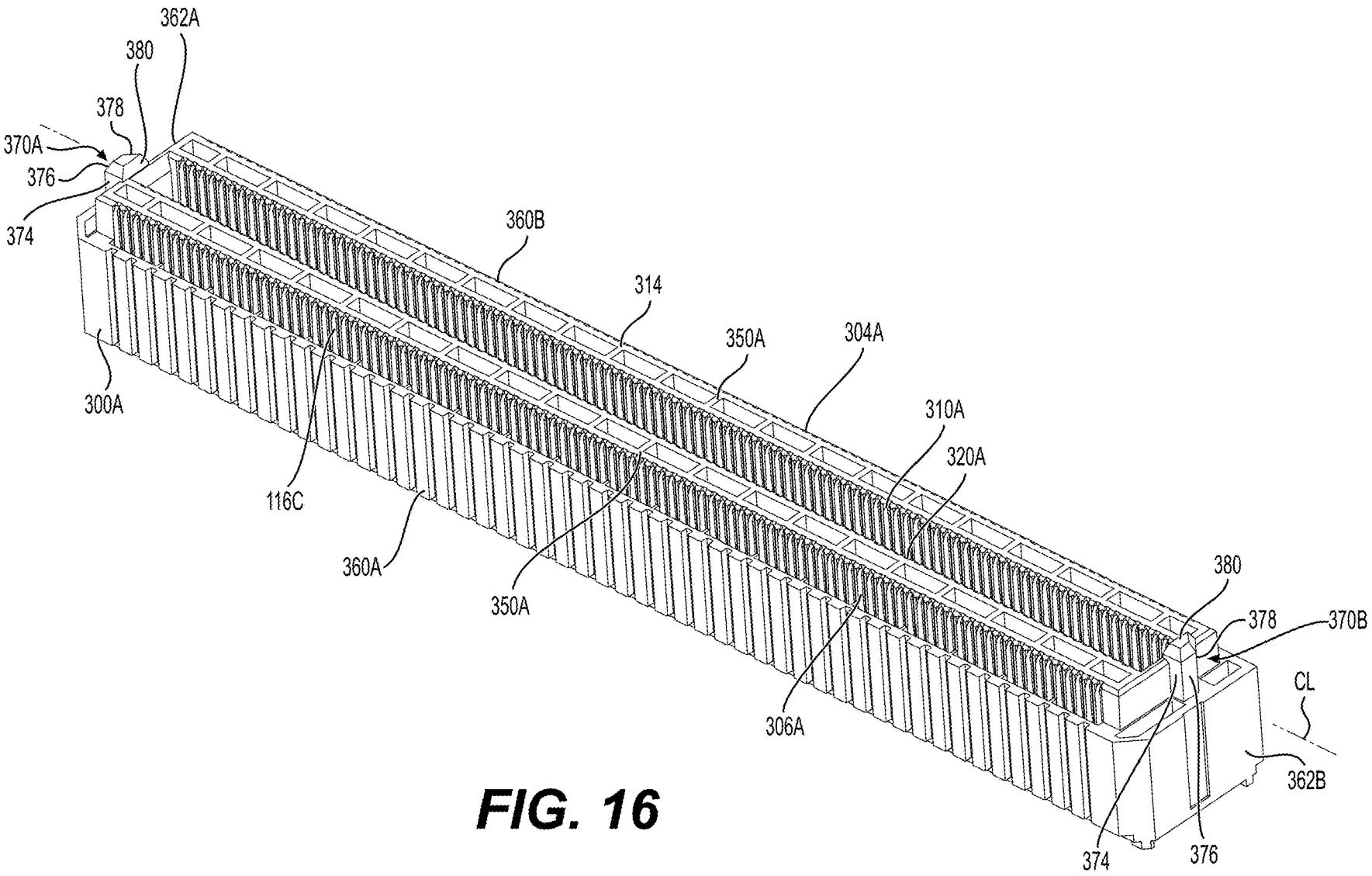
FIG. 16 is a perspective view of a plug connector according to an embodiment of the present invention.
Figure 17:
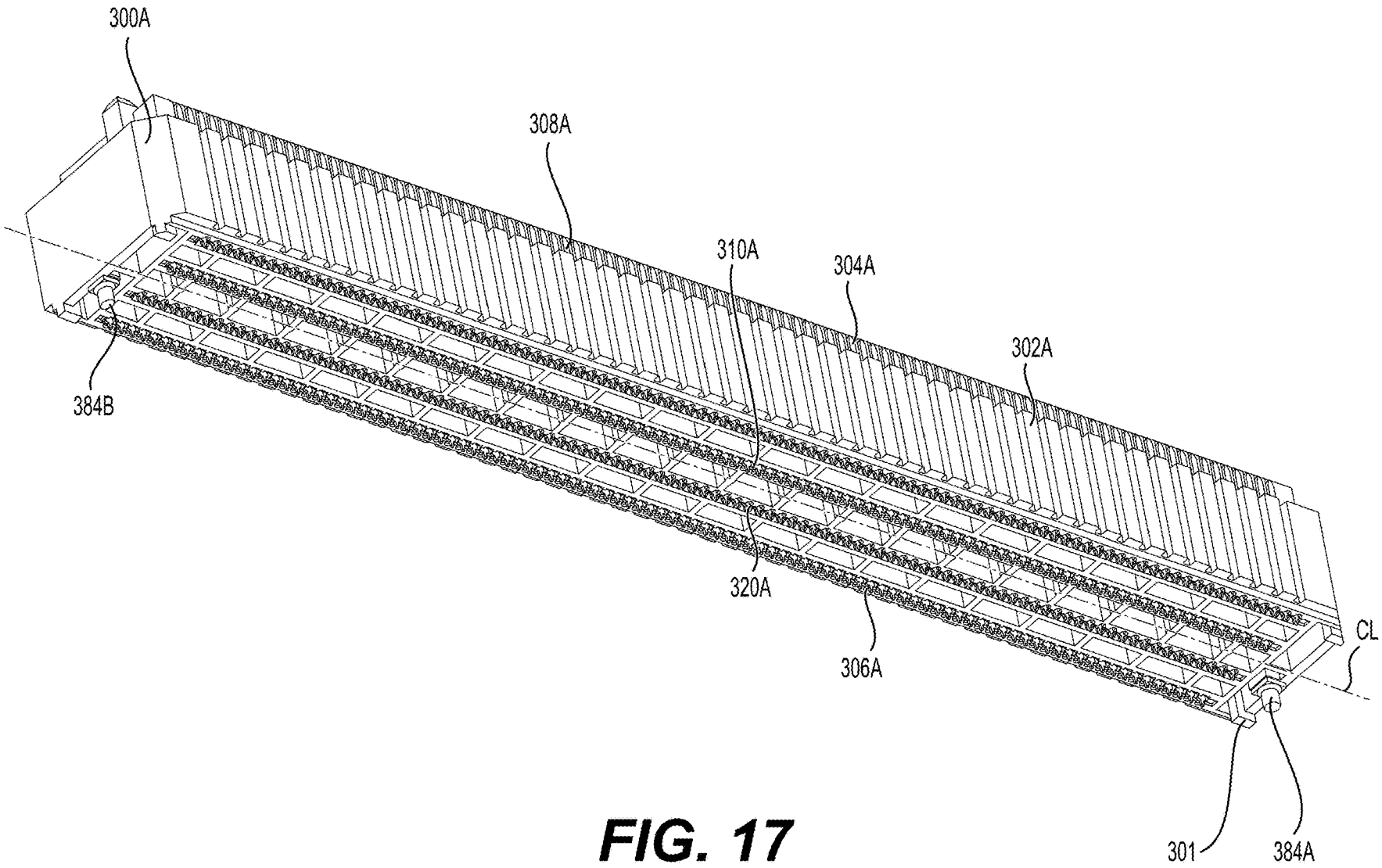
FIG. 17 is a bottom perspective view of the plug connector shown in FIG. 16.

FIGS. 16 and 17 illustrate an exemplary plug connector 300A of an embodiment of the present invention. As shown in FIG. 16, the plug connector 300A can have a plug housing 302A, or connector housing, that defines two parallel, spaced apart longitudinal walls, such as first longitudinal plug wall 360A and second longitudinal plug wall 360B, and two parallel, spaced apart end walls, such as first plug end wall 362A and second plug end wall 362B. The two parallel, spaced apart first and second plug end walls 362A, 362B are shorter in length than the two parallel, spaced apart first and second longitudinal plug walls 360A, 360B. A centerline CL extends through the two parallel, spaced apart plug end walls 362A, 362B, parallel to the two parallel, spaced apart longitudinal plug walls 360A, 360B. The plug connector 300A can include a first plug row 304A, a second plug row 310A, a third plug row, 320A and a fourth plug row 306A of electrical plug contacts 308A that are configured to mate with the receptacle connector 200B shown in FIGS. 13-15. The top perspective view of FIG. 16 shows that the plug connector 300A can include a first plug row 304A and a second plug row 310A of back-to-back electrical plug contacts 308A carried by a plug rib 350A adjacent to a mating interface of the plug housing 302A. The plug connector 300A can further include a third plug row 320A and a fourth plug row 306A of back-to-back electrical plug contacts 308A carried by a plug rib 350A adjacent to a mating interface of the plug housing 302A. The first plug row 304A of electrical plug contacts 308A can be positioned immediately adjacent to the second plug row 310A of electrical plug contacts 308A. The third plug row 320A of electrical plug contacts 308A is positioned adjacent to the second plug row 310A of electrical plug contacts 308A. A fourth plug row 306A of electrical plug contacts 308A is positioned adjacent to the third plug row 320A of electrical plug contacts 308A.

The plug ribs 350A can be spaced apart, be positioned parallel to each other, and extend in a direction from the first plug end wall 362A to the second plug end wall 362B. FIG. 16 also shows that the plug ribs 350A and mating ends 116C protrude above the plug housing 302A so they extend into and mate within recesses defined by the receptacle connector 200B shown in FIGS. 13-15.

The plug connector 300A mating interface 314 can include at least two keying structures, such as first plug keying structure 370A and second plug keying structure. The first plug keying structure 370A can lie on one side of the centerline CL, can abut the centerline CL, or can cross the centerline CL such that the centerline CL passes through at least a portion, but does not bisect the total bounded area, of the first plug keying structure. The second plug keying structure 370B may be positioned at the mating interface of the plug connector 300A on an opposite side of the centerline CL compared to the first plug keying structure 370A, and may abut the centerline CL or may cross the centerline CL such that the centerline CL passes through at least a portion, but does not bisect the total bounded area, of the second plug keying structure 370B. One of the first and second plug keying structures 370A, 370B can partially lie along the same line as the third plug row 320A of electrical plug contacts 308A, but not lie along lines of the first, second and third plug rows 304A, 310A, 320A of electrical plug contacts 308A. One of the remaining first and second plug keying structures 370A, 370B can partially lie along the same line as the second plug row 310A of electrical contacts, but not lie along lines of the first, third and fourth plug rows 304A, 320A, 306A of electrical contacts.

Each of the first and second plug keying structures 370A, 370B can be a respective protrusion defined by the plug housing 302A or positioned adjacent to the plug housing 302A. Each of the first and second plug keying structures can define three or more sides and can include a first plug side wall, line, or surface 374, a second plug side wall, line, or surface 376 that can perpendicularly intersect the first plug side wall 374, a canted plug side wall, line, or surface 378 that intersects with the second plug side wall 376, and fourth plug side wall, line, or surface 380 can intersect the canted plug side wall, line, or surface 378 and the first plug side wall, line, or surface 374. Each of the first and second plug keying structures 370A, 370B is configured to receive a corresponding first keying structure 270A, 270C or second keying structure 270B, 270D, which can be recesses or cavities of a mating receptacle connector 200, 200A, 200B. A fifth plug side wall, line, or surface 382 can be positioned between the canted plug side wall, line, or surface 378 and the fourth plug side wall, line, or surface 380.

On one side of the plug connector 300A, adjacent to first plug end wall 362A, the canted plug side wall 378 can abut the centerline CL, be spaced from the centerline CL, or pass through centerline CL. On an opposed side of the plug connector 300A, adjacent to the second plug end wall 362B, the first plug side wall 374 can abut, can be coincident with, can be parallel to, or can be positioned adjacent to, but spaced away from, the centerline CL. The first plug keying structure 370A and the second plug keying structure 370B can each be identically shaped, can be positioned as mirror images about a centerline that is perpendicular to the centerline CL and spans the first plug row, the second plug row, the third plug row, and the second plug row 304A, 310A, 320A, 306A, or can be positioned as offset mirror images, as shown.

FIG. 17 is a bottom perspective view of the plug connector 300A. Fusible members, not shown in FIG. 17, can be attached to the electrical plug contacts 308A in any suitable manner. The plug connector 300A can include plug standoffs 301. The plug standoffs 301 can be located at the four corners of the plug housing 302A. Any number and any location of plug standoffs 301 can be used. The plug standoffs 301 help ensure that the plug connector 300A is spaced a fixed distance from a mounting surface of a substrate when the fusible members (not shown) are reflowed to connect the plug connector 300A to a substrate. The plug connector 300A can include a first plug alignment peg 384A and a second plug alignment peg 384B that are configured to be received in pre-drilled alignment holes to roughly align fusible elements of the plug connector 300A with corresponding solder pads on a mounting surface of a substrate. FIG. 17 shows two plug alignment pegs, but any number of plug alignment pegs 384A, 384B can be used. The first and second plug alignment pegs 384A, 384B can have any suitable shapes, including, for example, a circular shape, an oval shape, a square shape, etc. The shapes of the first and second plug alignments pegs 384A, 384B can be the same or different. All of the first and second plug alignment pegs 384A, 384B can be positioned on the same side of the centerline CL, such that all of the first and second plug alignment pegs 384A, 384B and one of the first and second plug keying structures 370A, 370B are all positioned on the same side of the centerline CL. At least two alignment pegs can lie on the same line as one of the second plug row 310A of electrical plug contacts 308A and the third plug row 320A of electrical plug contacts 308A. A mated height of the receptacle connector 200, 200A, 200B and plug connector 300, 300A can be approximately 10±1 mm. Both the plug connector 300, 300A and the receptacle connector 200, 200A, 200B can include open pin field contacts.

Figure 18:
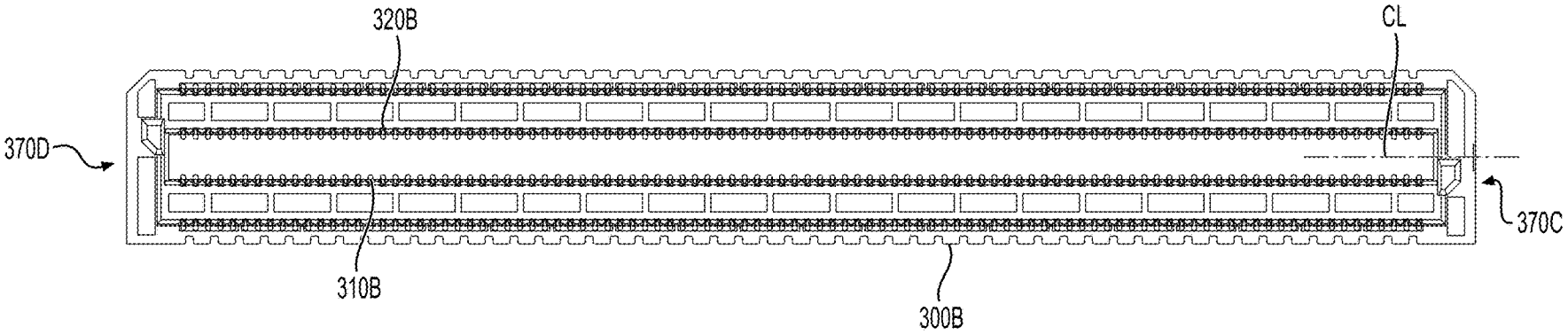
FIG. 18 is a top view of the plug connector shown in FIGS. 16 and 17.
Figure 19:
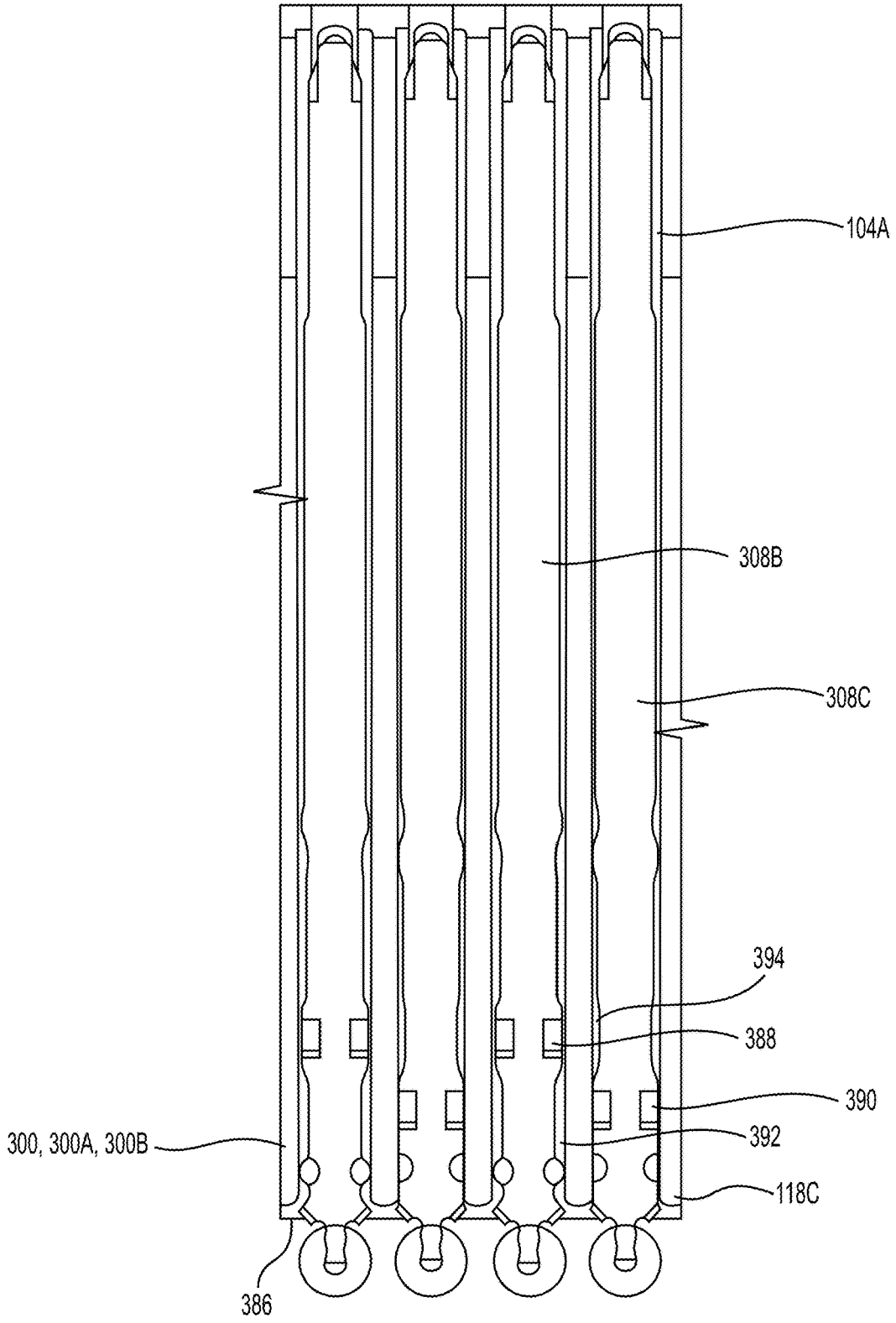
FIG. 19 is cross-sectional view of the plug connector shown in FIGS. 16-18.

FIG. 18 illustrates an exemplary plug connector 300B of an embodiment of the present invention. The plug connector 300B shown in FIG. 19 is similar to the plug connector 300A shown in FIGS. 16 and 17. One difference is that the first plug keying structure 370C shown in FIG. 19 lies on the same line as the third plug row 320B and the first plug keying structure 370A shown in FIG. 16 lies along the same line as the third plug row 320A. Another difference is that the second plug keying structure 370D shown in FIG. 19 lies on the same line as the third plug row 320B, and the second plug keying structure 370B shown in FIG. 16 lies along the same line as the second plug row 310A.

FIG. 19 shows two first electrical plug contacts 308B and two second electrical plug contacts 308C, and any of the plug connectors 300, 300A, 300B. The plug housing 302, 302A includes cores 118C and recesses 104A into which the first and second electrical plug contacts 308B, 308C can be stitched from the mounting side 386 of the plug housing 302, 302A. Plug securing structures 388, 390 can engage the plug housing 302, 302A at different heights. In addition, the first electrical plug contacts 308B can include indents 392, 394 that oppose the plug securing structures 388, 390 of the adjacent first or second electrical plug contacts 308B, 308C. Fusible elements 330, 340 can be attached to mounting ends of first or second electrical plug contacts 308B, 308C.

Figure 20:
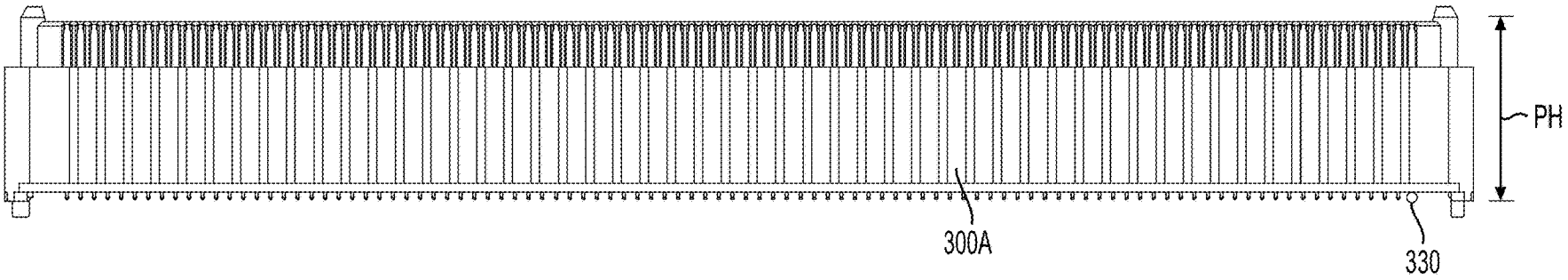
FIG. 20 is a side view of the plug connector shown in FIGS. 16-19.

As shown in FIG. 20, a plug height PH of the plug connector 300, 300A, 300B, measured from a top surface of the plug connector 300, 300A, 300B to a bottom surface of a fusible element 330, such as a solder ball, can be between approximately 8.4±0.5 mm.

Figure 21:
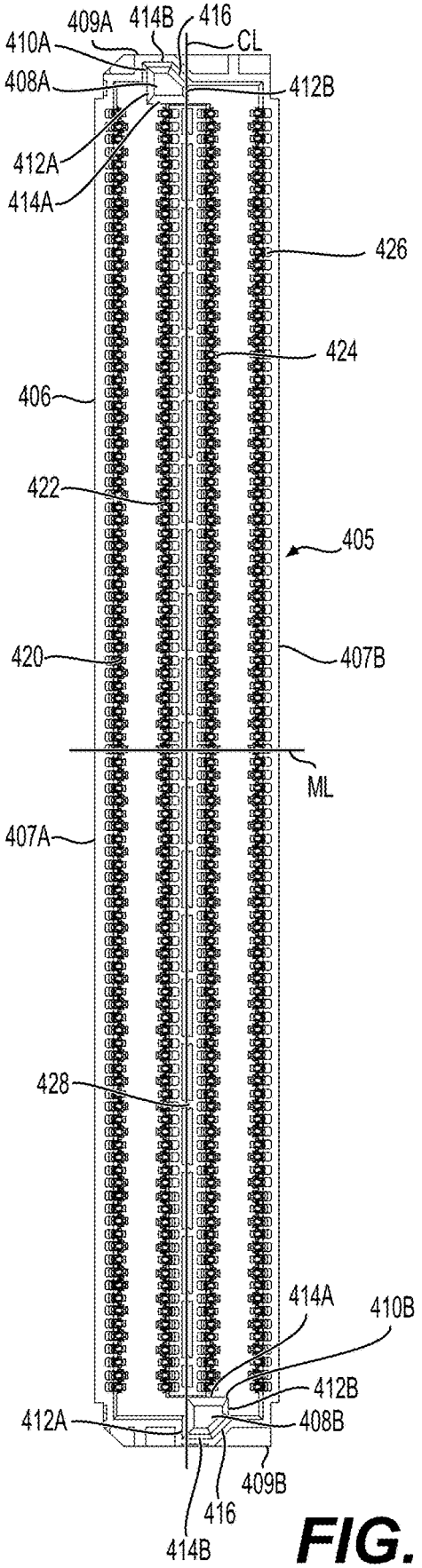
FIG. 21 is a top view of a receptacle connector according to an embodiment of the present invention.

As shown in FIG. 21, a receptacle connector 405 can have a receptacle housing 406 that defines two parallel, spaced apart longitudinal walls, such as first longitudinal wall 407A and second longitudinal wall 407B and two parallel, spaced apart end walls, such as first end wall 409A and second end wall 409B. The two parallel, spaced apart first and second end walls 409A, 409B are shorter in length than the two parallel, spaced apart first and second longitudinal walls 407A, 407B. A centerline CL extends through the two parallel, spaced apart first and second end walls 409A, 409B, parallel to the two parallel, spaced apart first and second longitudinal walls 407A, 407B. A mating interface of the receptacle connector 405 or receptacle housing 406 may include a first keying structure 410A and a second keying structure 410B. The first keying structure 410A can lie on one side of the centerline CL, and may abut the centerline CL or cross the centerline CL such that the centerline CL passes through at least a portion, but does not bisect a total bounded area or perimeter, of the first keying structure 410A. The second keying structure 410B may be positioned at the mating interface of the receptacle housing 406 on an opposite side of the centerline CL compared to the first keying structure 410A, and may abut the centerline CL or cross the centerline CL such that the centerline CL passes through at least a portion, but does not bisect a total bounded area or perimeter, of the second keying structure 410B.

Each of the first and second keying structures 410A, 410B can be a respective first recess 408A and second recess 408B with at least three wall sides or surfaces and four or five total sides or surfaces defined by the receptacle housing 406 and respective portions of the two parallel, spaced apart first and second end walls 409A, 409B. Each of the first and second recesses 408A, 408B can have a bounded area or perimeter defined by a first side wall, line, or surface 412A, a second side wall, line, or surface 414B, a canted side wall, line, or surface 416, a fourth side wall, line, or surface 412B, and a fifth side wall, line, or surface 414A. It should be understood that, with respect to the first and second keying structures 410A, 410B, "wall" can also include a line, surface or partial wall. The first side wall 412A and the fourth side wall 412B can be parallel to each other. The second side wall 414B and the fifth side wall 414A can be parallel to each other. The first side wall 412A and the second side wall 414B can intersect to form a right angle. The canted side wall 416 can intersect the second side wall 414B. The fourth side wall 412B can be parallel to the first side wall 412A and can intersect the canted side wall 416. The fifth side wall 414A can be parallel to the second side wall 414B and can intersect the first side wall 412A and the fourth side wall 412B. The second sidewall 414B can be shorter in length than the first side wall 412A and the fifth side wall 414A. The fourth side wall 412B can be the shortest sidewall in length. Each of the first and second keying structures 410A, 410B, which can be recesses, are configured to receive a corresponding first plug keying structure 510A or second plug keying structure 510B shown in FIG. 24, which can be posts or first or second protrusions 508A, 508B defined by plug housing 505 or positioned adjacent to a plug housing 505. For example, the first keying structure 410A of the receptacle connector 405 can receive the second plug keying structure 510B of the plug housing 505, and the second keying structure 410B of the receptacle housing 406 can receive the first plug keying structure 510A of the plug housing 505.

The receptacle connector 405 or receptacle housing 406 can include four parallel, spaced apart receptacle rows 420, 422, 424, 426 of electrical contacts 110, 110A, 120. A first receptacle row 420 of electrical contacts 110, 110A, 120 and a fourth receptacle row 426 of electrical contacts 110, 110A, 120 extend along the inside of the respective first longitudinal wall 407A and the second longitudinal wall 407B of the receptacle housing 406. A second receptacle row 422 of electrical contacts 110, 110A, 120 and a third receptacle row 424 of electrical contacts 110, 110A, 120 are back-to-back extending along an inner rib 428 that extends from end to end down a middle of the receptacle connector 405 or receptacle housing 406. Although the receptacle connector 405 is shown with four parallel, spaced apart, shieldless rows, any number of rows of electrical contacts 110, 110A, 120 can be used. The electrical contacts 110, 110A, 120 of the receptacle connector 405 can be stitched from two directions as described with respect to FIGS. 4-8. The receptacle connector 405 can be devoid any of crosstalk shields and magnetic absorbing lossy material or can include any number of crosstalk shields or electrically conductive or non-conductive magnetic absorbing lossy material. Fusible elements, such as solder balls, can be attached to respective ones of the electrical contacts 110, 110A, 120. The electrical contacts 110, 110A, 120 can also terminate in press-fit pins or eye-of-the needles, J-lead, or other configurations.

On one side of the receptacle connector 405 or receptacle housing 406, adjacent to first end wall 409A, the fourth side wall 412B can abut, be coincident with, or be positioned adjacent to, but spaced away from, the centerline CL. The first side wall 412A can be positioned parallel to and spaced away from the centerline CL. On an opposed side of the receptacle connector 405 or receptacle housing 406, adjacent to the second end wall 409B, the first side wall 412A can abut, be coincident with, or be positioned adjacent to, but spaced away from, the centerline CL. The fourth side wall 412B can be positioned parallel to and spaced away from the centerline CL. The first keying structure 410A and the second keying structure 410B can be identically shaped. The second keying structure 410B can be a mirror image of the first keying structure 410A with respect to a median centerline ML that is perpendicular to the centerline CL.

Figure 22:
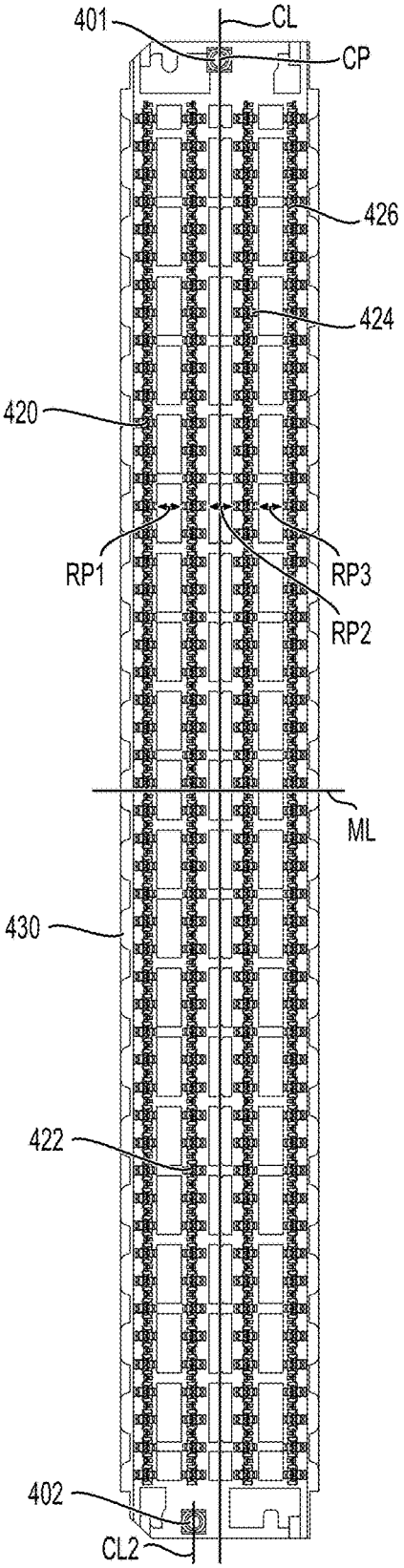
FIG. 22 is a bottom view of the receptacle connector shown in FIG. 21.

As shown in FIG. 22, a mounting interface of the receptacle connector 405 can include first alignment peg 401 and second alignment peg 402. The centerline CL can pass through the first alignment peg 401, and the first alignment peg 401 may have a center point CP that the centerline CL passes through. The second alignment peg 402 can be positioned on either side of the centerline CL, such that the centerline CL does not intersect the second alignment peg 402. In one embodiment, the second alignment peg 402 can be positioned, completely or partially, under the first keying structure 410A. The first alignment peg 401 can be positioned, completely or partially, under the second keying structure 410B. The second alignment peg 402 and the second receptacle row 422 of electrical contacts 110, 110A, 120 can both lie along a centerline CL2 that is parallel to and spaced away from the centerline CL, such that the centerline CL2 passes through the second receptacle row 422 of electrical contacts 110, 110A, 120 and the second alignment peg 402. The first alignment peg 401 can have a circular shape with a diameter of approximately 0.8±0.05 mm, and the second alignment peg 402 can have an oval shape with diameters of approximately 0.8±0.05 mm and 0.6±0.05 mm. The first alignment peg 401 can be positioned adjacent to the first end wall 409A of the receptacle housing 406 or connector housing and adjacent to a mounting interface 430 of the receptacle housing 406. The second alignment peg 402 can be positioned adjacent to the second end wall 409B of the receptacle housing 406 and adjacent to the mounting interface 430 of the receptacle housing 406. The first alignment peg 401 and the second alignment peg 402 can both be positioned non-symmetrically about both the longitudinal centerline CL and the median centerline ML. The first row pitch RP1 between respective electrical contact centers of the first receptacle row 420 and the second receptacle row 422 can be approximately 2.2±0.005 mm, 2.2±0.1 mm or 2.2±0.05 mm. A second row pitch RP2 between respective electrical contact centers of the second receptacle row 422 and the third receptacle row 424 can be approximately 2.4±0.005 mm, 2.4±0.1 mm or 2.4±0.05 mm. A third row pitch RP3 between respective electrical contact centers of the third receptacle row 424 and the fourth receptacle row 426 can be approximately 2.2±0.005 mm, 2.2±0.1 mm or 2.2±0.05 mm.

Figure 23:
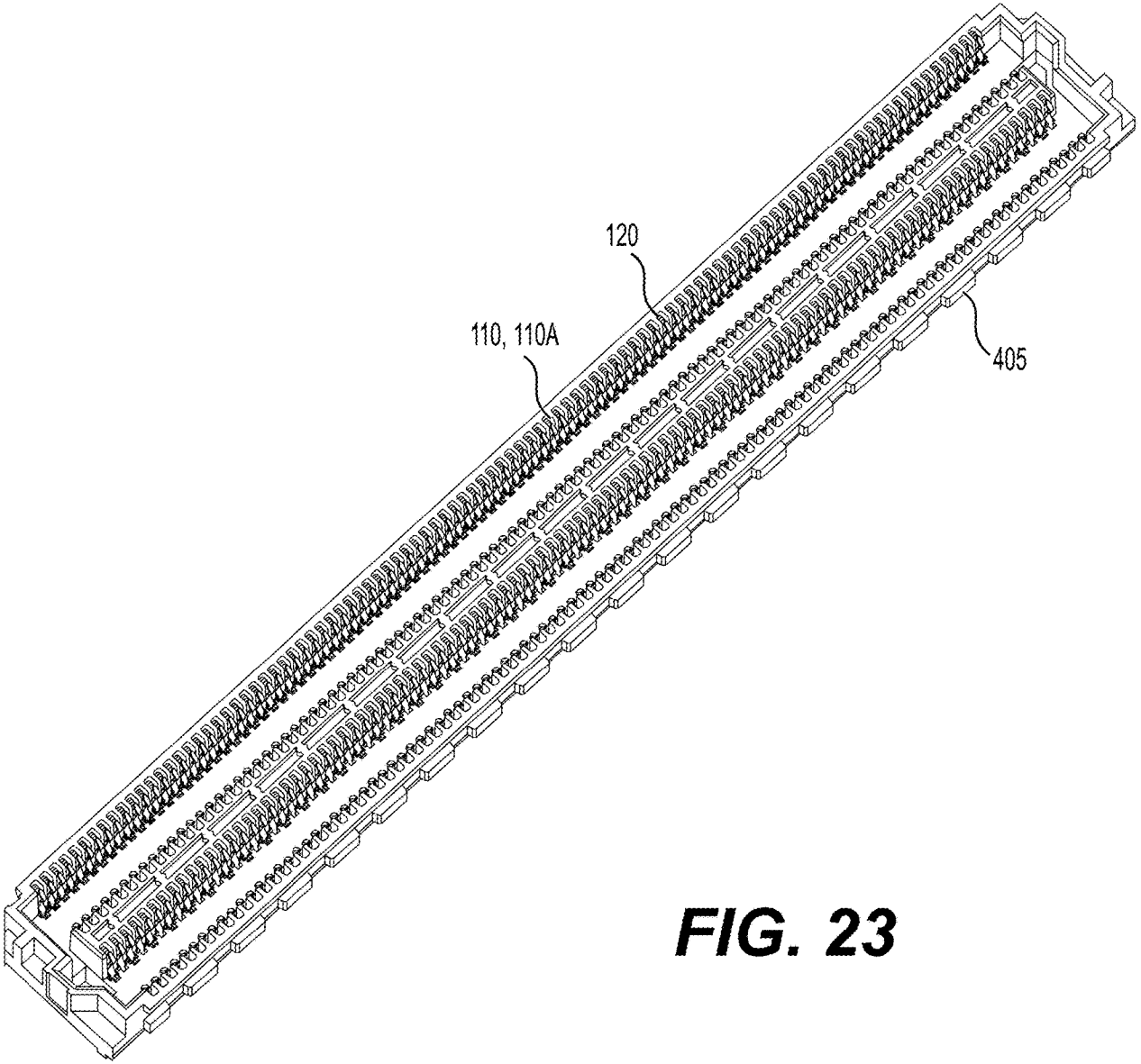
FIG. 23 is a top perspective view of the receptacle connector shown in FIGS. 21-22.

FIG. 23 is a top perspective view of the receptacle connector 405 shown in FIGS. 21 and 22. Immediately adjacent electrical contacts 110, 110A, 120 can be spaced apart on 0.65±0.05 centerlines. The receptacle connector 405 can carry 400 electrical contacts 110, 110A, 120 in four rows of one-hundred electrical contacts.

Figure 24:
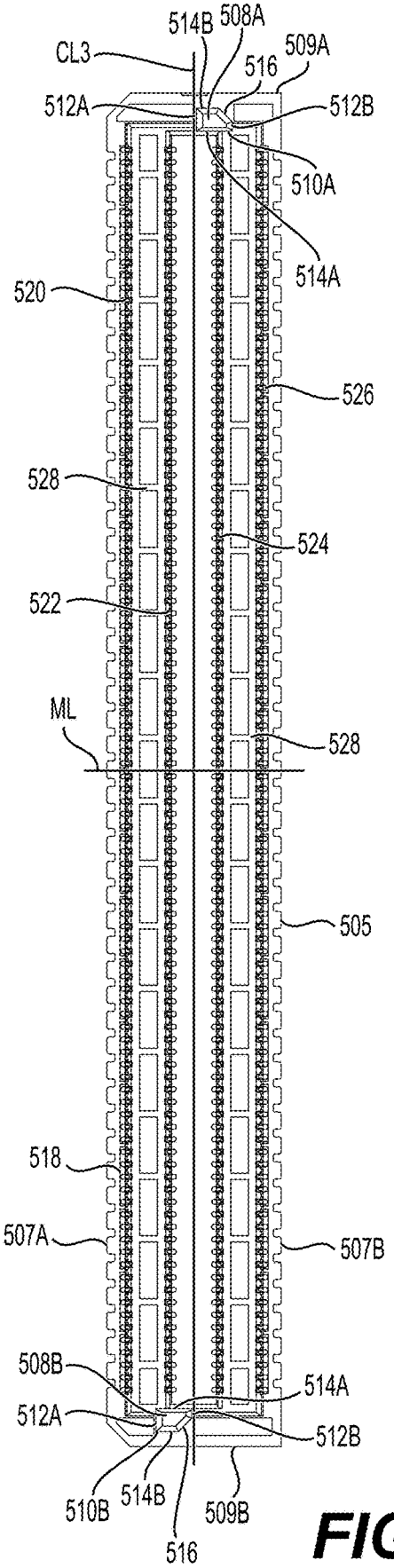
FIG. 24 is a top view of a plug connector according to an embodiment of the present invention.
Figure 25:
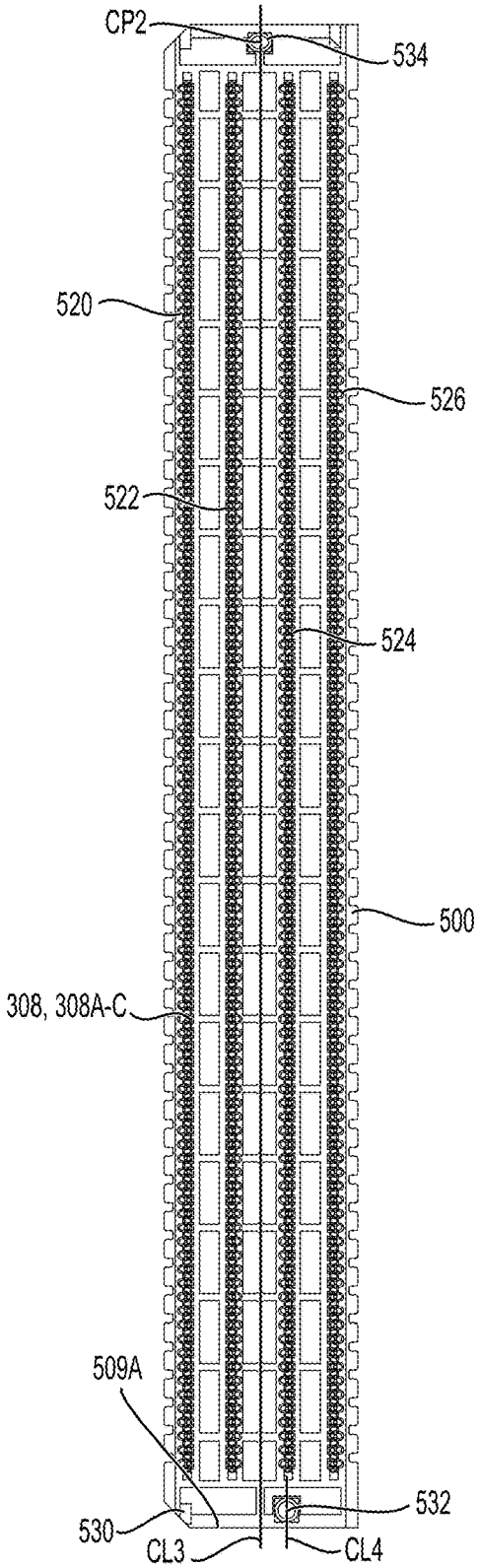
FIG. 25 is a bottom view of the plug connector shown in FIG. 24.
Figure 26:
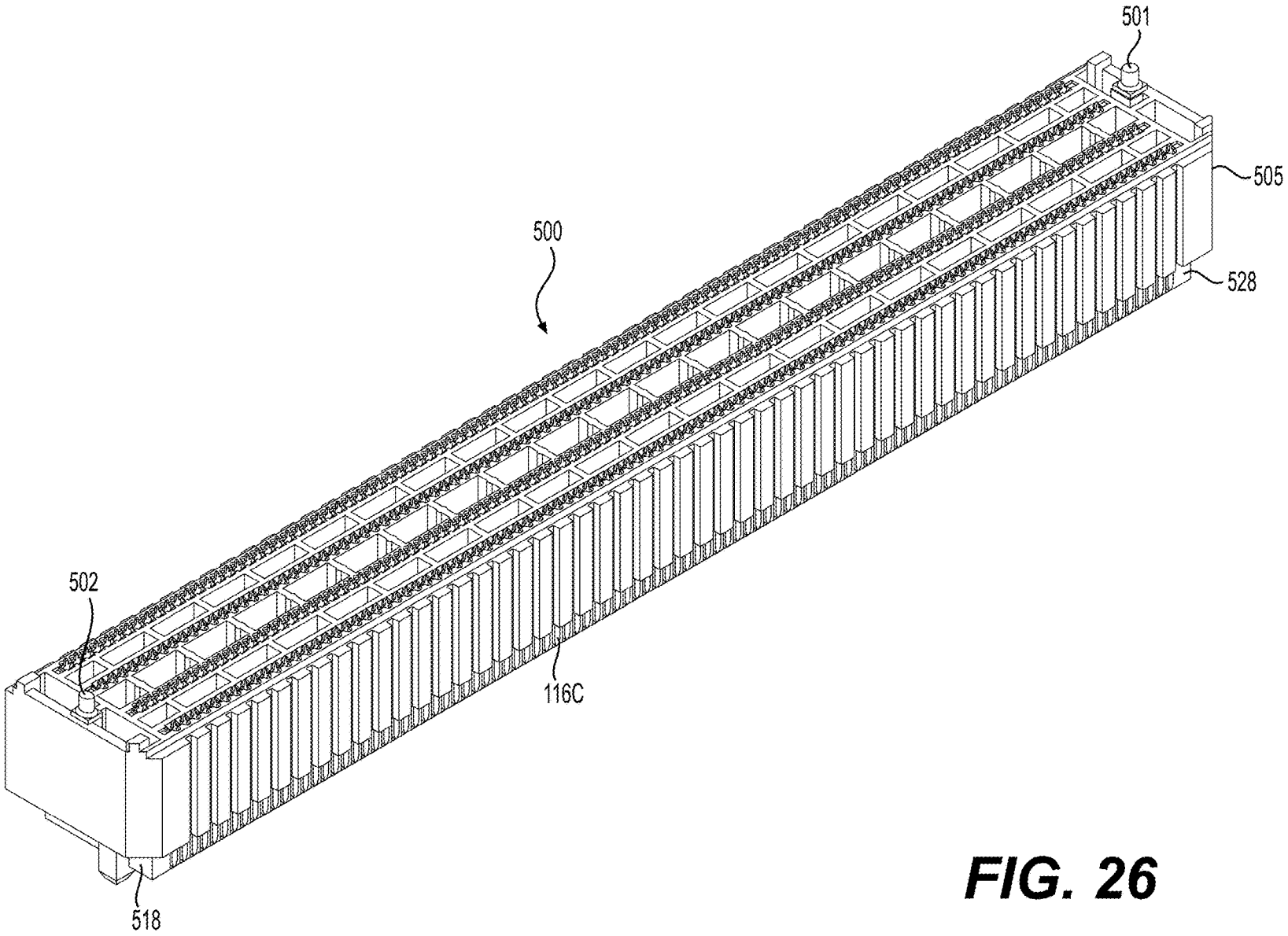
FIG. 26 is a bottom perspective view of the plug connector shown in FIGS. 24-26.

FIGS. 24-26 illustrate an exemplary plug connector 500. As shown in FIG. 24, a plug housing 505 or connector housing can be defined by two parallel, spaced apart longitudinal walls, such as first longitudinal plug wall 507A and second longitudinal plug wall 507B and two parallel, spaced apart end walls, such as first plug end wall 509A and second plug end wall 509B. The first and second plug end walls 509A, 509B are shorter in length than the two first and second longitudinal plug walls 507A, 507B. A longitudinal centerline CL3 extends through the first and second plug end walls 509A, 509B, parallel to the first and second longitudinal plug walls 507A, 507B. A mating interface of the plug connector 500 or plug housing 505 may include a first plug keying structure 510A and a second plug keying structure 510B. The first plug keying structure 510A can be on one side of the longitudinal centerline CL3 and can be spaced away from the longitudinal centerline CL3, can abut the longitudinal centerline CL3, or can cross the longitudinal centerline CL3 such that the longitudinal centerline CL3 passes through at least a portion of the first plug keying structure 510A but does not bisect the total bounded area or perimeter of the first plug keying structure 510A. The second plug keying structure 510B may be positioned at the mating interface of the plug connector 500 or plug housing 505, on an opposite side of the longitudinal centerline CL3 as compared to the first plug keying structure 510A, and may be spaced away from the longitudinal centerline CL3, abut the longitudinal centerline CL3 or cross the longitudinal centerline CL3 such that the longitudinal centerline CL3 passes through at least a portion of the second plug keying structure 510B without bisecting the total bounded area or the perimeter of the second plug keying structure 510B.

The plug connector 500 can include a first plug row 520 of electrical plug contacts 308, 308A, 308B, 308C, a second plug row 522 of electrical plug contacts 308, 308A, 308B, 308C, a third plug row 524 of electrical plug contacts 308, 308A, 308B, 308C, and a fourth plug row 526 of electrical plug contacts 308, 308A 308B, 308C. Plug connector 500 can include a first plug row 520 and a second plug row 522 of back-to-back electrical plug contacts 308, 308A, 308B, 308C carried by a plug rib 528 adjacent to a mating interface of the plug housing 505. The plug connector 500 can further include a third plug row 524 and a fourth plug row 526 of back-to-back electrical plug contacts 308, 308A, 308B, 308C carried by a plug rib 528 adjacent to a mating interface of the plug housing 505. The first plug row 520 of electrical plug contacts 308, 308A, 308B, 308C can be positioned immediately adjacent to the second plug row 522 of electrical plug contacts 308, 308A. 308B, 308C. The third plug row 524 of electrical plug contacts 308, 308A, 308B, 308C can be positioned adjacent to the second plug row 522 of electrical plug contacts 308, 308A, 308B, 308C. A fourth plug row 526 of electrical plug contacts 308, 308A, 308B, 308C can be positioned adjacent to the third plug row 524 of electrical plug contacts 308, 308A, 308B, 308C.

The plug ribs 528 can be spaced apart, can be positioned parallel to each other, and can extend in a direction from the first plug end wall 509A to the second plug end wall 509B. As shown in FIG. 26, plug ribs 528 and mating ends 116C at mating interface 518 can protrude above a step defined by the plug housing 505 so plug ribs 528 and mating ends 116C extend into and mate within recesses defined by a mating receptacle connector.

Referring again to FIG. 24, the mating interface 518 of the plug connector 500 can include at least two keying structures, such as first plug keying structure 510A and second plug keying structure 510B. The first plug keying structure 510A can lie on one side of the longitudinal centerline CL3, can abut the longitudinal centerline CL3, or can cross the longitudinal centerline CL3 such that the longitudinal centerline CL3 passes through at least a portion, but does not bisect the total bounded area, of the first plug keying structure 510A. The second plug keying structure 510B may be positioned at the mating interface 518 of the plug connector 500 on an opposite side of the longitudinal centerline CL3 compared to the first plug keying structure 510A, and may abut the longitudinal centerline CL3 or cross the longitudinal centerline CL3 such that the longitudinal centerline CL3 passes through at least a portion, but does not bisect the total bounded area, of the second plug keying structure 510B. The first plug keying structure 510A can partially lie along the same line as the third plug row 524 of electrical plug contacts 308, 308A, 308B, 308C, but not lie along lines of the first, second and fourth plug rows 520, 522, 526 of electrical plug contacts 308, 308A, 308B, 308C. The second plug keying structure 510B can partially lie along the same line as the second plug row 522 of electrical plug contacts 308, 308A, 308B, 308C, but not lie along lines of the first, third and fourth plug rows 520, 524, 526 of electrical plug contacts 308, 3008A, 308B, 308C.

Each of the first and second plug keying structures 510A, 510B can be a respective first protrusion 508A or second protrusion 508B defined by the plug housing 505 or positioned adjacent to the plug housing 505. Each of the first and second plug keying structures 510A, 510B can define three or more sides and can include a first plug side wall, line, or surface 512A, a second plug side wall, line, or surface 514B that can perpendicularly intersect the first plug side wall 512A, a canted plug side wall, line, or surface 516 that intersects with the second plug side wall 514B, a fourth plug side wall, line, or surface 512B, and a fifth plug side wall 514A. The fourth plug side wall, line, or surface 512B can intersect the canted plug side wall, line, or surface 516 and the fifth plug side wall, line, or surface 514A. The fifth plug side wall, line, or surface 514A can intersect the fourth plug side wall, line, or surface 512B and the first plug side wall, line, or surface 512A.

Each of the first and second plug keying structures 510A, 510B are configured to receive a corresponding first keying structure 270A, 270C or second keying structure 270B, 270D of a mating receptacle connector 200, 200A, 200B.

On one side of the plug connector 500 or plug housing 505, adjacent to first plug end wall 509A, first plug side wall 512A can abut the longitudinal centerline CL3, can be spaced away from the longitudinal centerline CL3, or can pass through longitudinal centerline CL3. On an opposed side of the plug connector 500 or plug housing 505, adjacent to the second plug end wall 509B, the fourth plug side wall 512B can abut, can be coincident with, can be parallel to, or can be positioned adjacent to, but spaced away from, the longitudinal centerline CL3. The first plug keying structure 510A and the second plug keying structure 510B can each be identically shaped, can be positioned as mirror images about a centerline ASF that is perpendicular to the longitudinal centerline CL3 and spans the first plug row, the second plug row, the third plug row, and the fourth plug row 520, 522, 524, 526, or can be positioned as offset mirror images about centerline ASF, as shown.

FIG. 25 is a bottom view of the plug connector 500A. Fusible members, not shown, can be attached to the electrical plug contacts 308, 308A, 308B, 308C in any suitable manner. Alternatively, the electrical plug contacts 308, 308A, 308B, 308C can terminate in J-leads, press-fit pins or eye-of-needles, or other suitable termination. The plug connector 500 can include plug standoffs 530. The plug standoffs 301 can be located at the four corners of the plug housing 505. Any number and any location of plug standoffs 530 can be used. The plug standoffs 530 help ensure that the plug connector 500A is spaced a fixed distance from a mounting surface of a substrate when the fusible members (not shown) are re-flowed to connect the plug connector 500A to a substrate. The plug connector 500 can include first plug alignment peg 532 and a second plug alignment peg 534 that are configured to be received in pre-drilled alignment holes to roughly align fusible elements of the plug connector 500 with corresponding solder pads on a mounting surface of a substrate.

FIG. 25 shows first and second plug alignment pegs 532, 534, but any number of plug alignment pegs can be used. The first and second plug alignment pegs 532, 534 can have any suitable shapes, including, for example, a circular shape, an oval shape, a square shape, etc. The shapes of the first and second plug alignments pegs 532, 534 can be the same or different. All of the first and second plug alignment pegs 532, 534 can be positioned on the same side of the longitudinal centerline CL3, such that all of the first and second plug alignment pegs 532, 534 and one of the first and second plug keying structures 510A, 510B are all positioned on the same side of the longitudinal centerline CL3. The first alignment peg 532, which can be positioned adjacent to the first plug end wall 509A can lie on the same line as the third plug row 524 of electrical plug contacts 308, 308A-C.

Longitudinal centerline CL3 can pass through the second plug alignment peg 534, and the second plug alignment peg 534 may have a center point CP2 that the longitudinal centerline CL3 passes through. The first plug alignment peg 532 can be positioned on either side of the longitudinal centerline CL3, such that the longitudinal centerline CL3 does not intersect the first plug alignment peg 532. In one embodiment, the first plug alignment peg 532 can be positioned, completely or partially, under the perimeter of the first plug keying structure 510A. The second plug alignment peg 534 can be positioned, completely or partially, under the perimeter of the second plug keying structure 510B. The first plug alignment peg 532 and the third plug row of electrical plug contacts can both lie along a centerline CL4 that is parallel to the longitudinal centerline CL3 and spaced away from the longitudinal centerline CL3

The second plug alignment peg 534 may be aligned with the longitudinal centerline CL3 of the plug connector 500, while the first plug alignment peg 532 may be a distance between approximately 1.2±0.05 mm to approximately 1.3±0.05 mm from the longitudinal centerline CL3 of the plug connector 500. The first plug alignment peg 532 can have a circular shape with a diameter of approximately 0.8±0.05 mm, and the second plug alignment peg 534 can have an oval shape with diameters of approximately 0.8±0.05 mm and 0.6±0.05 mm. A first row pitch RP1 between respective electrical contact centers of the first plug row 520 and the second plug row 522 can be approximately 2.2±0.1 mm, 2.2±0.05, or 2.2±0.005 mm. A second row pitch RP2 between respective electrical contact centers of the second plug row 522 and the third plug row 524 can be approximately 2.4±0.1 mm, 2.4±0.05 mm or 2.4±0.005 mm. A third row pitch RP3 between respective electrical contact centers of the third plug row 524 and the fourth plug row 526 can be approximately 2.2±0.1 mm, 2.2±0.05 mm or 2.2±0.005 mm.

Figure 27:
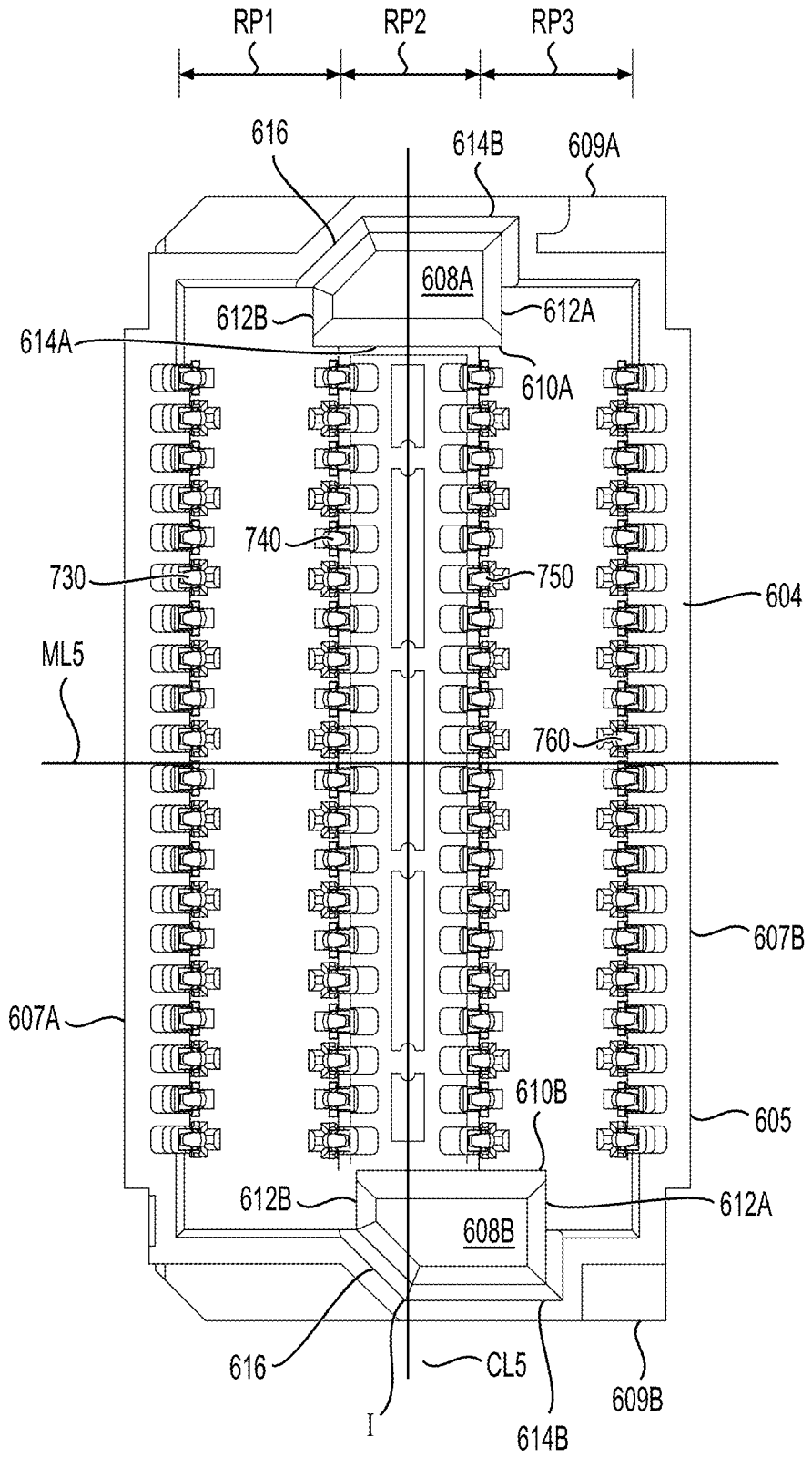
FIG. 27 shows a top view of a receptacle connector according to an embodiment of the present invention.

Referring to FIG. 27, a receptacle connector 600 can include a receptacle housing 605 can be defined by two parallel, spaced apart first and second longitudinal walls 607A, 607B and two parallel, spaced apart first and second end walls 609A, 609B. The two parallel, spaced apart first and second end walls 609A, 609B can be shorter in length than the two parallel, spaced apart first and second longitudinal walls 607A, 607B. Longitudinal centerline CL5 extends through the two parallel, spaced apart first and second end walls 609A, 609B, parallel to the two parallel, spaced apart first and second longitudinal walls 607A, 607B. A mating interface 604 of the receptacle housing 605 may include a first receptacle keying structure 610A and a second receptacle keying structure 610B. The first receptacle keying structure 610A lies on the longitudinal centerline CL5 such that the first receptacle keying structure 610A is non-symmetrical about the centerline CL5. The second keying structure 610B may be positioned at the mating interface 604 of the receptacle housing 605, on an opposite side of the longitudinal centerline CL5 compared to the first receptacle keying structure 610A, and can lie on the longitudinal centerline CL5 such that the second longitudinal keying structure 610B is non-symmetrical about the longitudinal centerline CL5 and non-symmetrical about median centerline ML5. The first receptacle keying structure 610A and the second receptacle keying structure 610B can be offset with respect to each other and the median centerline CL5. The first and second receptacle keying structures 610A, 610B can be offset mirror images of each other.

Each first and second receptacle keying structure 610A, 610B can be a respective first and second recess 608A, 608B, each with four or five sides or surfaces defined by the receptacle housing 605 and respective portions of the two parallel, spaced apart first and second end walls 609A, 609B. Each five-sided first and second recess 608A, 608B can have a perimeter defined by a first side wall, line, or surface 612A, a second side wall, line, or surface 614B, a canted side wall, line, or surface 616, a fourth side wall, line, or surface 612B, and a fifth side wall, line, or surface 614A. It should be understood that, with respect to the first and second keying structures 610A, 610B, the term wall can also include line or surface. Fifth and second side walls 614A, 614B can form respective right angles with first side wall 612A. Fourth side wall 612B can form a right angle with fifth side wall 614A. Fourth side wall 612B is shorter in length than any of the other side walls 612A, 614B, 616, 614A. Each of the first and second receptacle keying structures 610A, 610B, which can be recesses, are configured to receive a corresponding first plug keying structure 710A or second plug keying structure 710B as shown in FIG. 29, which are posts or protrusions of a plug housing 705.

On one side of the receptacle housing 605, adjacent to first end wall 609A, the first and fourth side walls 612A, 612B can be evenly spaced away from the longitudinal centerline CL5. On an opposite end of the receptacle housing 605, adjacent to second end wall 609B, the longitudinal centerline CL5 can intersect an intersection I of second side wall 614B and the canted side wall 616. First side wall 612A and fourth side wall 612B can be unevenly spaced or can be non-uniformly spaced away from the longitudinal centerline CL5. The first keying structure 610A and the second keying structure 610B can be identically shaped or have the same perimeter shape. The first keying structure 610B can be offset from the second keying feature 610A with respect to the longitudinal centerline CL, with respect to the median centerline ML5, or both the longitudinal centerline CL and the medial centerline ML5. The first receptacle keying structure 610A can be a mirror image of the second keying structure 610B with respect to median centerline ML5 that is perpendicular to the longitudinal centerline CL5.

Figure 28:
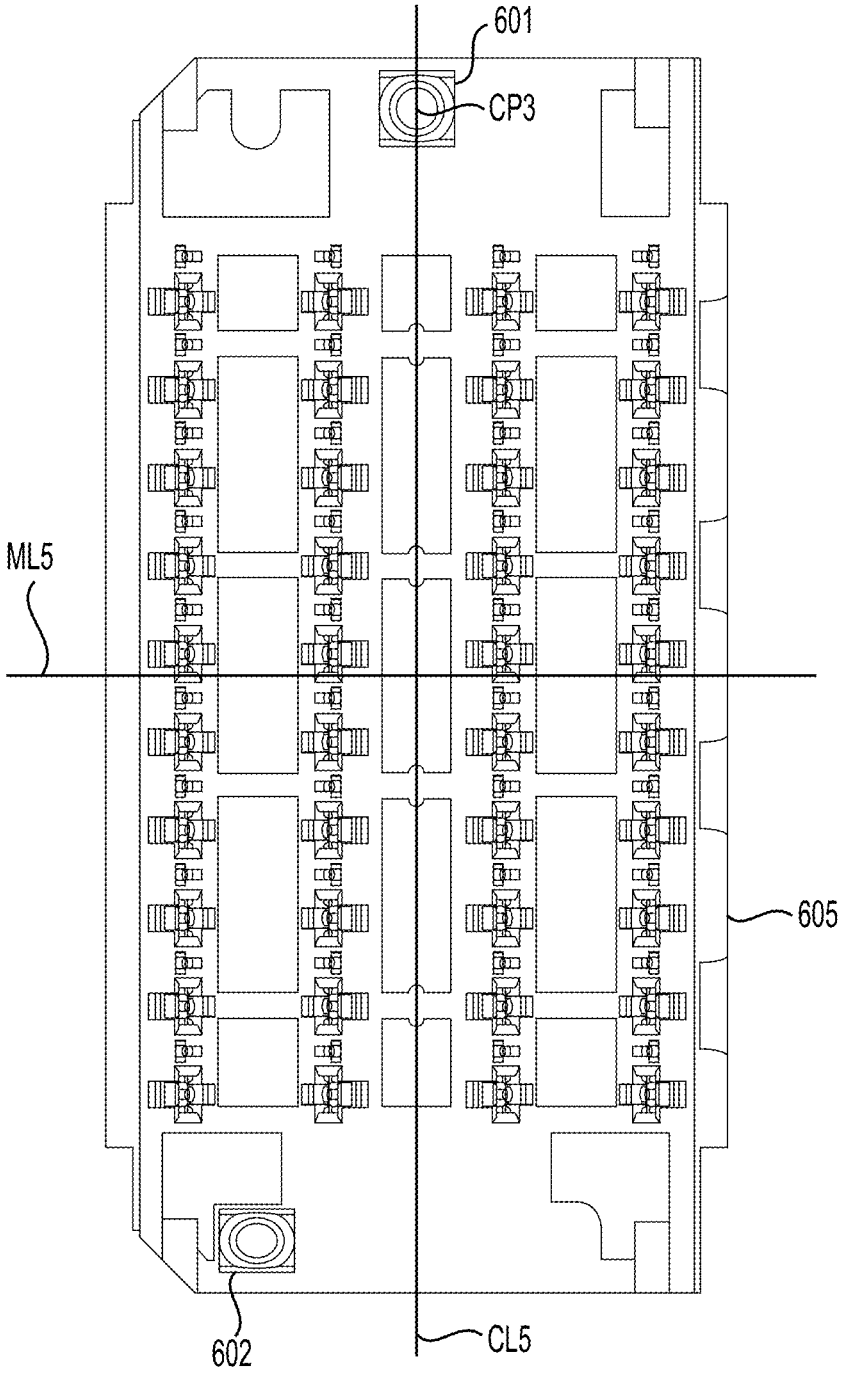
FIG. 28 shows a bottom view of the receptacle connector shown in FIG. 27.

As shown in FIG. 28, a mounting side or interface 620 of the receptacle housing 605 can include a first alignment peg 601 and a second alignment peg 602. The longitudinal centerline CL5 can pass through the first alignment peg 601, and the first alignment peg 601 may have a center point CP3 that the longitudinal centerline CL5 passes through. The second alignment peg 602 can be positioned on either side of the longitudinal centerline CL5, such that the longitudinal centerline CL5 does not intersect the second alignment peg 602. In one embodiment, the second alignment peg 602 can be positioned, completely or partially, under a perimeter defined by the first receptacle keying structure 610A shown in FIG. 27. The first alignment peg 601 can be positioned, completely or at least partially, under a perimeter defined by the second keying structure 610B of FIG. 27. The second alignment peg 602 can also be positioned so that the second alignment peg 602 is not even partially positioned under the first receptacle keying structure 610A. The first alignment peg 601 can have a circular shape with a diameter of approximately 0.8±0.05 mm, and the second alignment peg 602 can have an oval shape with dimensions of approximately 0.8±0.05 mm and 0.6±0.05 mm.

Figure 29:
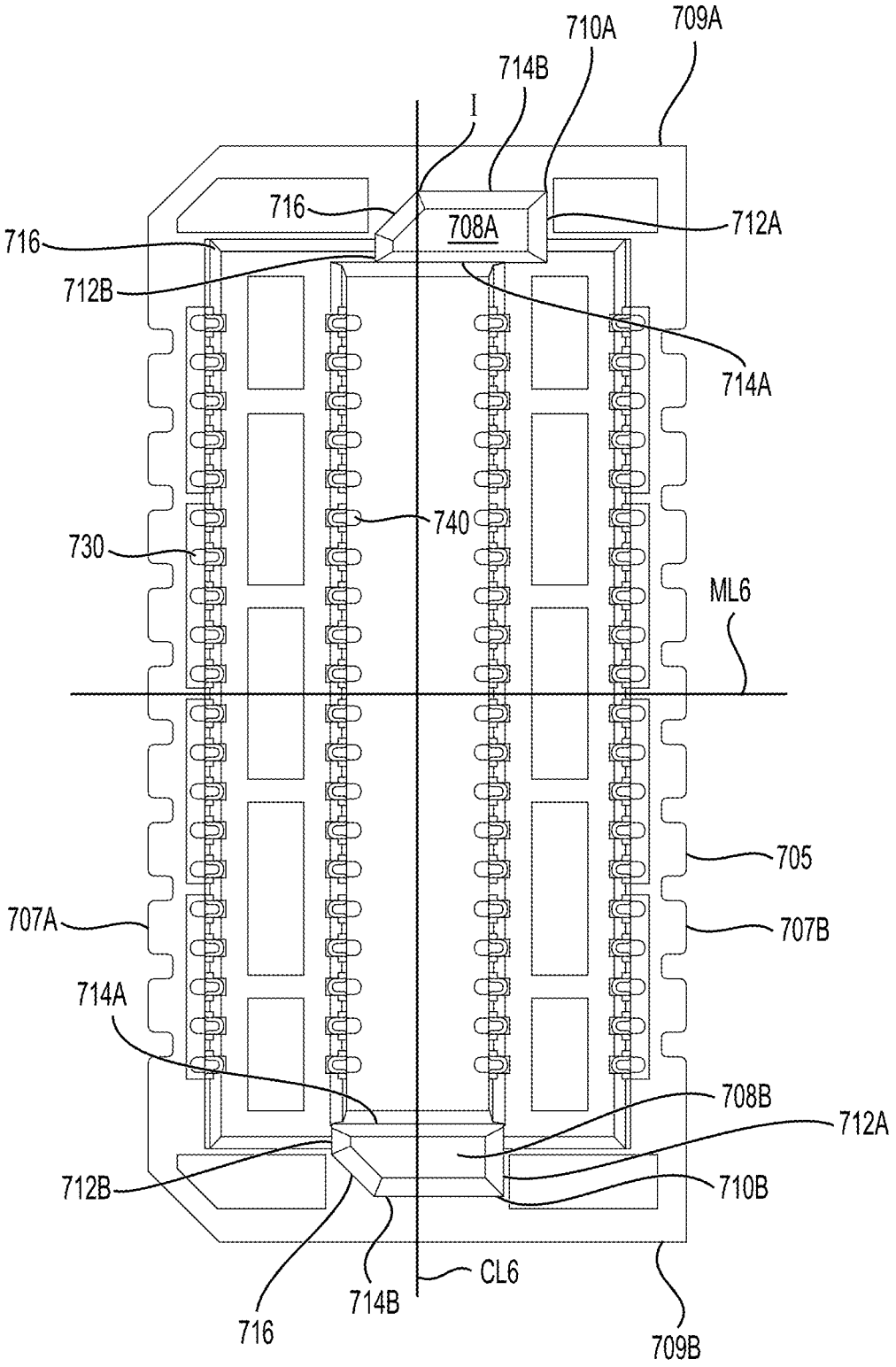
FIG. 29 shows a top view of a plug connector according to an embodiment of the present invention.

As shown in FIG. 29, a plug connector 700 having a plug housing 705 can be defined by two parallel, spaced apart, opposed first and second longitudinal plug walls 707A, 707B and two parallel, spaced apart first and second plug end walls 709A, 709B. The two parallel, opposed spaced apart first and second plug end walls 709A, 709B can be shorter in length than the two parallel, spaced apart first and second longitudinal plug walls 707A, 707B. A longitudinal centerline CL6 extends through the two parallel, spaced apart first and second plug end walls 709A, 709B, parallel to the two parallel, spaced apart first and second longitudinal plug walls 707A, 707B. A mating interface 704 of the plug housing 705 may include a first plug keying structure 710A and a second plug keying structure 710B. The first plug keying structure 710A can lie on the longitudinal centerline CL6 such that the first plug keying structure 710A is non-symmetrical about the longitudinal centerline CL6. The second plug keying structure 710B may be positioned at the mating interface 704 of the plug housing 705, on an opposite side of the longitudinal centerline CL6 compared to the first plug keying structure 710A, and can lie on the longitudinal centerline CL6 such that the second plug keying structure 710B is non-symmetrical about the longitudinal centerline CL6. The first plug keying structure 710A and the second plug keying structure 710B can be offset with respect to each other about the longitudinal centerline CL6. Each first and second plug keying structure 710A, 710B can each define respective four-sided or five-sided first and second projections 708A, 708B that each extend in a direction perpendicular to the longitudinal centerline CL6 and perpendicular to a first, second, third, and fourth plug rows 730, 740, 750, 760. The first plug row of electrical contacts 308, 308A, 308B can be spaced away from the second plug row by a first row pitch RP1. The second plug row of electrical contacts 308, 308A, 308B can be spaced away from the third plug row of electrical contacts 308, 308A, 308B by a second row pitch RP2. The third plug row of electrical contacts 308, 308A, 308B can be spaced away from the fourth plug row of electrical contacts 308, 308A, 308B by a third row pitch RP3. As discussed above, the first row pitch RP1 and the third row pitch RP3 can be essentially the same. The second row pitch RP1 is numerically greater than the first row pitch RP1 or third row pitch RP3.

Each of the first and second plug keying structures 710A, 710B are configured to receive a corresponding first receptacle keying structure 610A or second receptacle keying structure 610B of the receptacle connector 600 shown in FIGS. 27 and 28. The first and second protrusions 708A, 708B of the plug housing 705 are configured to fit into the respective first and second recesses 608A, 608B of the receptacle connector 600. For example, first receptacle keying feature 610A of the receptacle housing 605 can receive the second plug keying feature 710B of the plug connector 700, and second receptacle keying feature 610B of the receptacle housing 605 or receptacle connector 600 can receive the first plug keying feature 710A of the plug connector 700.

Each of the first and second plug keying structures 710A, 710B can have a four-sided or five-sided perimeter or other geometric shaped perimeter that includes a first plug side wall, line, or surface 712A, a second plug side wall, line, or surface 714B, a canted plug side wall, line, or surface 716, a fourth plug side wall, line, or surface 712B, and a fifth plug side wall, line, or surface 714A. Fifth and second plug side walls 714A, 714B can form right angles with first plug side wall 712A. Fourth plug side wall 712B can form a right angle with fifth plug side wall 714A. Fourth plug side wall 712B can be shorter in width or thickness than any of the other plug side walls 712A, 714A, 714B, 716. Each of the first and second receptacle keying structures 610A, 610B of the receptacle housing 605, discussed earlier, which can be first and second recesses 608A, 608B, are configured to receive a corresponding first plug keying structure 710A or second plug keying structure 710B. The first plug keying structure 710A and the second plug keying structure 710B can both be posts or first and second protrusions 708A, 708B defined by, or positioned adjacent to, plug housing 705.

On one side of the plug housing 705, adjacent to first plug end wall 709A, the longitudinal centerline CL6 can intersect the first protrusion 708A at an intersection I of second plug side wall 714B and the canted plug side wall 716. First and fourth plug side walls 712A, 712B can be unevenly spaced or can be non-uniformly spaced away from the longitudinal centerline CL6. On an opposite end of the plug housing 705, adjacent to plug end wall 709B, the first and fourth plug side walls 712A, 712B can be evenly spaced away from the longitudinal centerline CL6. The first plug keying structure 710A and the second plug keying structure 710B can be identically shaped. The first plug keying structure 710B can be a mirror image of the second plug keying structure 710B, with respect to median centerline ML6 that is perpendicular to the longitudinal centerline CL6 and perpendicular to the first and second plug rows 730, 740. The first plug keying structure 710A and the second plug keying structure 710B can be offset with respect to each other about the centerline CL6, can be offset with respect to each other with respect to the median centerline ML6, or can be both. The first plug keying structure 710A can be a mirror image of the second plug keying structure 710B with respect to median centerline ML6 that is perpendicular to the longitudinal centerline CL6.

Figure 30:
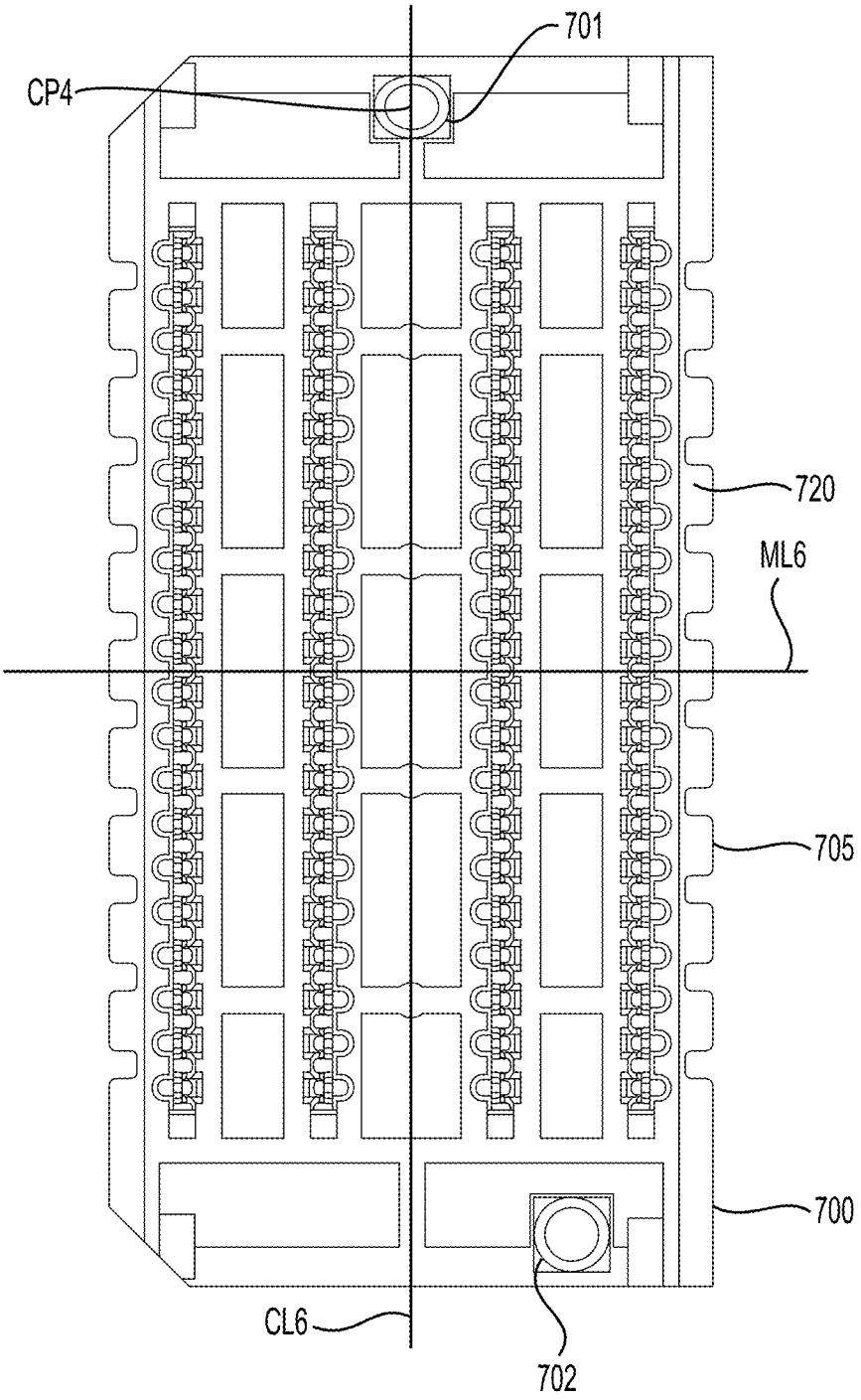
FIG. 30 shows a bottom view of the plug connector shown in FIG. 29.

As shown in FIG. 30, a mounting side 720 interface of the plug connector 700 or plug housing 705 can include a first plug alignment peg 701 and second plug alignment peg 702. The longitudinal centerline CL6 can pass through the first plug alignment peg 701, and the first plug alignment peg 701 may have a center point CP4 that the longitudinal centerline CL6 passes through. The second plug alignment peg 702 can be positioned on either side of the longitudinal centerline CL6, such that the longitudinal centerline CL6 does not intersect the second plug alignment peg 702. In one embodiment, the first plug alignment peg 701 can be positioned, completely or partially, under a perimeter defined by the first plug keying structure 710A or the second plug keying structure 710B of FIG. 29. Second plug alignment peg 702 can be positioned, at least partially or not at all, under a perimeter defined by the first plug keying structure 710A of FIG. 29. The first plug alignment peg 701 can define an oval shape with diameters of approximately 0.8±0.05 mm and 0.6±0.05 mm. The second plug alignment peg 702 can have a circular shape with a diameter of approximately 0.8±0.05 mm. The first and second plug alignment pegs can be reversed, so that the first plug alignment peg 701 defines an oval shape and the second plug alignment peg 702 defines a circular shape. The first and second plug alignment pegs 701, 702 can be positioned asymmetrically about the longitudinal centerline CL6, asymmetrically about the median centerline ML6, or asymmetrically about the longitudinal centerline CL6 and the median centerline ML6.

Figure 31:
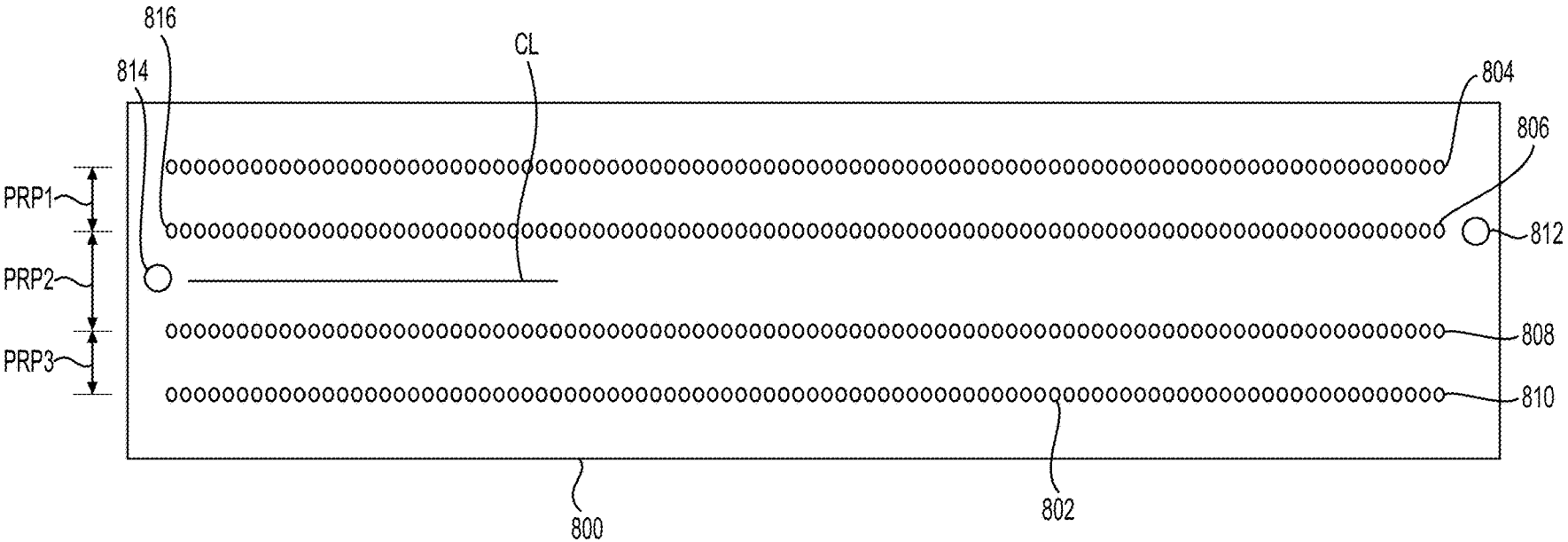
FIGS. 31-35 show various substrate footprint patterns according to various embodiments of the present invention.

FIG. 31 shows an example of a layout of a substrate 800, such as a printed circuit board, daughtercard, or backplane, including pads 802 that can be used to electrically connect with fusible elements of the receptacle connectors or the plug connectors described herein. A first pad row pitch PRP1, measured between respective centers of pads in a first pad row 804 and respective centers of pads in a second pad row 806, can be 2.2±0.2 mm, or any other pitch that corresponds to a mounting receptacle row or plug row. A second pad row pitch PRP2, measured between respective centers of pads in the second pad row 806 and respective centers of pads in a third pad row 808, can be 2.4±0.2 mm, or any other pitch that corresponds to a mounting receptacle row or plug row. A third pad row pitch PRP3, measured between respective centers of pads in the third pad row 808 and respective centers of pads in a fourth pad row 810, can be 2.2±0.2 mm, or any other pitch that corresponds to a mounting receptacle row or plug row.

The first pad row 804 can contain at least at least one hundred pads 802. The second pad row 806 can contain at least one hundred pads 802. The third pad row 808 can contain at least one hundred pads 802. The fourth pad row 810 can contain at least one hundred pads. Pads 802 can be any number greater than sixty, at least one hundred, at least one hundred and fifty, or any whole number of pads greater than sixty and less than one hundred and fifty pads per pad row. A first alignment hole 812 can be 0.8±0.05 mm by 0.6±0.05 mm and can lie along a same line as the second pad row 806 of pads 802 or can be coincident with the second pad row 806 of pads 802. A second alignment hole 814 can be 0.8±0.05 mm in diameter, can be positioned on a centerline CL positioned equidistant between and parallel to the second and third pad rows 806, 808, and can be positioned adjacent to the first pad 816 in the second pad row.

Figure 32:
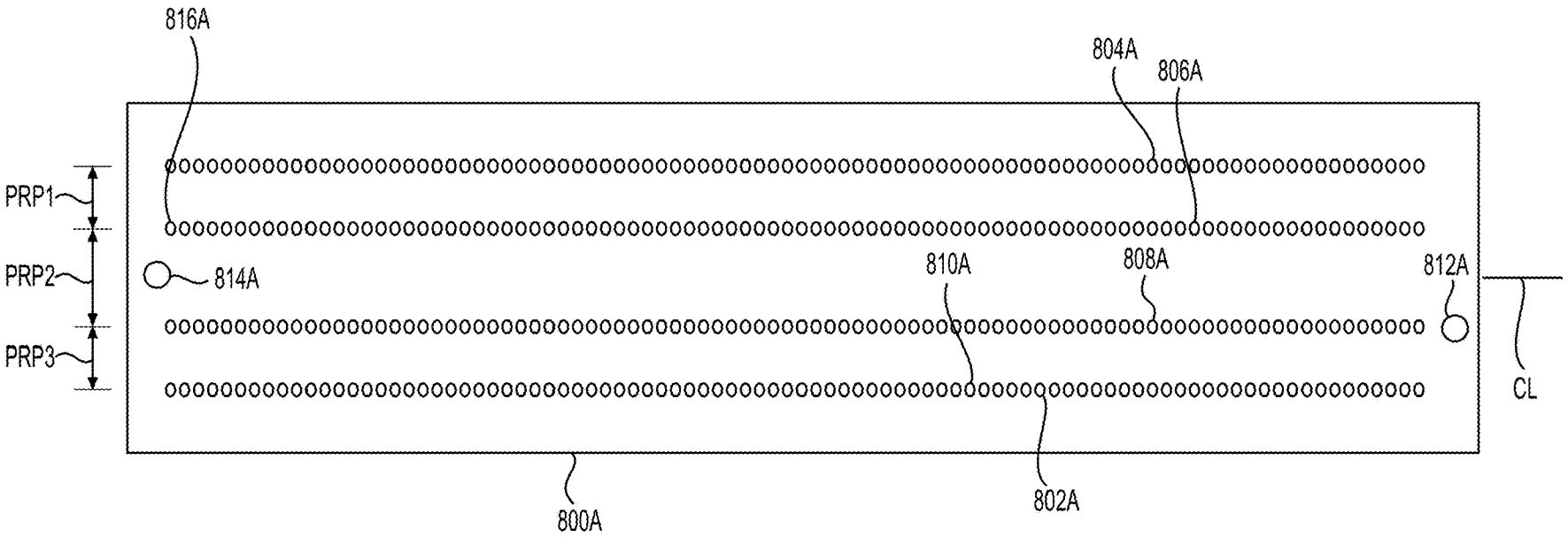

FIG. 32 shows an example of a footprint layout of a substrate 800A, such as a printed circuit board, daughtercard, or backplane, including pads 802A that can be used to electrically connect with fusible elements of the receptacle connectors or the plug connectors described herein. A first pad row pitch PRP1, measured between respective centers of pads in a first pad row 804A and respective centers of pads in a second pad row 806A, can be 2.2±0.2 mm, or any other pitch that corresponds to a mounting receptacle row or plug row. A second pad row pitch PRP2, measured between respective centers of pads in the second pad row 806A and respective centers of pads in a third pad row 808A, can be 2.4±0.2 mm, or any other pitch that corresponds to a mounting receptacle row or plug row. A third pad row pitch PRP3, measured between respective centers of pads in the third pad row 808A and respective centers of pads in a fourth pad row 810A, can be 2.2±0.2 mm, or any other pitch that corresponds to a mounting receptacle row or plug row.

A first alignment hole 812A can lie on the same line as a third pad row 808A of pads 802A. A second alignment hole 814A can be positioned between the second pad row 806A and the third pad row 808A, adjacent to a first pad 816A in the second pad row 806A and the third pad row 808A.

The first pad row 804A can contain at least at least one hundred pads 802A. The second pad row 806A can contain at least one hundred pads 802A. The third pad row 808A can contain at least one hundred pads 802A. The fourth pad row 810A can contain at least one hundred pads. The first alignment hole 812A can be 0.8±0.05 mm in diameter and can lie along a same line as the third pad row 808A of pads 802A or be coincident with the third pad row 808A of pads 802A. The second alignment hole 814A can be 0.8±0.05 mm by 0.6±0.05 mm, can be positioned on a centerline CL positioned equidistant between and parallel to the second and third pad rows 806A, 808A, and can be positioned adjacent to a first pad 816A in the second pad row 806A.

Figure 33:
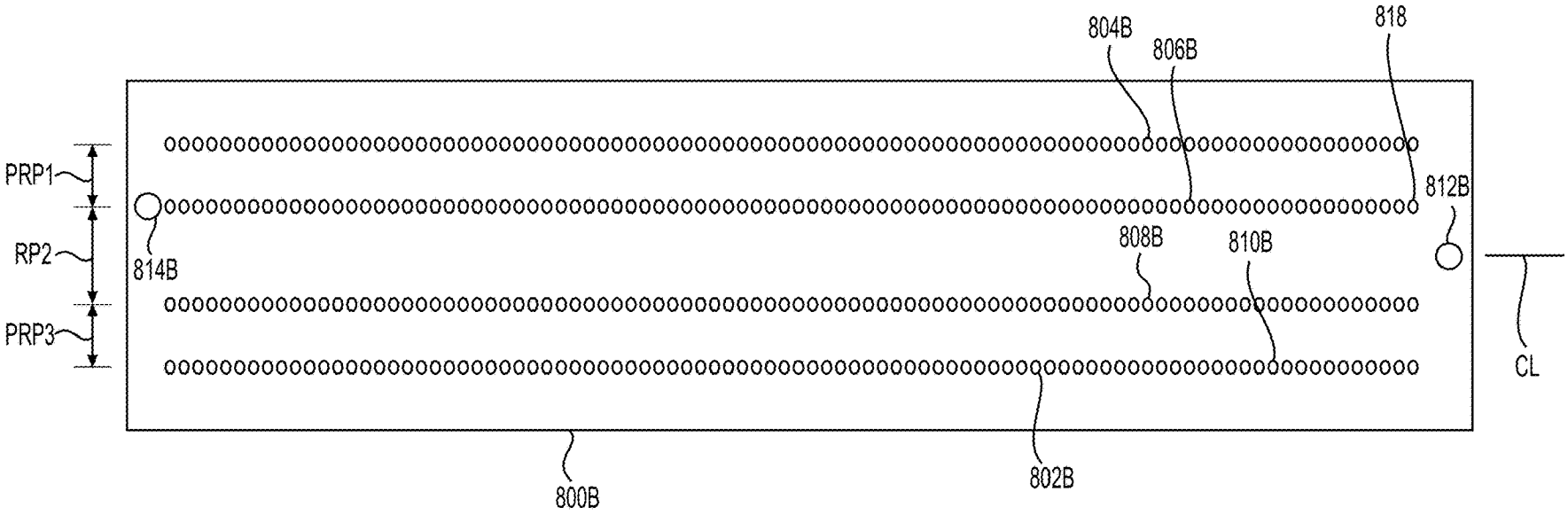

FIG. 33 shows an example of a layout of a substrate 800B, such as a printed circuit board, daughtercard, or backplane, including pads 802B that can be used to electrically connect with fusible elements of the receptacle connectors or the plug connectors described herein. A first pad row pitch PRP1, measured between respective centers of pads in a first pad row 804B and respective centers of pads in a second pad row 806B, can be 2.2±0.2 mm, or any other pitch that corresponds to a mounting receptacle row or plug row. A second pad row pitch PRP2, measured between respective centers of pads in the second pad row 806B and respective centers of pads in a third pad row 808B, can be 2.4±0.2 mm, or any other pitch that corresponds to a mounting receptacle row or plug row. A third pad row pitch PRP3, measured between respective centers of pads in the third pad row 808B and respective centers of pads in a fourth pad row 810B, can be 2.2±0.2 mm, or any other pitch that corresponds to a mounting receptacle row or plug row.

A first alignment hole 812B can be positioned between the second pad row 806B and the third pad row 808B, adjacent to a last pad 818 in the second pad row 806B and the third pad row 808B. A second alignment hole 814B can lie on the same line as a second pad row 806B of pads 802A.

Figure 34:
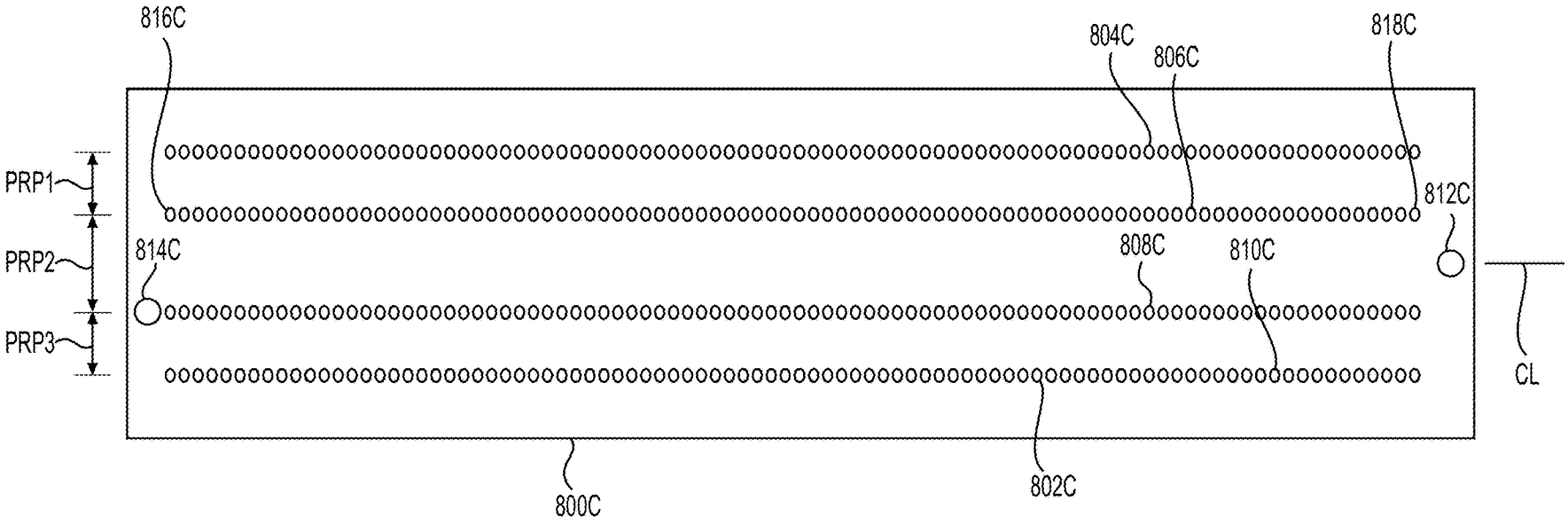

FIG. 34 shows an example of a layout of a substrate 800C, such as a printed circuit board, daughtercard, or backplane, including pads 802C that can be used to electrically connect with fusible elements of the receptacle connectors or the plug connectors described herein. A first pad row pitch PRP1, measured between respective centers of pads in a first pad row 804C and respective centers of pads in a second pad row 806C, can be 2.2±0.2 mm, or any other pitch that corresponds to a mounting receptacle row or plug row. A second pad row pitch PRP2, measured between respective centers of pads in the second pad row 806C and respective centers of pads in a third pad row 808C, can be 2.4±0.2 mm, or any other pitch that corresponds to a mounting receptacle row or plug row. A third pad row pitch PRP3, measured between respective centers of pads in the third pad row 808C and respective centers of pads in a fourth pad row 810C, can be 2.2±0.2 mm, or any other pitch that corresponds to a mounting receptacle row or plug row.

A first alignment hole 812C can be positioned between the second pad row 806C and the third pad row 808C, adjacent to a last pad 818C in the second pad row 806C and the third pad row 808C. A second alignment hole 814C can lie on the same line as a third pad row 808C of pads 802C.

Figure 35:
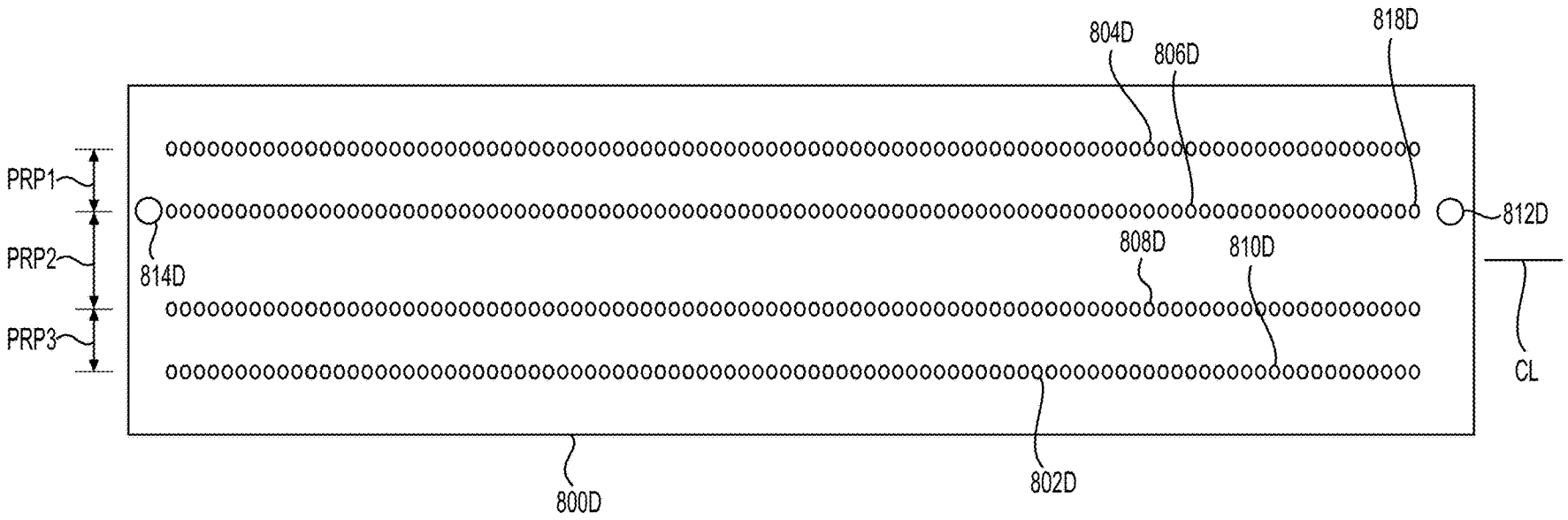

FIG. 35 shows an example of a layout of a substrate 800D, such as a printed circuit board, daughtercard, or backplane, including pads 802D that can be used to electrically connect with fusible elements of the receptacle connectors or the plug connectors described herein. A first pad row pitch PRP1, measured between respective centers of pads in a first pad row 804D and respective centers of pads in a second pad row 806D, can be 2.2±0.2 mm, or any other pitch that corresponds to a mounting receptacle row or plug row. A second pad row pitch PRP2, measured between respective centers of pads in the second pad row 806D and respective centers of pads in a third pad row 808D, can be 2.4±0.2 mm, or any other pitch that corresponds to a mounting receptacle row or plug row. A third pad row pitch PRP3, measured between respective centers of pads in the third pad row 808D and respective centers of pads in a fourth pad row 810D, can be 2.2±0.2 mm, or any other pitch that corresponds to a mounting receptacle row or plug row.

A first alignment hole 812D can be positioned on the same line as second the second pad row 806D. A second alignment hole 814D can be positioned on the same line as a third pad row 808D of pads 802D and the first alignment hole 812D.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims. Any description of any one embodiment can be combined with of the description of any other embodiment disclosed herein.

What is claimed is:

1. An electrical connector comprising:

a housing that defines at least four consecutive, immediately adjacent cores positioned on a common line;

a first electrical contact that defines a first retention shape, the first electrical contact positioned in a first one of the four consecutive, immediately adjacent cores;

a second electrical contact that defines a second retention shape, the second electrical contact positioned in a second one of the four consecutive, immediately adjacent cores, the second electrical contact positioned immediately adjacent to the first electrical contact;

a third electrical contact that defines the first retention shape, the third electrical contact positioned in a third one of the four consecutive, immediately adjacent cores, the third electrical contact positioned immediately adjacent to the second electrical contact; and a fourth electrical contact that defines the second retention shape, the fourth electrical contact positioned in a fourth one of the four consecutive, immediately adjacent cores, the fourth electrical contact positioned immediately adjacent to the third electrical contact, wherein the first electrical contact and the third electrical contact are inserted into the housing in a first direction, the second electrical contact and the fourth electrical contact are inserted into the housing in a second direction that is opposite to the first direction, and the first, second, third, and fourth electrical contacts all lie on a common centerline and are all evenly spaced apart and have the same contact pitch, the first retention shapes of the first and the third electrical contacts and the second retention shapes of the second and the fourth electrical contacts engage respective ones of the at least four consecutive, immediately adjacent cores at different heights, the first electrical contact further defines a first mating end shape, the second electrical contact further defines a second mating end shape, the third electrical contact further defines the first mating end shape, the fourth electrical contact further defines the second mating end shape, and the first mating end shape is a same shape as the second mating end shape.

2. The electrical connector of claim 1, wherein the electrical connector is an open pin field connector.

3. The electrical connector of claim 2, wherein the electrical connector is a mezzanine connector that mates with another mezzanine connector.

4. The electrical connector of claim 2, further comprising a fusible member attached to the first electrical contact prior to reflow.

5. The electrical connector of claim 2, wherein the second retention shape of the second electrical contact is inserted completely in the second one of the four consecutive, immediately adjacent cores.

6. The electrical connector of claim 2, wherein the electrical connector is devoid of crosstalk shields.

7. The electrical connector of claim 2, further comprising:

a first row defined by the at least four consecutive, immediately adjacent cores;

a second row of cores spaced from the first row by a first row pitch;

a third row of cores spaced from the second row by a second row pitch; and a fourth row of cores spaced from the third row by the first row pitch, wherein the first row pitch is about 2.2 mm and the second row pitch is about 2.4 mm.

8. The electrical connector of claim 2, wherein the electrical connector has a data rate per channel of at least 32 Gbits/sec with an insertion loss between 0 dB and −1.5 dB.

9. The electrical connector of claim 2, wherein the electrical connector has an aggregate data rate of at least 4096 Gbits/sec with an insertion loss between 0 dB and −1.5 dB.

10. The electrical connector of claim 2, wherein the electrical connector has a data rate density of at least 2088 Gbits/sec per square inch or 13467 Gbits/sec per square centimeter, with an insertion loss between 0 dB and −1.5 dB.

11. The electrical connector of claim 1, wherein electrical contacts in a first row of electrical contacts are alternatingly stitched into a top of the housing and a bottom of the housing.

12. The electrical connector of claim 2, wherein electrical contacts in a first row of electrical contacts are alternatingly stitched into a top of the housing and a bottom of the housing.

13. The electrical connector of claim 2, wherein the first and second electrical contacts are configured to define a differential pair and/or the third and fourth electrical contacts are configured to define a differential pair.

* * * * *